US007462979B2

(12) United States Patent
Konishi et al.

(10) Patent No.: US 7,462,979 B2
(45) Date of Patent: Dec. 9, 2008

(54) COLD CATHODE FIELD EMISSION DISPLAY

(75) Inventors: Morikazu Konishi, Kanagawa (JP); Koichi Iida, Gifu (JP)

(73) Assignee: Sony Corporation (JP)

( * ) Notice: Subject to any disclaimer, the term of this patent is extended or adjusted under 35 U.S.C. 154(b) by 600 days.

(21) Appl. No.: 10/512,136

(22) PCT Filed: Mar. 27, 2003

(86) PCT No.: PCT/JP03/03801

§ 371 (c)(1),
(2), (4) Date: Dec. 14, 2005

(87) PCT Pub. No.: WO03/100813

PCT Pub. Date: Dec. 4, 2003

(65) Prior Publication Data

US 2006/0087248 A1 Apr. 27, 2006

(30) Foreign Application Priority Data

May 24, 2002 (JP) ..... 2002-150291
Oct. 10, 2002 (JP) ..... 2002-297252

(51) Int. Cl.
*H01J 1/46* (2006.01)

(52) U.S. Cl. ..... 313/306; 313/309; 313/497; 445/51; 315/169.1

(58) Field of Classification Search ..... 313/306–310, 313/496, 497; 445/24, 51; 438/20, 29, 34, 438/257, 259; 315/169.1, 169.3
See application file for complete search history.

(56) References Cited

U.S. PATENT DOCUMENTS 6,580,223 B2 * 6/2003 Konishi et al. ..... 315/169.3
6,900,066 B2 * 5/2005 Toyota et al. ..... 438/20
6,991,949 B2 * 1/2006 Muroyama et al. ..... 438/20
7,329,978 B2 * 2/2008 Konishi ..... 313/306

FOREIGN PATENT DOCUMENTS

JP 10-326583 12/1998
JP 2000-251797 A 9/2000

(Continued)

OTHER PUBLICATIONS

Japanese Office Action; Application No. 2002-297252; Dated: Sep. 4, 2007.
Japanese Office Action No. 2007-171685—dated Oct. 16, 2007.
International Search Report dated Jul. 8, 2003.

(Continued)

*Primary Examiner*—Haissa Philogene
(74) *Attorney, Agent, or Firm*—Rader Fishman & Grauer PLLC; Ronald P. Kananen

(57) ABSTRACT

An anode electrode 20 in an anode panel constituting a cold cathode field emission display is constituted of anode electrode units 21 in the number of N (N≧2), each anode electrode unit is connected to an anode-electrode control circuit 43 through one electric supply line 22, and $V_A/L_g<1$ (kV/μm) is satisfied in which $V_A$ (unit:kilovolt) is a voltage difference between an output voltage of the anode-electrode control circuit and a voltage applied to a cold cathode field emission device, and $L_g$ (unit:μm) is a gap length between the anode electrode units.

36 Claims, 29 Drawing Sheets

FOREIGN PATENT DOCUMENTS

| | | | |
|---|---|---|---|
| JP | 3199682 | | 6/2001 |
| JP | 3199682 | B2 | 8/2001 |
| JP | 2001-243893 | | 9/2001 |
| JP | 2001-243893 | A | 9/2001 |
| JP | 2002-175764 | | 6/2002 |
| JP | 2000-251797 | | 9/2007 |

OTHER PUBLICATIONS

PCT International Preliminary Examination Report and Translation dated Feb. 17, 2004.
PCT Written Opinion and Translation dated Nov. 18, 2003.
Japanese Office Action; Application No.: 2002-297252, Date: May 1, 2007.

* cited by examiner

[STEP-A2]

[STEP-A3]

[STEP—A4]

[STEP—A5]

[STEP—B3]

[STEP—B5]

[STEP–B6]

[STEP–B7]

COLD CATHODE FIELD EMISSION DISPLAY

TECHNICAL FIELD

The present invention relates to a cold cathode field emission display having a characteristic feature in an anode electrode provided in an anode panel.

BACKGROUND ART

In the fields of displays for use in television receivers and information terminals, studies have been made for replacing conventionally mainstream cathode ray tubes (CRT) with flat-panel displays which are to comply with demands for a decrease in thickness, a decrease in weight, a larger screen and a high fineness. Such flat panel displays include a liquid crystal display (LCD), an electroluminescence display (ELD), a plasma display panel (PDP) and a cold cathode field emission display (FED). Of these, a liquid crystal display is widely used as a display for an information terminal. For applying the liquid crystal display to a floor-type television receiver, however, it still has problems to be solved concerning a higher brightness and an increase in size. In contrast, a cold cathode field emission display uses cold cathode field emission devices (to be sometimes referred to as "field emission device" hereinafter) capable of emitting electrons from a solid into a vacuum on the basis of a quantum tunnel effect without relying on thermal excitation, and it is of great interest from the viewpoints of a high brightness and a low power consumption.

FIGS. 29 and 4 shows a cold cathode field emission display to which the field emission devices are applied (to be sometimes referred to as "display" hereinafter). FIG. 29 is a schematic partial end view of the conventional display, and FIG. 4 is a schematic partial perspective view of a cathode panel CP.

The field emission device shown in FIG. 29 is a so-called Spindt-type field emission device having a conical electron-emitting portion. Such a field emission device comprises a cathode electrode 11 formed on a supporting member 10, an insulating layer 12 formed on the supporting member 10 and the cathode electrode 11, a gate electrode 13 formed on the insulating layer 12, an opening portion 14 formed through the gate electrode 13 and the insulating layer 12 (a first opening portion 14A formed through the gate electrode 13 and a second opening portion 14B formed through the insulating layer 12), and a conical electron-emitting portion 15 formed on the cathode electrode 11 positioned in the bottom portion of the second opening portion 14B. Generally, the cathode electrode 11 and the gate electrode 13 are formed in the form of a stripe each in directions in which the projection images of these two electrodes cross each other at right angles. Generally, a plurality of field emission devices are arranged in a region (corresponding to one pixel, and the region will be called an "overlap region" or an "electron-emitting region" hereinafter) where the projection images of the above two electrodes overlap. Further, generally, such electron-emitting regions are arranged in the form of a two-dimensional matrix within an effective field (which works as an actual display portion) of the cathode panel CP.

An anode panel AP comprises a substrate 30, phosphor layers 31 (31R, 31B, 31G) being formed on the substrate 30 and having a predetermined pattern, and an anode electrode 220 formed thereon. The anode electrode 220 has the form of one sheet covering the effective field and is formed, for example, of an aluminum thin film. Generally provided between an anode-electrode control circuit 43 and the anode electrode 220 is a resister $R_0$ (resistance value 10 MΩ in a shown example) for preventing excess current and discharge. The resister $R_0$ is provided outside the substrate.

Each pixel is constituted of a group of the field emission devices formed on the overlap region of the cathode electrode 11 and the gate electrode 13 of the cathode panel side and the phosphor layer 31 of the anode panel side arranged so as to face the group of the field emission devices. In the effective field, such pixels are arranged on the order, for example, of hundreds of thousands to several millions. A black matrix 32 is formed on the substrate 30 between one phosphor layer 31 and another phosphor layer 31, and a separation wall 33 is formed on the black matrix 32.

The anode panel AP and the cathode panel CP are arranged such that the electron-emitting regions and the phosphor layers 31 are opposed to each other, and the anode panel AP and the cathode panel CP are bonded to each other in their circumferential portions through a frame 35, whereby the display is produced. In an ineffective field which surrounds the effective field and where a peripheral circuit for selecting pixels is provided, a through-hole (not shown) for vacuuming is provided, and a tip tube (not shown) is connected to the through-hole and sealed after vacuuming. That is, a space surrounded by the anode panel AP, the cathode panel CP and the frame 35 is in a vacuum state.

A relatively negative voltage is applied to the cathode electrode 11 from a cathode-electrode control circuit 41, a relatively positive voltage is applied to the gate electrode 13 from a gate-electrode control circuit 42, and a positive voltage having a higher level than the voltage applied to the gate electrode 13 is applied to the anode electrode 220 from an anode-electrode control circuit 43. When such a display is used for displaying on its screen, a scanning signal is inputted to the cathode electrode 11 from the cathode-electrode control circuit 41, and a video signal is inputted to the gate electrode 13 from the gate-electrode control circuit 42. Due to an electric field generated when a voltage is applied between the cathode electrode 11 and the gate electrode 13, electrons are emitted from the electron-emitting portion 15 on the basis of a quantum tunnel effect, and the electrons are attracted toward the anode electrode 220 and collide with the phosphor layer 31. As a result, the phosphor layer 31 is excited to emit light, and a desired image can be obtained. That is, the working of the display is controlled, in principle, by a voltage applied to the gate electrode 13 and a voltage applied to the electron-emitting portion 15 through the cathode electrode 11.

In JP-A-2001-243893, Applicant proposes a display panel in which an anode electrode is constituted of a plurality of anode electrode units.

Meanwhile, in the above display, the distance between the anode panel AP and the cathode panel CP is about 1 mm at the largest, and an abnormal discharge (vacuum arc discharge) is liable to take place between the field emission device on the cathode panel and the anode electrode 220 on the anode panel AP. When the abnormal discharge takes place, not only the display quality is impaired, but also the field emission device or the anode electrode 220 is damaged.

In a mechanism in which a discharge takes place in a vacuum space, first, electrons and ions that are emitted from the field emission device under a strong electric field work as a trigger to cause a small-scaled discharge. And, energy is supplied to the anode electrode 220 from the anode-electrode control circuit 43, the anode electrode 220 is locally temperature-increased, and an occluded gas inside the anode electrode 220 is released, or a material constituting the anode electrode 220 is caused to vaporize, so that the small-scaled discharge presumably grows to be an abnormal discharge. Besides the anode-electrode control circuit 43, energy accumulated in an electrostatic capacity formed between the anode electrode 220 and the field emission device may possibly work as a source for supplying energy that promotes the growth to the abnormal discharge.

For inhibiting the abnormal discharge (vacuum arc discharge), it is effective to control the emission of electrons and ions which trigger the discharge, while it is required to control the particles extremely strictly therefor. In a general production process of the anode panels AP or the display panels using the anode panels AP, practicing the above control involves great technical difficulties.

While the anode electrode unit proposed in JP-A-2001-243893 has an effect on inhibiting the growth of a small-scale discharge to a large-scale discharge, it has been found to still have room for further improvements.

It is therefore an object of the present invention to provide a cold cathode field emission display having an anode electrode that is so structured as to more reliably inhibit the growth of a small-scale discharge to a large-scale discharge.

DISCLOSURE OF THE INVENTION

The cold cathode field emission display according to a first aspect of the present invention for achieving the above object is a cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, one electric supply line, and an anode electrode formed on the phosphor layer, the anode electrode is constituted of anode electrode units in the number of N ($N \geqq 2$), each anode electrode unit is connected to an anode-electrode control circuit through said electric supply line, and $V_A/L_g<1$ (kV/μm) is satisfied in which $V_A$ (unit:kilovolt) is a voltage difference between an output voltage of the anode-electrode control circuit and a voltage applied to the cold cathode field emission device, and $L_g$ (unit:μm) is a gap length between the anode electrode units.

In the cold cathode field emission display according to the first aspect of the present invention, or in a cold cathode field emission display according to a third aspect of the present invention to be described later, the gap length $L_g$ between the anode electrode units may be constant regardless of positions of the anode electrode units, or it may be different depending upon the positions of the anode electrode units.

The cold cathode field emission display according to a second aspect of the present invention for achieving the above object is a cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, one electric supply line, and an anode electrode formed on the phosphor layer, the anode electrode is constituted of anode electrode units in the number of N ($N \geqq 2$), each anode electrode unit is connected to an anode-electrode control circuit through said electric supply line, and $(V_A/7)^2 \times (S/d) \leqq 2250$ is satisfied in which d (unit:mm) is a distance between the anode electrode unit and the cold cathode field emission device, and S (unit:$mm^2$) is an area of the anode electrode unit.

The cold cathode field emission display according to a third aspect of the present invention for achieving the above object is a cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, and an anode electrode formed on the phosphor layer, the anode electrode is constituted of anode electrode units in the number of N ($N \geqq 2$), a resistance layer is formed between the anode electrode units, one anode electrode unit is connected to an anode-electrode control circuit, and $V_A/L_g<1$ (kV/μm) is satisfied in which $V_A$ (unit:kilovolt) is a voltage difference between an output voltage of the anode-electrode control circuit and a voltage applied to the cold cathode field emission device, and $L_g$ (unit:μm) is a gap length between the anode electrode units.

The cold cathode field emission display according to a fourth aspect of the present invention for achieving the above object is a cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, and an anode electrode formed on the phosphor layer, the anode electrode is constituted of anode electrode units in the number of N ($N \geqq 2$), a resistance layer is formed between the anode electrode units, one anode electrode unit is connected to an anode-electrode control circuit, $(V_A/7)^2 \times (S/d) \leqq 2250$ is satisfied in which d (unit:mm) is a distance between the anode electrode unit and the cold cathode field emission device, and S (unit:$mm^2$) is an area of the anode electrode unit.

In the cold cathode field emission display according to the third or fourth aspect of the present invention, the anode electrode units are connected in series through the resistance layer, and one of a plurality of the anode electrode units is connected to the anode-electrode control circuit. Which one of the anode electrode units connected in series is the above anode electrode unit connected to the anode-electrode control circuit is essentially arbitrary. For example, it may be the anode electrode unit positioned in the center of the anode electrode units connected in series, or it may be the anode electrode unit positioned in an end of the anode electrode units connected in series.

The cold cathode field emission display according to a fifth aspect of the present invention for achieving the above object is a cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, and an anode electrode formed on the phosphor layer, the anode electrode is constituted of anode electrode units in the number of N ($N \geqq 2$), and each anode electrode unit has a size that inhibits energy generated by a discharge taking place between the anode electrode unit and the cold cathode field emission device from vaporizing the anode electrode unit locally.

In the cold cathode field emission display according to the fifth aspect of the present invention, preferably, the anode electrode unit has a size that inhibits energy generated by a discharge taking place between the anode electrode unit and the cold cathode field emission device from vaporizing a portion of the anode electrode unit which portion has a size equivalent to one subpixel.

In the cold cathode field emission display according to the first, second or fifth aspect of the present invention, preferably, a resistance layer is formed between the anode electrode units for inhibiting the occurrence of a discharge between the anode electrode units. The above cold cathode field emission display according to the first, second or fifth aspect of the present invention will be referred to as "cold cathode field emission display according to the first-A, second-A or fifth-A aspect of the present invention" for convenience.

In the cold cathode field emission display according to the first, second or fifth aspect of the present invention including the cold cathode field emission display according to the first-A, second-A or fifth-A aspect of the present invention, or in the cold cathode field emission display according to the third or fourth aspect of the present invention, desirably, that edge portion of each anode electrode unit which does not face the adjacent anode electrode unit is covered with a resistance layer for preventing the growth of a small-scale discharge at the edge portion of the anode electrode unit to a large-scale discharge.

In the cold cathode field emission display according to the first or second aspect of the present invention including the first-A or second-A aspect of the present invention, it is more preferred to employ a constitution in which a gap is provided between each anode electrode unit and the electric supply line, and each anode electrode unit and the electric supply line are connected through a resistance element. The above resistance element will be sometimes referred to as "first resistance element" for convenience. The first resistance element can temporarily stop the supply of energy from the anode-electrode control circuit when a discharge occurs.

In this case and when the resistance layer having a resistance value $r_0$ is further formed, preferably, $30r_0 \leqq r_1 \leqq 100r_0$ is satisfied in which $r_1$ is a resistance value of the resistance element (first resistance element). In a preferred constitution, the electric supply line is constituted of electric supply line units in the number of M ($2 \leqq M \leqq N$) connected in series through a second resistance element (or second resistance elements) and one electric supply line unit is connected to one or at least two anode electrode units, and still more preferably, $10M \leqq N \leqq 100N$ is satisfied. These constitutions can be applied to the cold cathode field emission display according to the fifth aspect of the present invention. When the electric supply line is constituted of a plurality of electric supply line units, the area of the electric supply line unit can be decreased, so that the damage caused on the electric supply line by a discharge between the electric supply line and the cold cathode field emission device (for example, local vaporization of the electric supply line) can be inhibited.

When the distance between the anode electrode unit and the cold cathode field emission device is d (unit:mm) and when the electric supply line unit has an area S' (unit:$mm^2$), $(V_A/7)^2 \times (S'/d) \leqq 2250$ is satisfied, preferably, $(V_A/7)^2 \times (S'/d) \leqq 450$ is satisfied, which is desirable for more reliably preventing the damage that is caused on the electric supply line unit by a discharge between the electric supply line and the cold cathode field emission device (for example, local vaporization of the electric supply line unit). The electric supply line units may have the same sizes or different sizes.

Further, for preventing the growth of a small-scale discharge at an edge portion of the electric supply line or the electric supply line unit to a large-scale discharge, preferably, the edge portion of the electric supply line or the electric supply line unit is covered with a resistive element film. Alternatively, the electric supply line or the electric supply line unit may be covered with a resistive element film.

In the cold cathode field emission display according to each of the first to fifth aspects of the present invention including the first-A, second-A and fifth-A aspects of the present invention (to be sometimes referred to as "cold cathode field emission display of the present invention" hereinafter), it is preferred to employ a constitution in which a stripe-shaped transparent electrode connected to the anode-electrode control circuit is formed between the phosphor layer and the substrate, and further, it is more preferred to employ a constitution in which a plurality of unit phosphor layers, each constituting one picture element (1 pixel), are arranged in the form of a straight line and a stripe-shaped transparent electrode connected to the anode-electrode control circuit is formed between a column constituted of a plurality of the unit phosphor layers arranged in the form of a straight line and the substrate. That is, when the total number of columns of the unit phosphor layers arranged in the form of a straight line is n columns, the number of the stripe-shaped transparent electrodes is a maximum of n. There may be also employed a constitution in which a stripe-shaped transparent electrode connected to the anode-electrode control circuit is formed between a plurality of columns of unit phosphor layers arranged in the form of a straight line and the substrate. Thus-formed transparent electrode can reliably prevent excess charge of the phosphor layer and can inhibit the deterioration that is caused on the phosphor layer by the excess charge. When the thus-structured transparent electrodes are provided, the designing of the cold cathode field emission display made on an experimental basis can be easily changed. In a color display, one column of the unit phosphor layers arranged in the form of a straight line may be entirely constituted of a column of unit phosphor layers that emit light in red, a column of unit phosphor layers that emit light in green, or a column of unit phosphor layers that emit light in blue, or it may be constituted of a column of unit phosphor layers that emit light in red, unit phosphor layers that emit light in green and unit phosphor layers that emit light in blue, in which the unit phosphor layer that emits light in red, the unit phosphor layer that emits light in green and the unit phosphor layer that emits light in blue are consecutively arranged. The above unit phosphor layer is defined to be a phosphor layer that generates one bright spot on a display panel. One picture element (one pixel) is constituted of a set of one unit phosphor layer that emits light in red, one unit phosphor layer that emits light in green and one unit phosphor layer that emits light in blue, and one subpixel is constituted of one unit phosphor layer (one unit phosphor layer that emits light in red, one unit phosphor layer that emits light in green, or one unit phosphor layer that emits light in blue). Further, the size equivalent to one subpixel in the anode electrode unit means a size of that portion of the anode electrode unit which covers one unit phosphor layer.

In the cold cathode field emission display according to the first aspect of the present invention including the first-A aspect of the present invention, the third aspect of the present invention, or the fifth aspect of the present invention including the fifth-A aspect of the present invention, when the distance between the anode electrode unit and the cold cathode field emission device is d (unit:mm) and when the anode electrode unit has an area S (unit:$mm^2$), preferably, $(V_A/7)^2\times(S/d)\leqq 2250$ is satisfied, more preferably, $(V_A/7)^2\times(S/d)\leqq 450$ is satisfied, for preventing the scale-up of damage caused on the anode electrode unit, such as melting of the anode electrode unit, due to a discharge between the anode electrode unit and the cold cathode field emission device.

In the cold cathode field emission display according to the second aspect of the present invention including the second-A aspect of the present invention or the fourth aspect of the present invention, more preferably, $(V_A/7)^2\times(S/d)\leqq 450$ is satisfied.

When a convexoconcave shape exists in the anode electrode unit and when the distance d between the anode electrode unit and the cold cathode field emission device is not constant, the shortest distance between the anode electrode unit and the cold cathode field emission device is taken as d.

In the cold cathode field emission display of the present invention, generally, the output voltage of the anode-electrode control circuit is constant. The method of operation of the cold cathode field emission display includes (1) a method in which the voltage to be applied to the cathode electrode is constant and the voltage to be applied to the gate electrode is changed, (2) a method in which the voltage to be applied to the cathode electrode is changed and the voltage to be applied to the gate electrode is constant, and (3) a method in which the voltage to be applied to the cathode electrode is changed and the voltage to be applied to the gate electrode is also changed. The voltage difference $V_A$ between the output voltage of the anode-electrode control circuit and the voltage applied to the cold cathode field emission device can be a voltage difference between the output voltage of the anode-electrode control circuit and the voltage applied to the cathode electrode in the case of (1), or it can be the maximum of a voltage difference between the output voltage of the anode-electrode control circuit and the voltage applied to the cathode electrode in the cases of (2) and (3).

In the cold cathode field emission display of the present invention, it is sufficient that the anode electrode should be formed at least on the phosphor layer, and the anode electrode may extend onto the substrate where no phosphor layer is formed. Specifically, the anode electrode as a whole covers at least the effective field that functions as an actual display portion. The circumference of the effective field is an ineffective field that supports the function of the effective field such as the mounting of peripheral circuits and the mechanical supporting of a display screen. While the outer form of the anode electrode unit may be essentially any form, it is preferably a rectangular form (the form of a stripe) in view of an easiness in its processing and the like. When the effective field is assumed to have a rectangular form, the extending direction of the anode electrode unit having a rectangular form may be a length direction or may be a width direction of the effective field.

It is sufficient that the number (N) of the anode electrode units should be 2 or more. For example, when the total sum of columns of unit phosphor layers arranged in the form of a straight line is n columns, N=n, $n=\alpha\cdot N$ ($\alpha$ is an integer of 2 or greater, preferably $10\leqq\alpha\leqq 100$, more preferably $20\leqq\alpha\leqq 50$), or N may be the number obtained by adding 1 to the number of spacers arranged at constant intervals. The sizes of the anode electrode units may be the same regardless of positions of the anode electrode units, or they may differ depending upon the positions of the anode electrode units.

The resistance value $r_0$ of the resistance layer is, for example, $1\times 10\ \Omega$ to $1\times 10^3\ \Omega$, preferably $1\times 10\ \Omega$ to $2\times 10^2\ \Omega$.

The resistance value of the resistance element is selected such that it is at a low level at which almost no effect is caused on the display brightness when a voltage drop is caused by an anode current during general display operation and that it is at a high level at which the supply of energy to the anode electrode unit from the anode-electrode control circuit through the electric supply line is temporarily blocked when a small-scale discharge takes place. The resistance value can be selected from the range of several tens kΩ to 1 MΩ so long as the above conditions are satisfied. Preferably, the resistance value $r_1$ of the resistance element (first resistance element) and the resistance value $r_0$ of the resistance layer satisfy the above relationship.

The first resistance element and the second resistance element include a chip resistor or a resistive element film. Further, the material for constituting the resistance layer or the resistive element film constituting the first resistance element or the second resistance element includes carbon materials such as silicon carbide (SiC) and SiCN; SiN; refractory metal oxides such as ruthenium oxide ($RuO_2$), tantalum oxide, tantalum nitride, chromium oxide and titanium oxide; semiconductor materials such as amorphous silicon; and ITO.

The electric supply line, the first resistance element and the second resistance element can be formed on the ineffective field. A connecting terminal is provided in an end portion of the electric supply line or an end portion of the anode electrode unit, and the connecting terminal is connected to the anode-electrode control circuit through a wiring.

The anode electrode units and the electric supply line can be formed on the phosphor layer and the substrate using a common conductive material layer. For example, a conductive material layer made of a certain conductive material is formed on the substrate and patterned, whereby the anode electrode units and the electric supply line can be formed simultaneously. Alternatively, a conductive material is vapor-deposited or screen-printed through a mask or screen having a pattern of the anode electrode units and the electric supply line, whereby the anode electrode unit and the electric supply line can be simultaneously formed on the phosphor layer and the substrate. The resistance layer or the resistance element can be also formed by a similar method. That is, the resistance layer or the resistance element may be formed from a certain resistive material and patterned. Alternatively, a resistive material may vapor-deposited or screen-printed through a mask or screen having a pattern of the resistance layer or the resistance element, to form the resistance layer or the resistance element.

In the cold cathode field emission display of the present invention, more specifically, the cold cathode field emission device (to be referred to as "field emission device" hereinafter) comprises, for example;

(A) a cathode electrode being formed on a supporting member and extending in a first direction, (B) an insulating layer formed on the supporting member and the cathode electrode, (C) a gate electrode being formed on the insulating layer and extending in a second direction different from the first direction, (D) an opening portion formed through the gate electrode and the insulating layer, and (E) an electron-emitting portion exposed in the bottom portion of the opening portion.

The form of the field emission device in the cold cathode field emission display of the present invention is not specially limited, and it may be any form of a Spindt-type device, an edge-type device, a flat-type device, a plane-type device or a crown-type device. Preferably, the cathode electrode and the gate electrode have the form of a stripe, and the projection image of the cathode electrode and the projection image of the gate electrode cross each other at right angles in view of the simplification of structure of the cold cathode field emission display. Further, the field emission device may be provided with a focus electrode.

In addition to the above-mentioned forms of the field emission device, a device generally called a surface-conduction-type electron emitting device is known as the field emission device and can be applied to the cold cathode field emission display of the present invention. In the surface-conduction-type electron emitting device, thin films composed of material such as tin oxide ($SnO_2$), gold (Au), indium oxide ($In_2O_3$)/tin oxide ($SnO_2$), carbon, palladium oxide (Pod) or the like and having a very small area are formed in the form of a matrix on the substrate made, for example, of glass. Each thin film is constituted of a pair of thin film fragments and has a constitution in which a wiring in the row direction is connected to one of each pair of the thin film fragments and a wiring in the column direction is connected to the other of each pair of the thin film fragments and a several nm gap is formed between one of each pair of the thin film fragments and the other of each pair of the thin film fragments. In the thin film selected by the wiring in the row direction and the wiring in the column direction, electrons are emitted from the thin film through the gap.

The substrate for constituting the cold cathode field emission display in the present invention includes a glass substrate, a glass substrate having an insulating film formed on its surface, a quartz substrate, a quartz substrate having an insulating film formed on its surface and a semiconductor substrate having an insulating film formed on its surface. From the viewpoint that the production cost is decreased, it is preferred to use a glass substrate or a glass substrate having an insulating film formed on its surface. Examples of the glass substrate include high-distortion glass, soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). A supporting member for constituting the cathode panel can have the same constitution as that of the above substrate.

The material for constituting the anode electrode unit, the electric supply line, the cathode electrode or the gate electrode includes metals such as aluminum (Al), tungsten (W), niobium (Nb), tantalum (Ta), molybdenum (Mo), chromium (Cr), copper (Cu), gold (Au), silver (Ag), titanium (Ti), nickel (Ni) and the like; alloys or compounds containing these metal elements (for example, nitrides such as TiN and silicides such as $WSi_2$, $MoSi_2$, $TiSi_2$ and $TaSi_2$); electrically conductive metal oxides such as ITO (indium-tin oxide), indium oxide and zinc oxide; and semiconductors such as silicon (Si). For making or forming the anode electrode unit, the electric supply line, the cathode electrode or the gate electrode, a thin film made of the above material is formed on a substratum by a known thin film forming method such as a CVD method, a sputtering method, a vapor deposition method, an ion-plating method, an electrolytic plating method, an electroless plating method, a screen printing method, a laser abrasion method or a sol-gel method. When the thin film is formed on the entire surface of the substratum, the thin film is patterned by a known patterning method to form the above members. When a patterned resist is formed on the substratum in advance of the formation of the thin film, the above members can be formed by a lift-off method. Further, when vapor deposition is carried out using a mask having openings conforming to the anode electrode unit, the electric supply line, the cathode electrode or the gate electrode, or when screen printing is carried out with a screen having such openings, no patterning is required after the formation of the thin film.

As a material for constituting the insulating layer which constitutes the field emission device, $SiO_2$-containing material such as $SiO_2$, BPSG, PSG, BSG, AsSG, PbSG, SiN, SiON, spin on glass (SOG), low-melting-point glass and a glass paste, SiN, an insulating resin such as polyimide and the like can be used alone or in combination. The insulating layer can be formed by a known method such as a CVD method, an application method, a sputtering method or a screen printing method.

The transparent electrode can be made, for example, of ITO, tin oxide, zinc oxide or titanium oxide.

The phosphor layer may be made of a monochromatic phosphor particles, or it may be made of phosphor particles of three primary colors. Further, the arrangement form of the phosphor layer may be a dot matrix form, or it may be a stripe form. In the arrangement form such as a dot matrix form or a stripe form, a black matrix for improvement in contrast may be embedded in a space between one phosphor layer and another adjacent phosphor layer.

Further, the anode panel is preferably provided with a plurality of separation walls for preventing the occurrence of a so-called optical crosstalk (color mixing) that is caused when electrons recoiling from the phosphor layer or secondary electrons emitted from the phosphor layer enter another phosphor layer, or for preventing the collision of electrons with other phosphor layer when electrons recoiling from the phosphor layer or secondary electrons emitted from the phosphor layer enter other phosphor layer over the separation wall.

The form of the separation walls includes the form of a lattice (grilles), that is, a form in which the separation wall surrounds four sides of the phosphor layer corresponding to one pixel and having a plan form of a nearly rectangle (or dot-shaped), and a stripe or band-like form that extends in parallel with opposite two sides of a rectangular or stripe-shaped phosphor layer. When the separation wall(s) has (have) the form of a lattice, the separation wall may have a form in which the separation wall continuously or discontinuously surrounds four sides of one phosphor layer. When the separation wall(s) has(have) the form of a stripe or band-like form, the form may be continuous or discontinuous. The formed separation walls may be polished to flatten the top surface of each separation wall.

For improving the contrast of display images, preferably, a black matrix that absorbs light from the phosphor layer is formed between one phosphor layer and another adjacent phosphor layer and between the separation wall and the substrate. As a material for constituting the black matrix, it is preferred to select a material that absorbs at least 99% of light from the phosphor layer. The above material includes carbon, a thin metal film (made, for example, of chromium, nickel, aluminum, molybdenum and an alloy of these), a metal oxide (for example, chromium oxide), metal nitride (for example, chromium nitride), a heat-resistant organic resin, glass paste, and glass paste containing a black pigment or electrically conductive particles of silver or the like. Specific examples thereof include a photosensitive polyimide resin, chromium oxide, and a chromium oxide/chromium stacked film. Concerning the chromium oxide/chromium stacked film, the chromium film is to be in contact with the substrate.

When the cathode panel and the anode panel are bonded in their circumferential portions, the bonding may be carried out with an adhesive layer or with a frame made of an insulating rigid material such as glass or ceramic and an adhesive layer. When the frame and the adhesive layer are used in combination, the facing distance between the cathode panel and the anode panel can be adjusted to be longer by properly determining the height of the frame than that obtained when the adhesive layer alone is used. While a frit glass is generally used as a material for the adhesive layer, a so-called low-melting-point metal material having a melting point of approximately 120 to 400° C. may be used. The low-melting-point metal material includes In (indium; melting point 157° C.); an indium-gold low-melting-point alloy; tin (Sn)-containing high-temperature solders such as $Sn_{80}Ag_{20}$ (melting point 220 to 370° C.) and $Sn_{95}Cu_5$ (melting point 227 to 370° C.); lead (Pb)-containing high-temperature solders such as $Pb_{97.5}Ag_{2.5}$ (melting point 304° C.), $Pb_{94.5}Ag_{5.5}$ (melting point 304 to 365° C.) and $Pb_{97.5}Ag_{1.5}Sn_{1.0}$ (melting point 309° C.); zinc (Zn)-containing high-temperature solders such as $Zn_{95}Al_5$ (melting point 380° C.); tin-lead-containing standard solders such as $Sn_5Pb_{95}$ (melting point 300 to 314° C.) and $Sn_2Pb_{98}$ (melting point 316 to 322° C.); and brazing materials such as $Au_{88}Ga_{12}$ (melting point 381° C.) (all of the above parenthesized values show atomic %).

When three members of the substrate, the supporting member and the frame are bonded, these three members may be bonded at the same time, or one of the substrate and the supporting member may be bonded to the frame at a first stage, and then the other of the substrate and the supporting member may be bonded to the frame at a second stage. When bonding of the three members or bonding at the second stage is carried out in a high-vacuum atmosphere, a space surrounded by the substrate, the supporting member, the frame and the adhesive layer comes to be a vacuum space upon bonding. Otherwise, after the three members are bonded, the space surrounded by the substrate, the supporting member, the frame and the adhesive layer may be vacuumed to obtain a vacuum space. When the vacuuming is carried out after the bonding, the pressure in an atmosphere during the bonding may be any one of atmospheric pressure and reduced pressure, and the gas constituting the atmosphere may be ambient atmosphere or an inert gas containing nitrogen gas or a gas (for example, Ar gas) coming under the group 0 of the periodic table.

When the vacuuming is carried out after the bonding, the vacuuming can be carried out through a tip tube pre-connected to the substrate and/or the supporting member. Typically, the tip tube is made of a glass tube and is bonded to a circumference of a through-hole formed in the ineffective field of the substrate and/or the supporting member (i.e., the field other than the effective field which works as a display portion) with a frit glass or the above low-melting-point metal material. After the space reaches a predetermined vacuum degree, the tip tube is sealed by thermal fusion. It is preferred to heat and then temperature-decrease the cold cathode field emission display as a whole before the sealing, since residual gas can be released into the space, and the residual gas can be removed out of the space by vacuuming.

In the cold cathode field emission display of the present invention, the basic concept is not that the trigger for a discharge is suppressed but that energy generated between the anode electrode and the cold cathode field emission device is suppressed so that a small-scale discharge, even if it should take place, does not grow to a large-scale discharge. The anode electrode is not formed on the entire surface of the effective field, but is formed in the form of split anode electrode units having smaller areas, so that the electrostatic capacity between the anode electrode unit and the cold cathode field emission device can be decreased and that energy to be generated can be reduced. As a result, the damage caused on the anode electrode unit by a discharge can be effectively decreased in scale.

Moreover, in the cold cathode field emission display according to the first or third aspect of the present invention, $V_A/L_g<1$ (kV/μm) is satisfied, so that the occurrence of a discharge between the anode electrode units can be reliably decreased. As a result, permanent damages of the anode electrode unit such as vaporization caused on the anode electrode unit due to the above discharge can be fully decreased. Further, in the cold cathode field emission display according to the second or fourth aspect of the present invention, $(V_A/7)^2\times(S/d)\leqq 2250$ is satisfied, and in the cold cathode field emission display according to the fifth aspect of the present invention, the size of the anode electrode units is defined, so that permanent damages of the anode electrode unit such as vaporization caused on the anode electrode unit due to a discharge between the anode electrode unit and the cold cathode field emission device can be fully decreased.

BRIEF DESCRIPTION OF THE DRAWINGS

FIG. 20B, are schematic partial end views of the supporting member, etc., for explaining the method of manufacturing a Spindt-type cold cathode field emission device.

FIG. 22B, are schematic partial end views of the supporting member, etc., for explaining the method of manufacturing a plane-type cold cathode field emission device (No. 1).

BEST MODE FOR CARRYING OUT THE INVENTION

The present invention will be explained on the basis of Examples with reference to drawings hereinafter.

EXAMPLE 1

Example 1 is concerned with the cold cathode field emission display (to be simply abbreviated as "display" hereinafter) according to each of the first, second and fifth aspects of the present invention.

Figure 1:
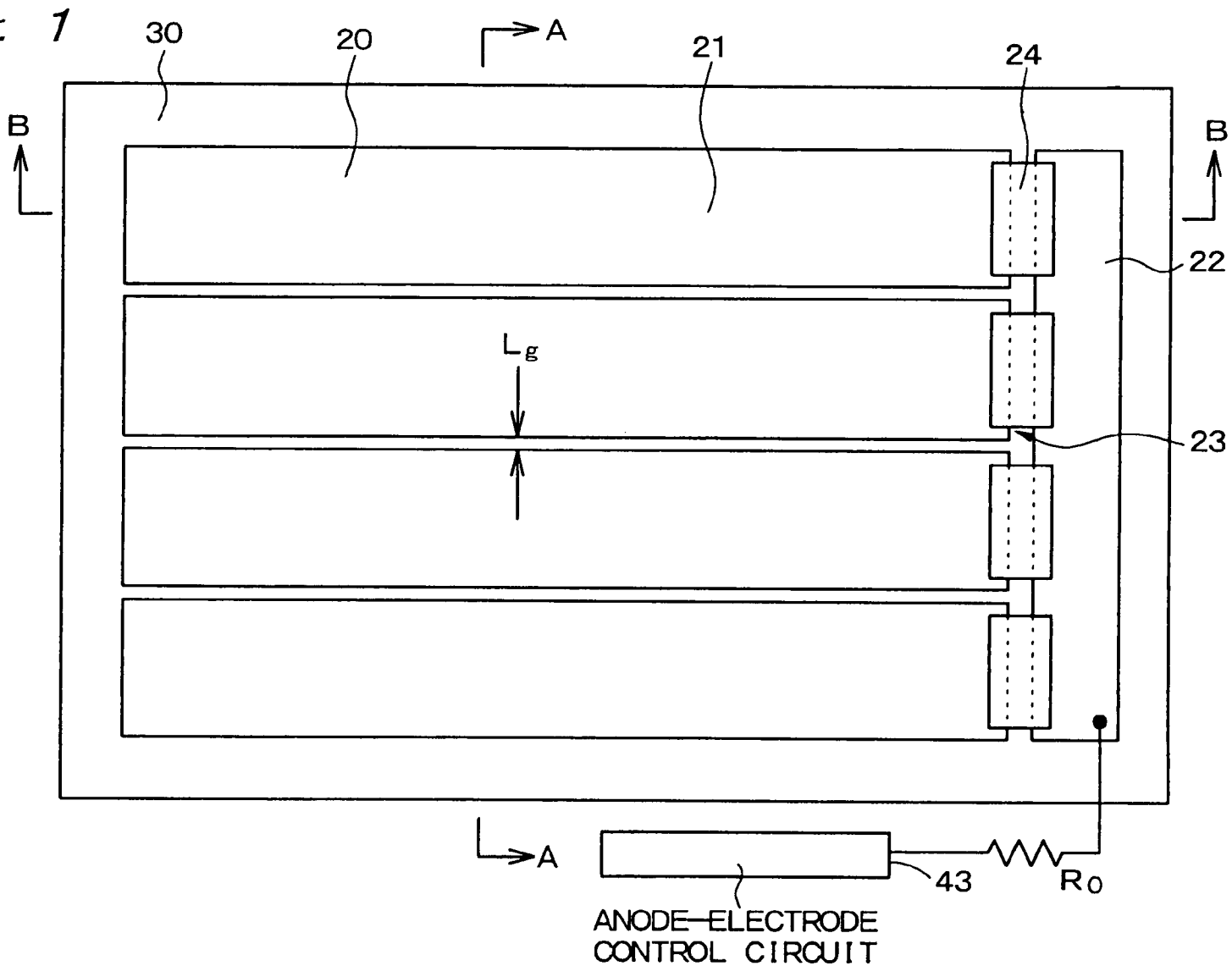
FIG. 1 is a schematic plan view of an anode electrode in a cold cathode field emission display in Example 1.
Figure 2A:
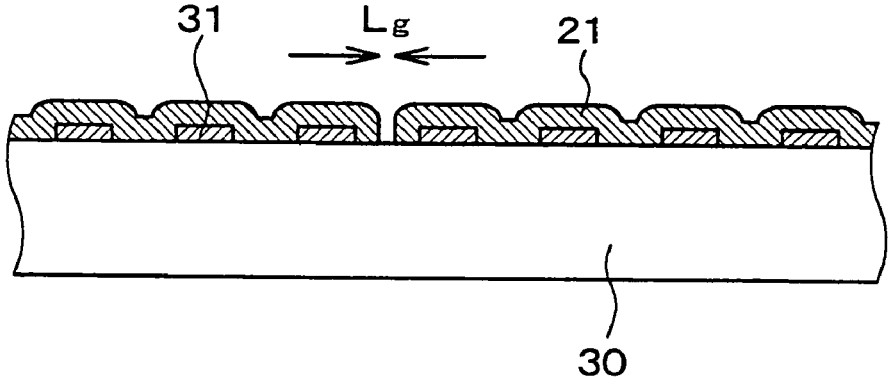
FIGS. 2A and 2B are schematic partial end views of an anode panel in the cold cathode field emission display in Example 1, taken along lines A-A and B-B in FIG. 1, respectively.
Figure 2B:
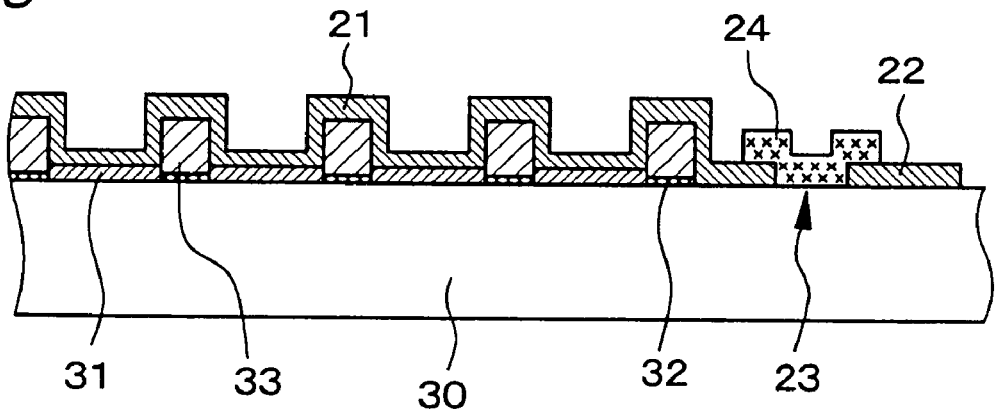
Figure 3:
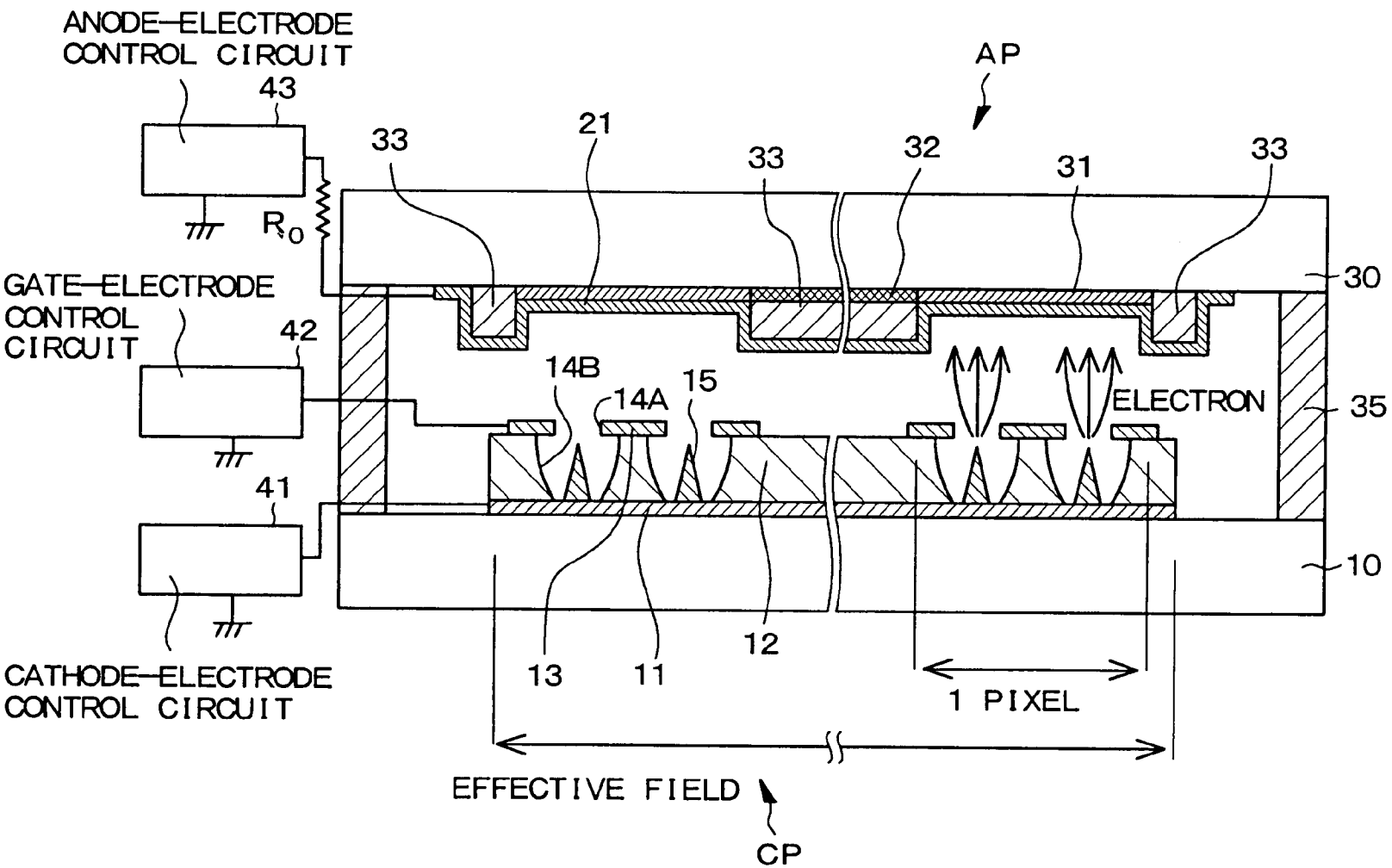
FIG. 3 is a schematic partial end view of a cold cathode field emission display in Example 1.
Figure 4:
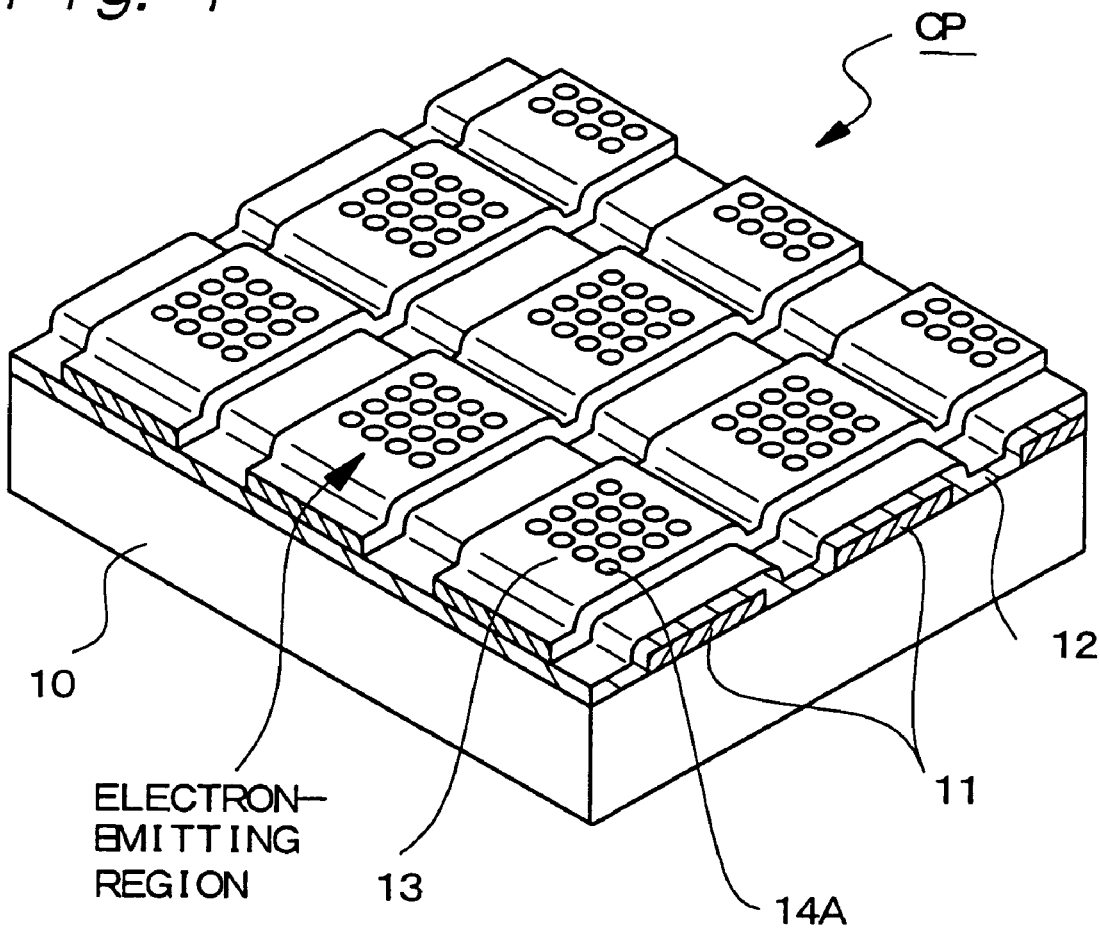
FIG. 4 is a schematic partial perspective view of a cathode panel in the cold cathode field emission display in Example 1.
Figure 5:
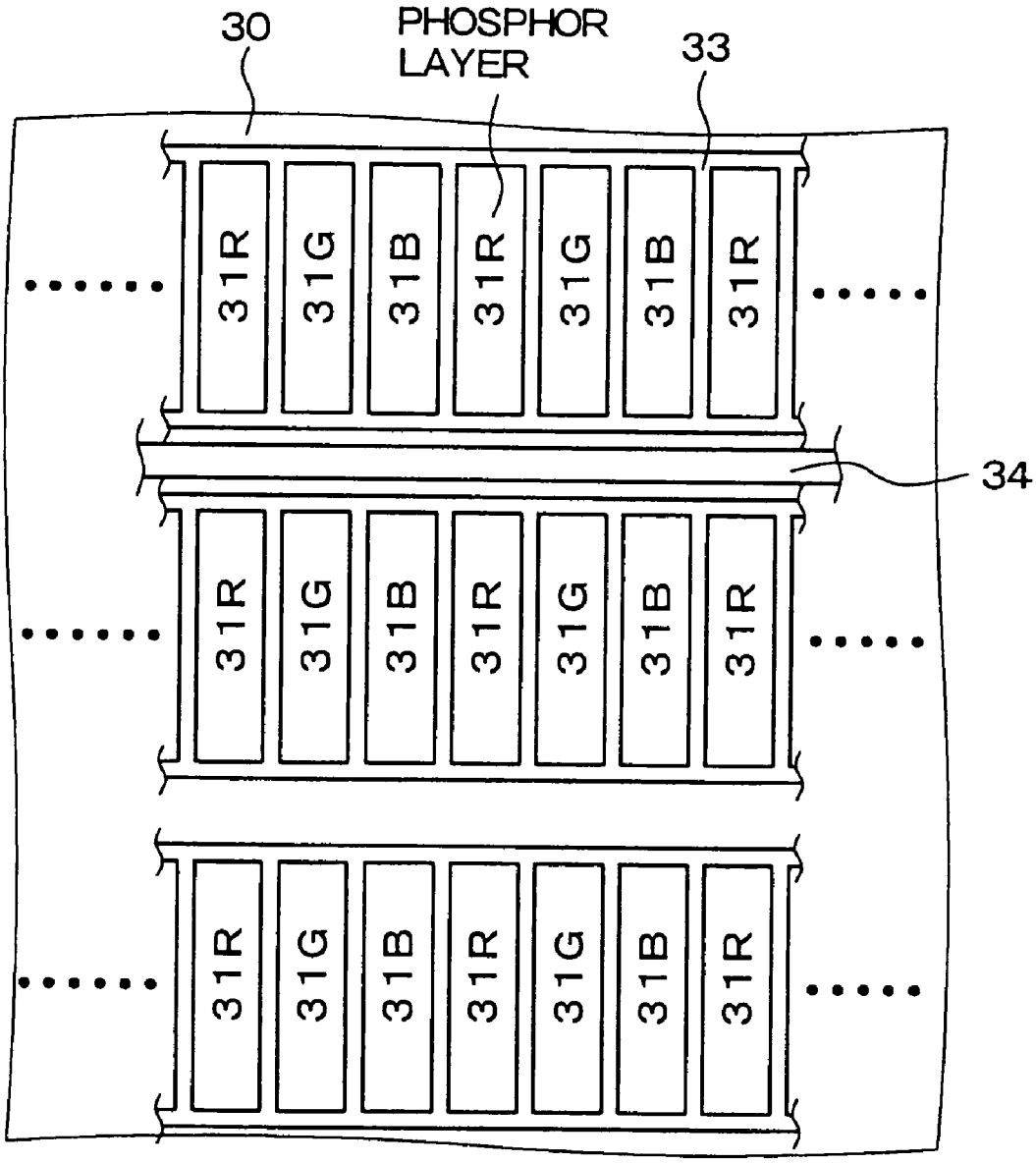
FIG. 5 is a schematic layout of a separation wall, a spacer and a phosphor layer in an anode panel constituting a cold cathode field emission display.
Figure 6:
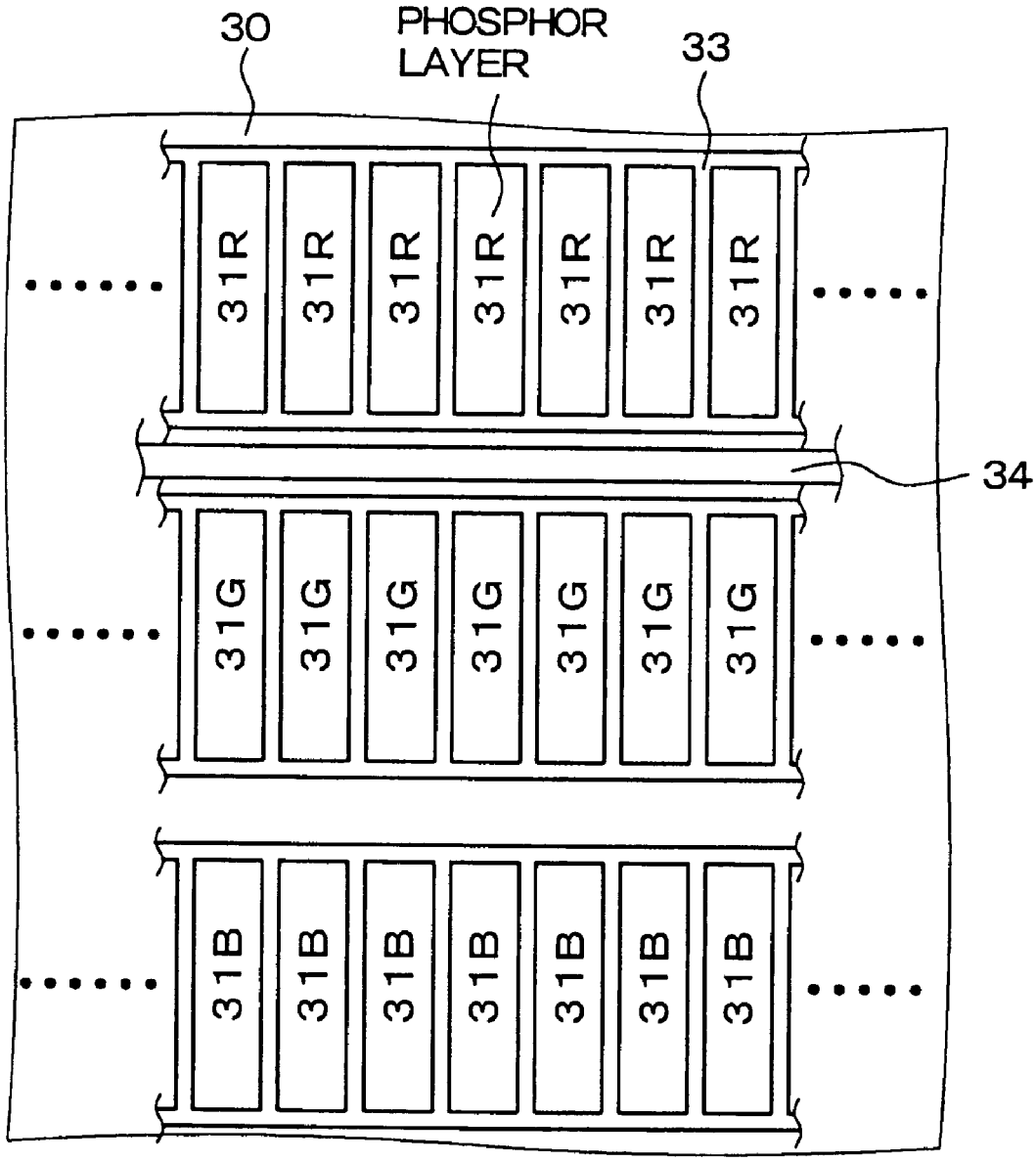
FIG. 6 is a schematic layout of a separation wall, a spacer and a phosphor layer in an anode panel constituting a cold cathode field emission display.
Figure 7:
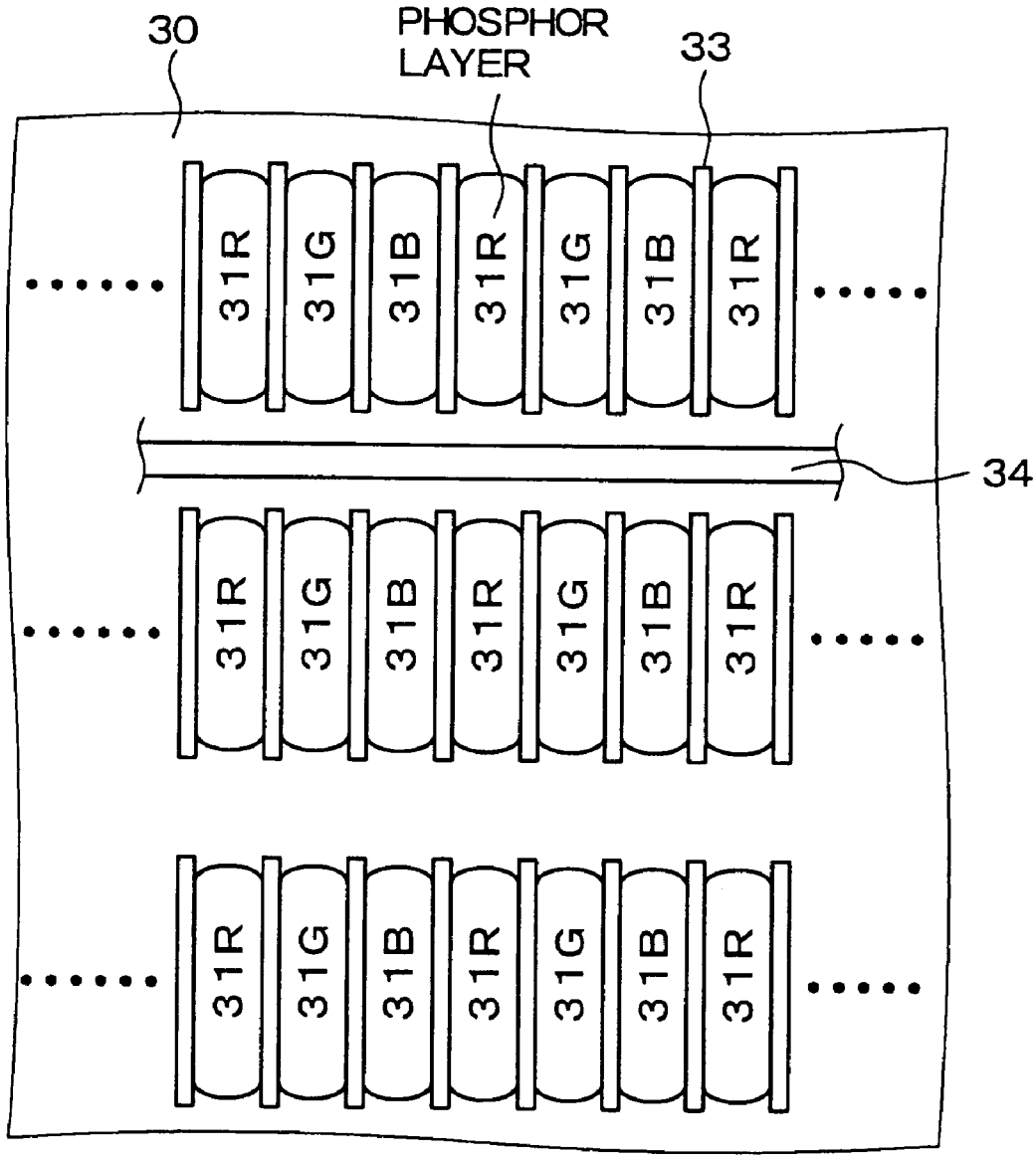
FIG. 7 is a schematic layout of a separation wall, a spacer and a phosphor layer in an anode panel constituting a cold cathode field emission display.
Figure 8:
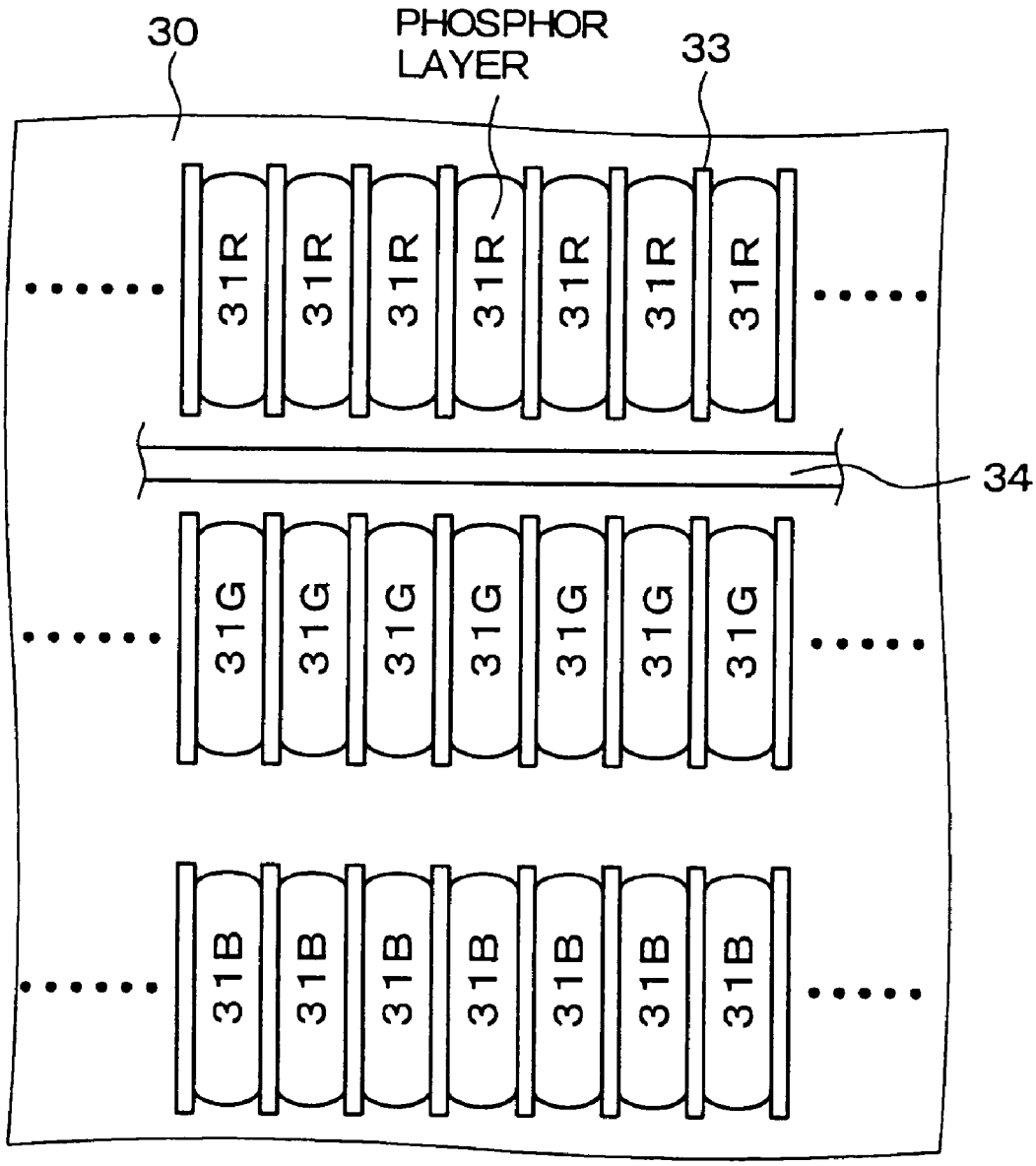
FIG. 8 is a schematic layout of a separation wall, a spacer and a phosphor layer in an anode panel constituting a cold cathode field emission display.

FIG. 1 shows a schematic plan view of an anode electrode, FIG. 2A shows a schematic partial end view of an anode panel AP taken along line A-A in FIG. 1, and FIG. 2B shows a schematic partial end view of the anode panel AP taken along line B-B in FIG. 1. Further, FIG. 3 shows a schematic partial end view of the display in Example 1, and FIG. 4 shows a partial perspective view of a cathode panel CP. Further, FIGS. 5 to 8 illustrate schematic partial plan views of layouts of phosphor layers and the like. The layout of the phosphor layers, etc., in the schematic partial end view of the anode panel AP has a constitution shown in FIG. 7 or 8.

The display comprises the cathode panel CP having a plurality of cold cathode field emission devices (to be simply abbreviated as "field emission device" hereinafter) constituted of a cathode electrode 11, a gate electrode 13 and an electron-emitting portion 15 each, and the anode panel AP, the cathode panel CP and the anode panel AP being bonded to each other in their circumferential portions.

The field emission device shown in FIG. 3 is a so-called Spindt-type field emission device having a conical electron-emitting portion. This field emission device comprises the cathode electrode 11 formed on a supporting member 10, an insulating layer 12 formed on the supporting member 10 and the cathode electrode 11, the gate electrode 13 formed on the insulating layer 12, an opening portion 14 formed through the gate electrode 13 and the insulating layer 12 (a first opening portion 14A formed through the gate electrode 13 and a second opening portion 14B formed through the insulating layer 12), and the conical electron-emitting portion 15 formed on the cathode electrode 11 positioned in the bottom portion of the second opening portion 14B. Generally, the cathode electrode 11 and the gate electrode 13 are formed in the form of stripes extending in a manner in which the projection images of these two electrodes cross each other at right angles, and generally, a plurality of field emission devices are formed in an overlap region of the projection images of these two electrodes (this region corresponds to one pixel and will be referred to as "overlap region" or "electron-emitting region" hereinafter). Further, generally, such electron-emitting regions are arranged in a two-dimensional matrix in the effective field (field that works as an actual display portion) of the cathode panel CP.

The anode panel AP comprises a substrate 30, a phosphor layer 31 (phosphor layer 31R for emitting light in red, phosphor layer 31B for emitting light in blue and phosphor layer 31G for emitting light in green) being formed on the substrate 30 and having a predetermined pattern, an anode electrode 20 formed thereon, and one electric supply line 22. The anode electrode 20 as a whole has the form covering a rectangular effective field (size: 70 mm×110 mm) and is made, for example, of an aluminum thin film. The anode electrode 20 is constituted of anode electrode units 21 in the number of N ($N \geqq 2$, and N=200 in Example 1). The total number n of columns of the unit phosphor layers 31 arranged in the form of a straight line and N have the relationship of n=20N. The anode electrode units 21 in the number of N are connected to an anode-electrode control circuit 43 through one electric supply line 22. The electric supply line 22 is also made, for example, of an aluminum thin film.

The anode electrode unit 21 has a size that inhibits energy generated by a discharge taking place between the anode electrode unit 21 and the field emission device (more specifically, the gate electrode 13 or the cathode electrode 11) from vaporizing a portion of the anode electrode unit 21 locally (more specifically, a size that inhibits vaporization caused on that portion of the anode electrode unit 21 which corresponds to one subpixel, due to energy generated by a discharge that takes place between the anode electrode unit 21 and the gate electrode 13 or the cathode electrode 11). Specifically, the anode electrode unit 21 had a rectangular form as an outer form, and had a size (area S) of 0.33 mm×110 mm. FIG. 1 shows four anode electrode units 21 for simplification of the drawing.

A black matrix 32 is formed on the substrate 30 between one phosphor layer 31 and another phosphor layer 31. A separation wall 33 is formed on the black matrix 32. FIGS. 5 to 8 schematically show examples of layout of the separation walls 33, spacer 34 and the phosphor layers 31 in the anode panel AP. The plan form of the separation wall 33 includes the form of a lattice (grid form), i.e., a form that surrounds the phosphor layer 31 having the plan form, for example, of a nearly rectangle and equivalent to one picture element (one pixel) (see FIGS. 5 and 6), and a form of a band (stripe form) extending in parallel with facing two sides of the phosphor layer 31 having a nearly rectangular form (or strip form) (see FIGS. 7 and 8). The phosphor layer 31 may have the form of a stripe that extends vertically on FIGS. 5 to 8.

The space surrounded by the anode panel AP, the cathode panel CP and a frame 35 is a vacuum space. Atmosphere has a pressure on the anode panel AP and the cathode panel CP. The spacer 34 having a height, for example, of about 1 mm is provided between the anode panel AP and the cathode panel CP for preventing the pressure from destroying the display. FIG. 3 omits showing of the spacer. Part of the separation wall 33 works as a spacer holding portion for holding the spacer 34.

When a voltage difference between an output voltage of the anode-electrode control circuit 43 and a voltage applied to the cold cathode field emission device (specifically, voltage applied to the cathode electrode 11) is $V_A$ (unit:kilovolt), and when a gap length between the anode electrode units 21 is $L_g$ (unit:μm), $V_A/L_g<1$ (kV/μm) is satisfied. Specifically, $V_A$ was 5 kilovolts, and the gap length $L_g$ between the anode electrode units 21 was 20 μm. The gap between the anode electrode units 21 is provided in a portion where no phosphor layer 31 is formed.

Each anode electrode unit 21 is connected to the anode-electrode control circuit 43 through one electric supply line 22. Generally, provided between the anode-electrode control circuit 43 and the electric supply line 22 is a resister $R_0$ (a resistance value of 10 MΩ in a shown example) for preventing excess current and a discharge. The resister $R_0$ is provided outside the substrate. A space 23 is provided between each anode electrode unit 21 and the electric supply line 22, and each anode electrode unit 21 and the electric supply line 22 are connected through a resistance element (first resistance element 24). The first resistance element was constituted of a resistive element film made of amorphous silicon. The first resistance element 24 is formed on the space 23 so as to bridge the anode electrode unit 21 and the electric supply line 22. The first resistance element 24 has a resistance value ($r_1$) of about 30 kilo Ω.

Each picture element (one pixel) is constituted of a group of field emission devices formed in the overlap region of the cathode electrode 11 and the gate electrode 13 on the cathode panel side, and the phosphor layer 31 (an aggregate of one unit phosphor layer for emitting light in red, one unit phosphor layer for emitting light in green and one unit phosphor layer for emitting light in blue) that faces the group of the field emission devices and is on the anode panel side. Such pixels are arranged in the effective field on the order of, for example, several hundreds thousand to several millions. Further, each picture element (one pixel) is constituted of three subpixels, and each subpixel has one unit phosphor layer for emitting light in red, one unit phosphor layer for emitting light in green or one unit phosphor layer for emitting light in blue.

The anode panel AP and the cathode panel CP are arranged such that the electron-emitting region and the phosphor layer 31 face each other, and they are bonded to each other in their circumferential portions through the frame 35, whereby a display can be manufactured. The ineffective field surrounding the effective field and having peripheral circuits for selecting pixels is provided with a through hole (not shown) for vacuuming, and a tip tube (not shown) that is to be sealed after the vacuuming is connected to the through hole. That is, the space surrounded by the anode panel AP, the cathode panel CP and the frame 35 is a vacuum space.

A relatively negative voltage is applied to the cathode electrode 11 from the cathode-electrode control circuit 41, a relatively positive voltage is applied to the gate electrode 13 from the gate-electrode control circuit 42, and a positive voltage higher than that applied to the gate electrode 13 is applied to the anode electrode unit 21 from the anode-electrode control circuit 43. When display is performed with the above display, for example, a scanning signal is inputted to the cathode electrode 11 from the cathode-electrode control circuit 41, and a video signal is inputted to the gate electrode 13 from the gate-electrode control circuit 42. Reversely, a video signal may be inputted to the cathode electrode 11 from the cathode-electrode control circuit 41, and a scanning signal may be inputted to the gate electrode 13 from the gate-electrode control circuit 42. Due to an electric field generated when a voltage is applied between the cathode electrode 11 and the gate electrode 13, electrons are emitted from the electron-emitting portion 15 on the basis of a quantum tunnel effect, and the electrons are drawn toward the anode electrode unit 21 to collide with the phosphor layers 31. As a result, the phosphor layers 31 are excited, whereby a desired image can be obtained. That is, the operation of the display is basically controlled by the voltage applied to the gate electrode 13 and the voltage applied to the electron-emitting portion 15 through the cathode electrode 11.

In the display in Example 1, when the distance between the anode electrode unit 21 and the gate electrode 13 is d (unit: mm) and when the area of the anode electrode unit 21 is S (unit:$mm^2$), $(V_A/7)^2\times(S/d)\leqq 2250$ is satisfied, and further, $(V_A/7)^2\times(S/d)\leqq 450$ is satisfied. Specifically, the value of d is 1.0 mm, and the value of S is 36.3 $mm^2$.

Since the anode electrode unit 21 is formed on the substrate 30, on the separation wall 33 and on the phosphor layer 31, the anode electrode unit 21 has the form of convexoconcave, and the distance d between the anode electrode unit 21 and the field emission device is not constant. Therefore, the shortest distance between the anode electrode unit and the field emission device, that is, the distance specifically between the anode electrode unit 21 (or an anode electrode unit 121 to be described later) on the separation wall 33 and the field emission device (more specifically, the gate electrode 13) is taken as d. The distance d in explanations to be given hereinafter has the same meaning.

Energy for vaporization caused on area of 0.04 $mm^2$ (this area corresponds approximately to one subpixel) of the anode electrode unit 21 made, for example, of aluminum by a discharge between the anode electrode unit 21 and the field emission device will be calculated below. The calculation is based on values shown in the following Table 1.

TABLE 1

| | |
|---|---|
| Thickness of anode electrode unit | 1 μm |
| Area to be melted | 0.04 $mm^2$ |
| Specific gravity of aluminum | 2.7 |
| Melting point of aluminum | 660° C. |
| Boiling point of aluminum | 2060° C. |
| Specific heat of aluminum | 0.214 cal/g · ° C. |
| Heat of dissolution of aluminum | 94.6 cal/g |
| Heat of vaporization of aluminum | 293 kJ/mol = 10850 J/g |

The mass $M_{Al}$ (unit:gram) of aluminum to be melted, energy $Q_{MELT}$ (unit:joule) required before the temperature of aluminum reaches its melting point (660° C.) from room temperature (30° C.), energy $Q_{Liq}$ (unit:joule) required for melting, energy $Q_{Biol}$ (unit:joule) required before the temperature of aluminum reaches its boiling point (2060° C.) from its melting point (660° C.), energy $Q_{Evap}$ required for vaporization and the total energy $Q_{Total}$ are as follows.

$$M_{Al} = 0.04\times10^{-2}\times10^{-4}\times2.7 = 1.08\times10^{-7}(\text{g})$$

$$Q_{MELT} = 0.214\times4.2\times(660-30)\times M_{Al} = 6.1\times10^{-5}(J)$$

$$Q_{Liq} = 94.6\times4.2\times M_{Al} = 4.3\times10^{-5}(J)$$

$$Q_{Biol} = 0.214\times4.2\times(2060-660)\times M_{Al} = 1.36\times10^{-4}(J)$$

$$Q_{Evap} = 10850\times M_{Al} \quad 1.17\times10^{-3}(J)$$

$$Q_{Total} = Q_{MELT} + Q_{Liq} + Q_{Biol} + Q_{Evap} = 1.41\times10^{-3}(J)$$

It can be said that local vaporization does not take place in the anode electrode unit so long as the integrated value of energy generated in the anode electrode unit 21 during a discharge between the anode electrode unit 21 and the field emission device does not exceed the value of the above total energy $Q_{Total}$. That is, it can be said that any portion equivalent to one subpixel of the anode electrode unit 21 is free from evaporation. When the anode electrode unit is made of molybdenum (Mo), the total energy $Q_{Total}$ is $2.7\times10^{-3}$ (J).

Figure 9:
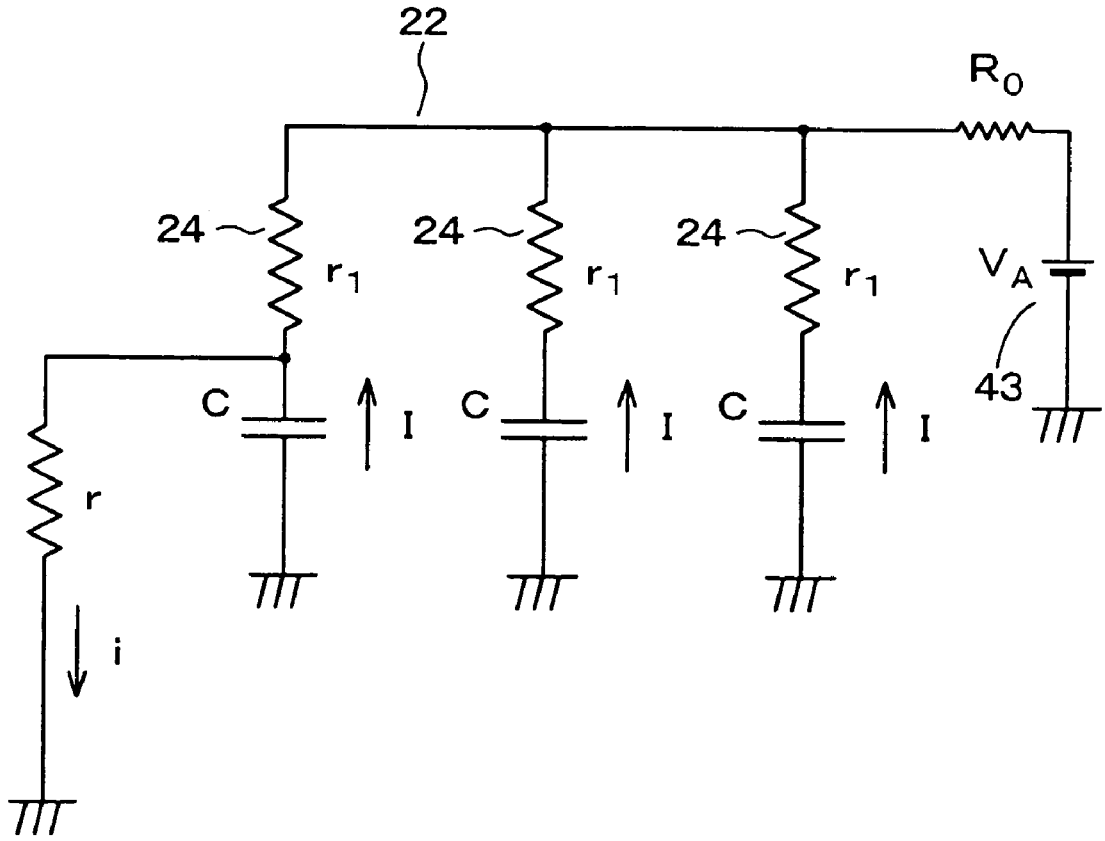
FIG. 9 shows an equivalent circuit when an abnormal discharge takes place between an anode electrode unit and a gate electrode in Example 1.
Figure 10:
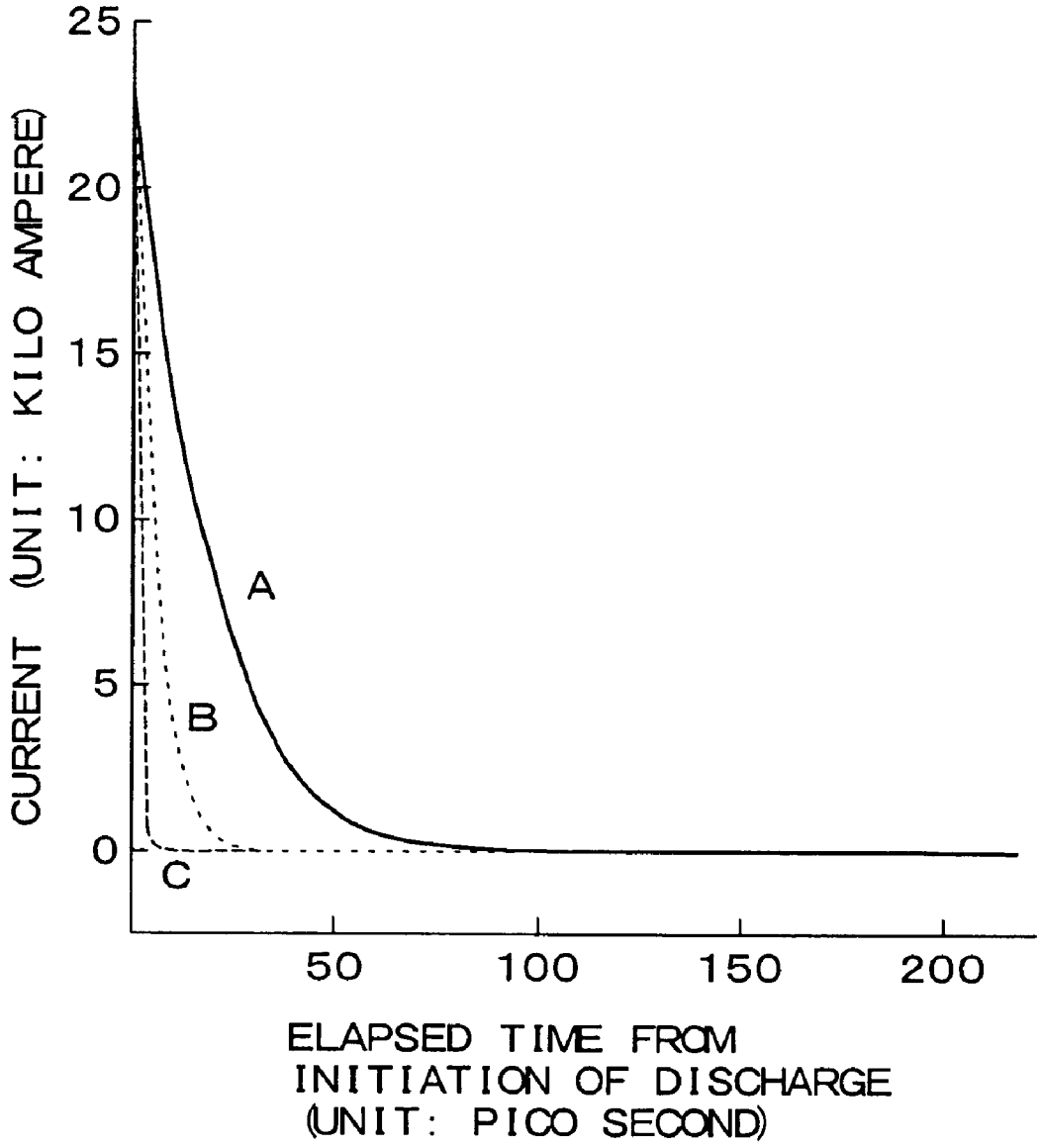
FIG. 10 is a graph showing simulation results of discharge current i when the area S of an anode electrode unit is 9000 $mm^2$, 3000 $mm^2$ or 450 $mm^2$ in the cold cathode field emission display in Example 1.
Figure 11:
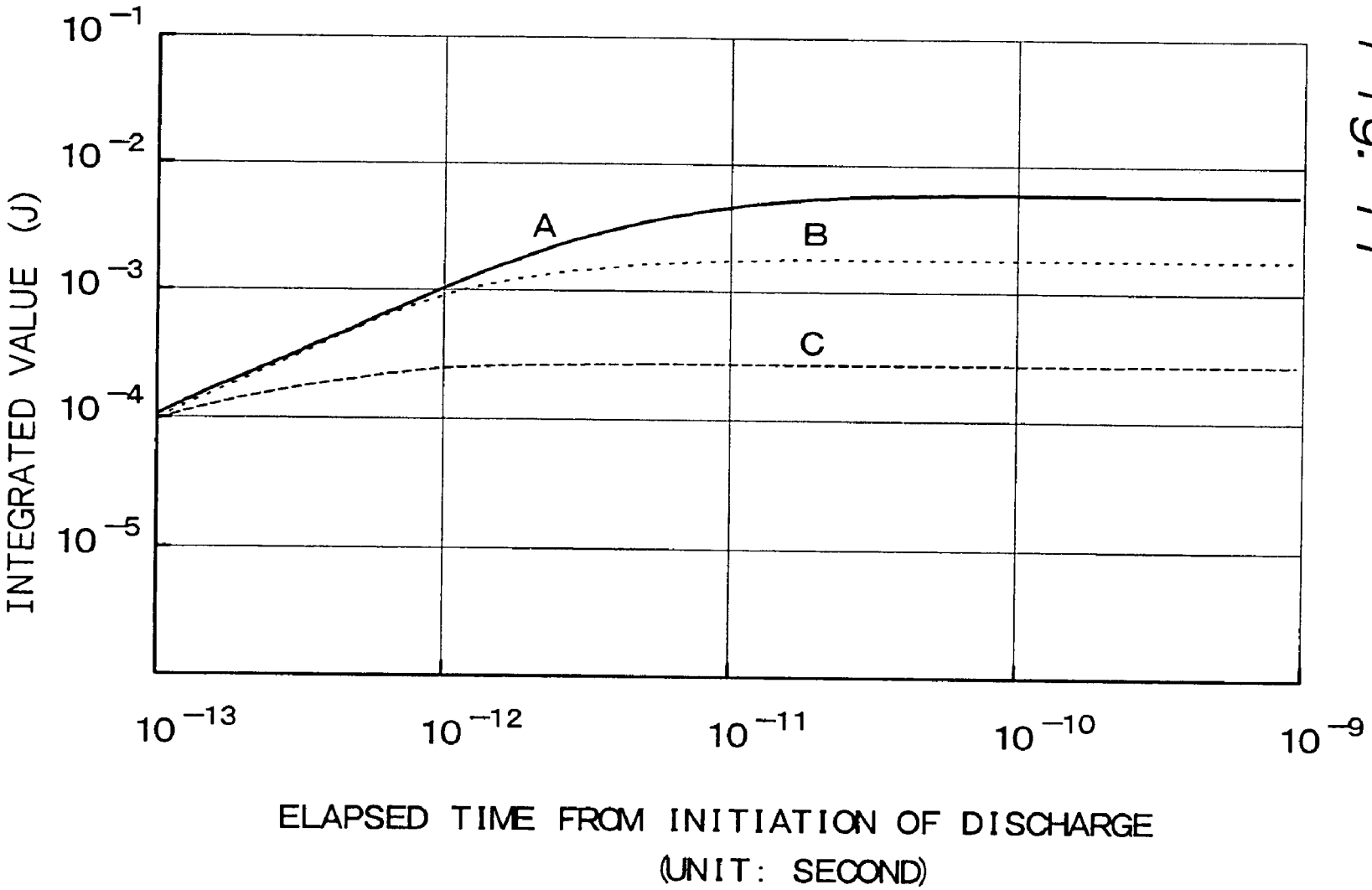
FIG. 11 is a graph showing simulation results of integrated values of energy generated during an abnormal discharge when the area S of an anode electrode unit is 9000 $mm^2$, 3000 $mm^2$ or 450 $mm^2$ in the cold cathode field emission display in Example 1.

FIG. 9 shows an equivalent circuit found when a discharge takes place between the anode electrode unit 21 and the gate electrode 13. FIG. 9 shows three anode electrode units. A discharge current i flows due to a discharge between the anode electrode unit 21 and the gate electrode 13, and the theoretical resistance value (r) that is a resistance value between the anode electrode unit 21 and the gate electrode 13 is 0.2 Ω. The theoretical resistance value (r) is generally approximately 0.1 Ω to 10 Ω. Further, the value of a capacitor (C) formed by the anode electrode unit 21 and the gate electrode 13 when the value of S was 9000 mm$^2$, 3000 mm$^2$ or 450 mm$^2$ was determined to be 60 pF, 20 pF or 3 pF. Further, $V_A$ was determined to be 7 kilovolts. FIGS. 10 and 11 show a change in current I flowing in the anode electrode unit 21 obtained by simulation and energy generated in the anode electrode unit 21, respectively, when the value of S is 9000 mm$^2$, 3000 mm$^2$ or 450 mm$^2$. In FIGS. 10 and 11, curves A show values when the value of S is 9000 mm$^2$, curves B show values when the value of S is 3000 mm$^2$, and curves C show values when the value of S is 450 mm$^2$. Further, the integrated values of energy generated in the anode electrode unit 21 by a discharge between the anode electrode unit 21 and the field emission device (which are integrated values for 1 nanosecond after the discharge took place, and integrated values of generated energy have the same meaning hereinafter) were as shown in Table 2 below. Table 2 further shows an integrated value of energy generated in the anode electrode unit 21 by a discharge between the anode electrode unit 21 and the field emission device in a simulation in which the value of the capacity (C) formed by the anode electrode unit 21 and the gate electrode 13 when the value of S is 2250 mm$^2$ is 15 pF and in which $V_A$ is 7 kilovolts.

TABLE 2

| Area of anode electrode unit | Integrated value of energy generated during discharge |
|---|---|
| 9000 mm$^2$ | $5.6\times10^{-3}$(J) |
| 3000 mm$^2$ | $1.9\times10^{-3}$(J) |
| 2250 mm$^2$ | $1.4\times10^{-3}$(J) |
| 450 mm$^2$ | $2.8\times10^{-4}$(J) |

When the area of the anode electrode unit 21 is 9000 mm$^2$ and when it is 3000 mm$^2$, the integrated value of energy generated during a discharge between the anode electrode unit 21 and the field emission device exceeds $Q_{Total}$. When the area of the anode electrode unit 21 is 2250 mm$^2$ or less, the integrated value of energy generated during a discharge between the anode electrode unit 21 and the field emission device does not exceed $Q_{Total}$. Therefore, there is no case where the anode electrode unit 21 is destroyed locally (specifically, in a portion having a size equivalent to one subpixel) due to energy generated by a discharge that takes place between the anode electrode unit 21 and the field emission device (specifically, the gate electrode 13 or the cathode electrode 11). Specifically, there is no case where the anode electrode unit 21 is vaporized locally (specifically, in a portion having a size equivalent to one subpixel) by a discharge that takes place between the anode electrode unit 21 and the field emission device.

Meanwhile, the energy accumulated in a capacitor having a capacity c is generally represented by $(1/2)cV^2$. When the counterpart electrode of the capacitor has an area S and when the distance between the electrodes is d, the capacity c of the capacitor is represented by $\epsilon(S/d)$. When the counterpart electrode has an area of S and when the distance between the anode electrode unit 21 and the field emission device is d, if the following expression is satisfied, no damage is caused locally (specifically, in a portion having a size equivalent to one subpixel) on the anode electrode unit 21 corresponding to the counterpart electrode of the capacitor.

$$\epsilon(1/2)(S/d)V_A^2 \leqq \epsilon(1/2)[2250/1]7^2$$

When the above expression is modified, $(V_A/7)^2\times(S/d)\leqq2250$ is obtained.

There was manufactured a display having an anode panel AP in which the gap length $L_g$ between the anode electrode units 21 (S=36.3 mm$^2$) was 50 μm. While aerial atmosphere was maintained inside the display without vacuuming the inside of the display, the display was tested by applying a voltage to the display while the voltage difference $V_A$ between the output voltage of the anode-electrode control circuit and the voltage applied to the cold cathode field emission device was adjusted to 2 kilovolts, 3 kilovolts, 4 kilovolts, 5 kilovolts and 6 kilovolts, to show that a discharge took place between the anode electrode units 21 with a probability of 100% when the voltage difference $V_A$ was 5 kilovolts or higher. When the voltage difference $V_A$ was less than 5 kilovolts, almost no discharge took place between the anode electrode units 21. When it is taken into account that the discharge breakdown between the anode electrode units 21 is in proportion to the gap length $L_g$ between the anode electrode units 21, it is seen from the above data that if $V_A/L_g<(5/50)$ (kV/μm), that is, $V_A/L_g<0.1$ (kV/μm) is satisfied, no discharge takes place between the anode electrode units 21. Further, taking it into account that the above series of tests were carried out in aerial atmosphere, it is considered that the voltage difference $V_A$ at which the discharge takes place when the display is performed in an actual vacuum atmosphere is 5 to 10 times the voltage difference $V_A$ at which the discharge takes place in aerial atmosphere, so that the above expression can be modified to $V_A/L_g<1$ (kV/μm).

EXAMPLE 2

Figure 12:
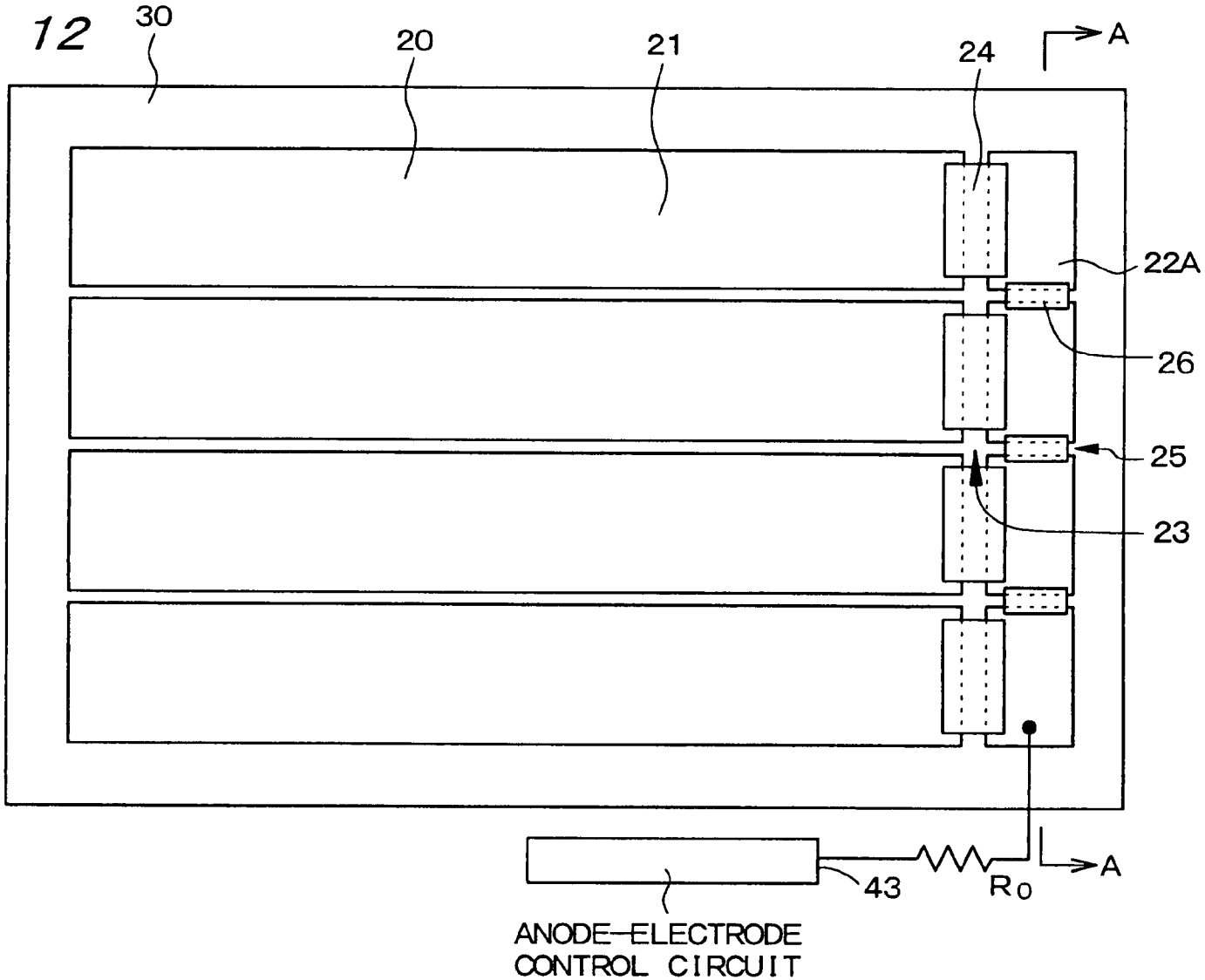
FIG. 12 is a schematic plan view of an anode electrode in a cold cathode field emission display in Example 2.
Figure 13:
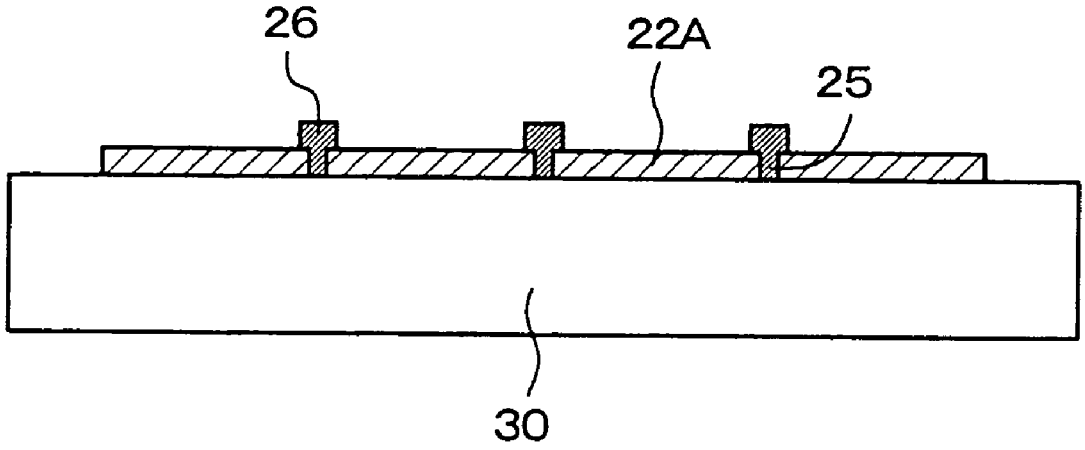
FIG. 13 is a schematic partial end view of an anode panel in the cold cathode field emission display in Example 2, taken along line A-A in FIG. 12.

Example 2 is a variant of Example 1. FIG. 12 shows a schematic partial plan view of an anode panel AP in Example 2, and FIG. 13 shows a schematic partial end view taken along line A-A in FIG. 12. In the anode panel AP in Example 2, an electric supply line 22 is constituted of electric supply line units 22A in the number of M ($2 \leqq M \leqq N$, 10M=N in Example 2) connected in series through second resistance elements 26 made of SiC or chromium oxide by a sputtering method. One electric supply line unit 22A is connected to one anode electrode unit 21. The electric supply line unit 22A had a size (area S') of 1 mm×150 mm. A space 25 is provided between one electric supply line unit 22A and another electric supply line unit 22A, and the second resistance element 26 is formed on the space 25 so as to bridge one electric supply line unit 22A and another electric supply line unit 22A. The second resistance element 26 has a resistance value ($r_2$) of about 5 kilo Ω. The anode panel AP in Example 2 is structurally the same as the anode panel AP in Example 1 except for the above point, so that a detailed explanation of the anode panel AP will be omitted. Further, a display and a cathode panel CP in Example 2 are also structurally the same as the display and the cathode panel CP in Example 1, so that a detailed explanation thereof will be omitted.

When the distance between the anode electrode unit 22A and the field emission device is d (unit:mm), and when the electric supply line unit 22A has an area of S' (unit:$mm^2$), it is desirable to satisfy $(V_A/7)^2 \times (S'/d) \leqq 2250$, preferably, $(V_A/7)^2 \times (S'/d) \leqq 450$, for more reliably suppressing damage that is caused on the electric supply line unit 22A (for example, local vaporization of the electric supply line unit 22A) due to a discharge between the electric supply line unit 22A and the field emission device.

The structure of the electric supply line in Example 2 can be applied to anode panels in Examples 3 and 4 to be described later. Further, the first resistance element 24 may be omitted, and the electric supply line unit 22A may be directly connected to the anode electrode unit 21 (that is, the anode electrode unit 21 and the electric supply line unit 22A may be integrally fabricated).

EXAMPLE 3

Figure 14A:
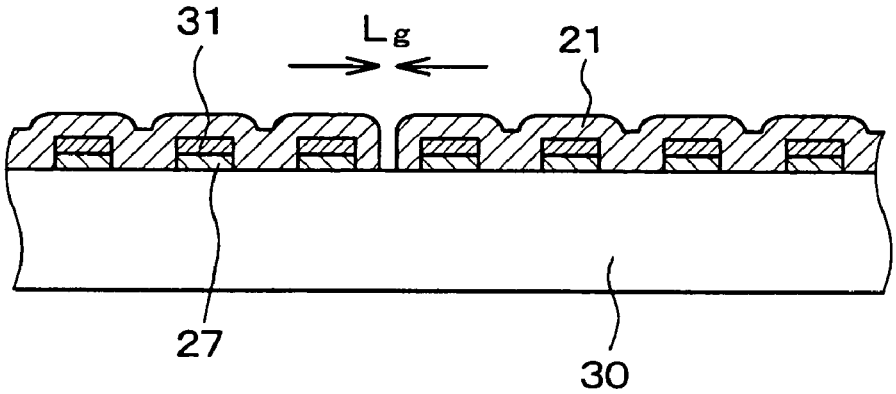
FIGS. 14A and 14B are schematic partial end views of an anode panel in a cold cathode field emission display in Example 3, taken along lines similar to the lines A-A and B-B in FIG. 1, respectively.
Figure 14B:
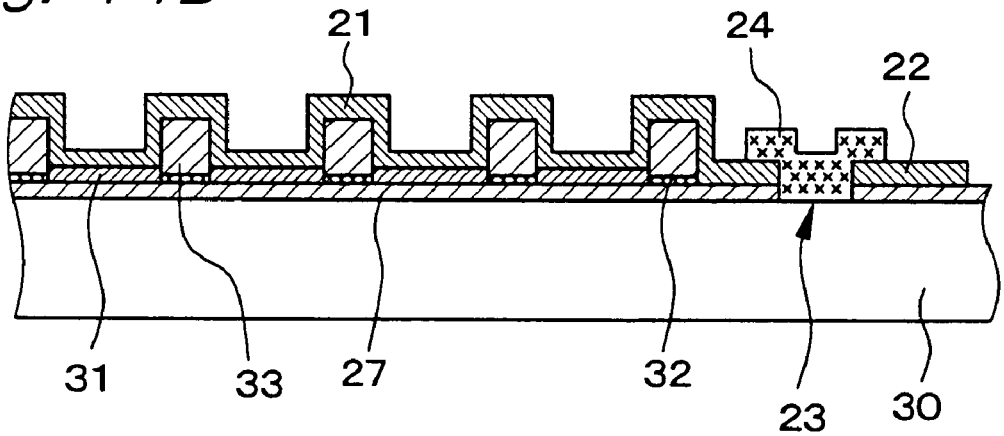

Example 3 is also a variant of Example 1. FIG. 14A shows a schematic partial end view of an anode panel in Example 3, taken along a line similar to the line A-A in FIG. 1, and FIG. 14B shows a schematic partial end view taken along a line similar to the line B-B in FIG. 1. In Example 3, a stripe-shaped transparent electrode 27 made of ITO and connected to the anode-electrode control circuit 43 is formed between the phosphor layer 31 and the substrate 30. More specifically, a plurality of unit phosphor layers 31 constituting the pixels are arranged in the form of a straight line as shown in FIGS. 5 to 8, and one stripe-shaped transparent electrode 27 connected to the anode-electrode control circuit 43 is formed between one column of a plurality of the unit phosphor layers 31 and the substrate 30. The anode panel AP in Example 3 is structurally the same as the anode panel AP in Example 1 except for the above point, so that a detailed explanation of the anode panel AP, a cathode panel CP and a display will be omitted. The transparent electrode 27 may be connected to the anode-electrode control circuit 43 through a resister $R_0$, or it may be optionally connected directly to the anode-electrode control circuit 43.

When the transparent electrode 27 is provided, excess charge of the phosphor layer 31 can be reliably prevented, and the deterioration caused on the phosphor layer 31 by excess charge can be suppressed. Further, by bringing the total number (n) of columns of the unit phosphor layers arranged in the form of a straight line and the number of the stripe-shaped transparent electrodes 27 into agreement with each other, the designing of a display made on an experimental basis can be easily changed. When the number of the transparent electrodes 27 was changed, TAT (Turn Around Time) for a display on an experimental basis was approximately 1 week. In contrast, when only the number N of the anode electrode units 21 was changed, TAT was approximately 1.5 days.

The transparent electrode 27 in Example 3 can be applied to the anode panel Example 2 or an anode panel in Example 4 or 5 to be described later.

EXAMPLE 4

Figure 15:
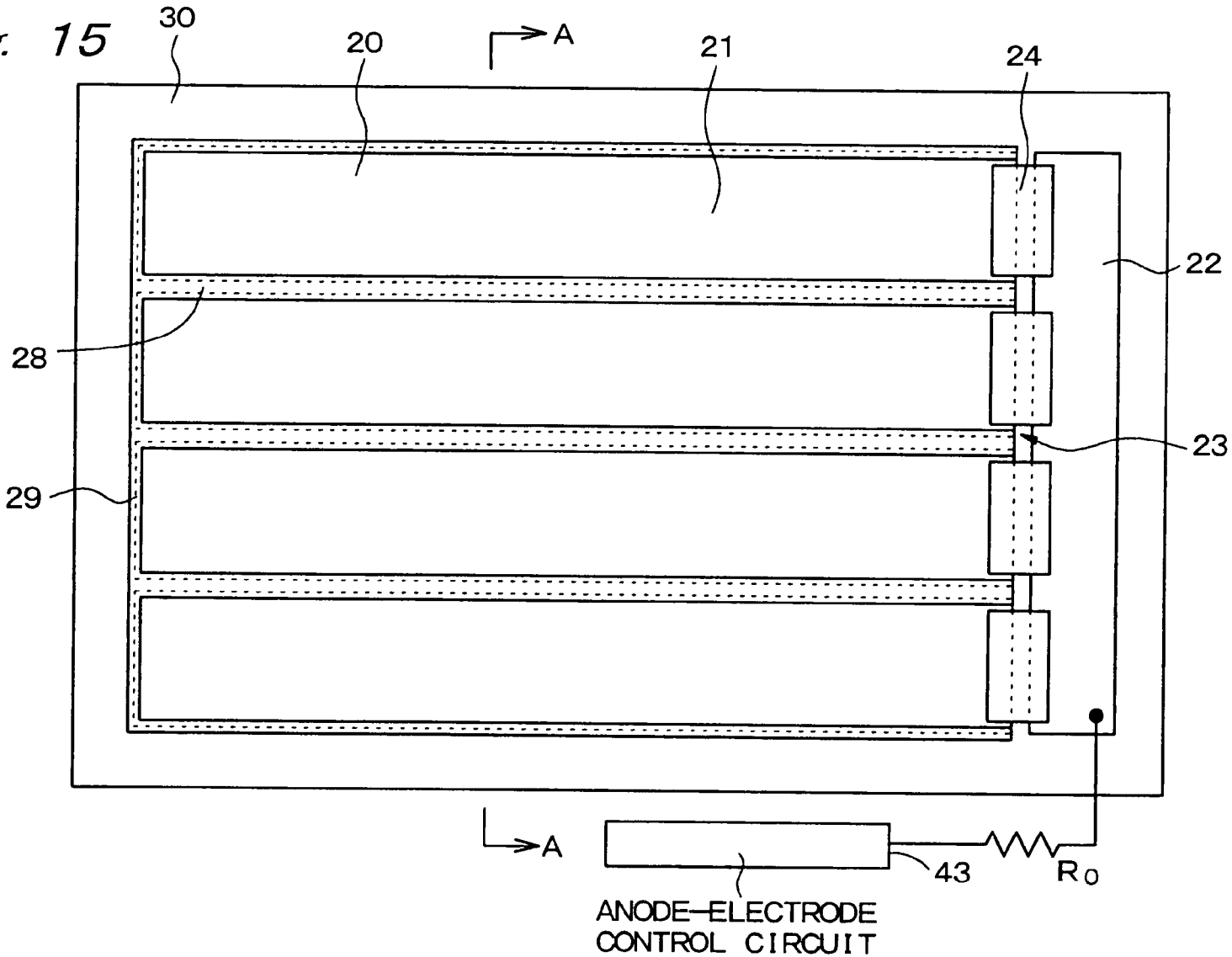
FIG. 15 is a schematic plan view of an anode electrode in a cold cathode field emission display in Example 4.
Figure 16:
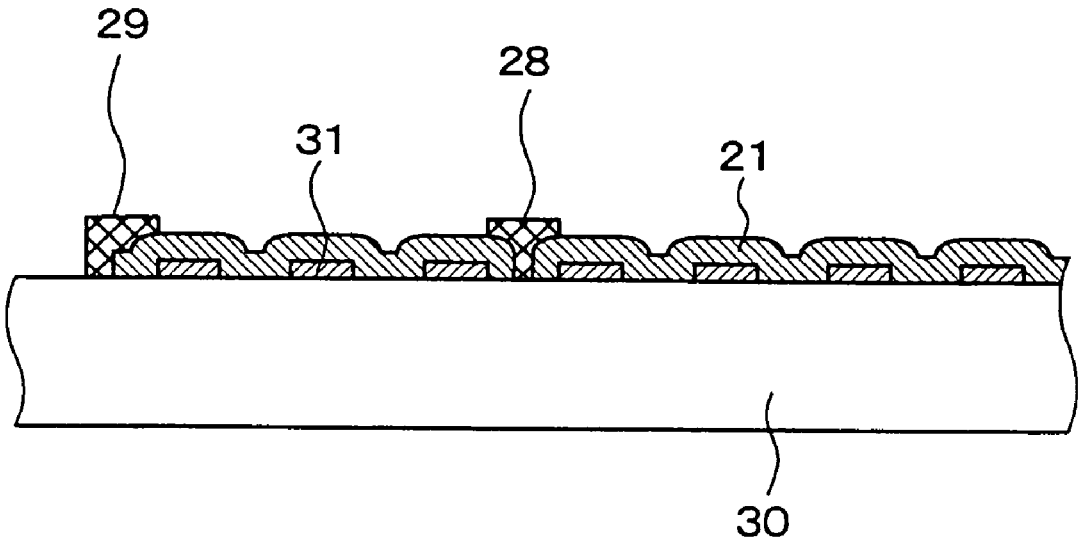
FIG. 16 is a schematic partial end view of an anode panel in the cold cathode field emission display in Example 4, taken along line A-A in FIG. 15.

Example 4 is also a variant of Example 1 and is concerned with the display according to the first-A, second-A and fifth-A aspects of the present invention. FIG. 15 shows a schematic plan view of an anode panel in Example 4, and FIG. 16 shows a schematic partial end view taken alone line A-A in FIG. 15. In the anode panel AP in Example 4, a resistance layer 28 is formed between the anode electrode units 21 unlike Example 1. When the resistance layer 28 is formed as described above, a discharge between the anode electrode units 21 can be effectively suppressed. That edge portion of an anode electrode unit 21 which does not face an adjacent anode electrode unit 21 is covered with a resistance layer 29. In this manner, the scale of a discharge at the edge portion of the anode electrode unit 21 can be decreased. The resistance layers 28 and 29 are made of SiC or chromium oxide and are simultaneously formed by a sputtering method. The anode panel AP in Example 4 is structurally the same as the anode panel AP in Example 1 except for the above points, so that a detailed explanation of the anode panel AP and a display will be omitted. The resistance layer 28 may optionally cover the entire anode electrode 20.

The resistance layer 28 in Example 4 can be applied to the anode panel in Example 2 or 3, or the resistance layer 29 in Example 4 can be applied to the anode panels in Examples 1 to 3 or an anode panel in Example 5 to be described later. The first resistance element 24 or the second resistance element 26 may be formed from, or an electric supply line may be formed concurrently with the resistance layer 28 and formed with the same material as that of the resistance layer 28 to cover the electric supply line.

EXAMPLE 5

Example 5 is concerned with the display according to the third, fourth and fifth-A aspects of the present invention.

Figure 17:
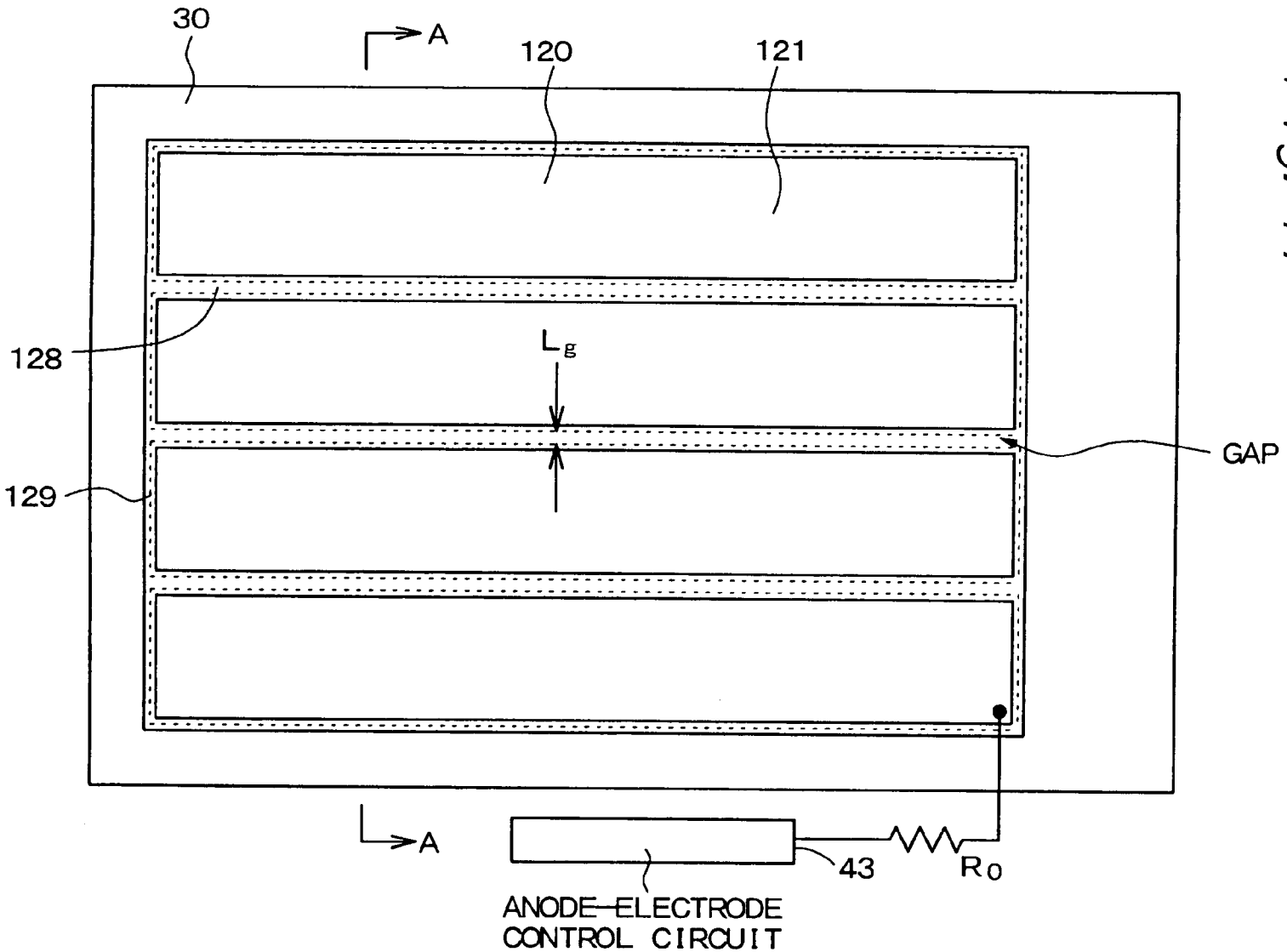
FIG. 17 is a schematic plan view of an anode electrode in a cold cathode field emission display in Example 5.

The display in Example 5 has the same schematic partial end view as that shown in FIG. 3. Further, a cathode panel CP has the same schematic perspective view as that shown in FIG. 4. FIG. 17 shows a schematic plan view of an anode electrode. The schematic partial end view of an anode panel AP taken along line A-A in FIG. 17 is similar to that shown in FIG. 16, while the resistance layers 28 and 29 in FIG. 16 should be read as resistance layers 128 and 129.

The constitution of the cathode panel CP and the display in Example 5 and the method of driving the display can be same as those of the cathode panel CP and the display in Example 1 and the method of driving the display in Example 1, so that a detailed explanation thereof will be omitted.

The anode panel AP comprises a substrate 30, a phosphor layer 31 (phosphor layer 31R that emits light in red, phosphor layer 31B that emits light in blue, and phosphor layer 31G that emits limit in green) being formed on the substrate and having a predetermined pattern, and an anode electrode 20 formed thereon. The anode electrode 20 as a whole has a form covering a rectangular effective field (size: 70 mm×110 mm) and is made, for example, of an aluminum thin film. The anode electrode 120 is constituted of anode electrode units 121 in the number of N (N≧2, and 200 in Example 5). The total number n of columns of unit phosphor layers 31 arranged in the form of a straight line and N have a relationship of n=20N. And, one anode electrode unit 121 is connected to an anode-electrode control circuit 43 through a resister $R_0$. Which one of the anode electrode units 121 connected in series is the above anode electrode 121 connected to the anode-electrode control circuit 43 is essentially arbitrary. For example, it may be the anode electrode unit positioned in an end of the anode electrode units connected in series as shown in FIG. 17, or it may be the anode electrode unit positioned, for example, in the center of the anode electrode units connected in series. The layout of the phosphor layer 31, etc., may be the same as that shown in any one of FIGS. 5 to 8.

The anode electrode unit 121 has a size that inhibits energy generated by a discharge taking place between the anode electrode unit 121 and the field emission device (more specifically, the gate electrode 13 or the cathode electrode 11) from vaporizing a portion of the anode electrode unit 121 locally (more specifically, a size that inhibits vaporization caused on that portion of the anode electrode unit 121 which corresponds to one subpixel). Specifically, the anode electrode unit 121 had a rectangular form as an outer form, and had a size (area S) of 0.33 mm×110 mm. FIG. 17 shows four anode electrode units 121 for simplification of the drawing.

In the anode panel AP in Example 5, a resistance layer 128 made of SiC, chromium oxide or the like is formed between the anode electrode units 121 by a sputtering method. That is, the anode electrode units 121 are connected in series through the resistance layer 128. The resistance layer 128 may optionally cover the entire anode electrode 120. Further, an edge portion of the anode electrode unit 121 that does not face any adjacent anode electrode unit 121 is covered with the resistance layer 129.

And, $V_A/L_g<1$ (kV/μm) is satisfied, in which $V_A$ (unit: kilovolt) is a voltage difference between an output voltage of the anode-electrode control circuit 43 and a voltage applied to the cold cathode field emission device (specifically, voltage applied to the cathode electrode 11), $L_g$ (unit:μm) is a gap length between the anode electrode units 121, $r_0$ (unit:kilo Ω) is a resistance value of the resistance layer 128, and I (unit: ampere) is a current that is caused to flow in the anode electrode unit 121 by a discharge between the anode electrode unit 121 and the field emission device. Specifically, the gap length $L_g$ between the anode electrode units was 50 μm. Further, the value of $r_0$ is about 1 kilo Ω, and the value of a discharge current I is about 23 kilo amperes at the largest.

In the display in Example 5, when the distance between the anode electrode unit 121 and the field emission device is d (unit:μm) and when the anode electrode unit 121 has an area of S (unit:mm$^2$), $(V_A/7)^2\times(S/d)\leqq 2250$ is satisfied, and further, $(V_A/7)^2\times(S/d)\leqq 450$ is satisfied. Specifically, the value of d is 1.0 mm, and the value of S is 36.3 mm$^2$.

As explained in Example 1, no local vaporization takes place in the anode electrode unit 121 so long as the integrated value of energy that is generated in the anode electrode unit 121 during a discharge between the anode electrode unit 121 and the field emission device does not exceed the value of the total energy $Q_{Total}$. More specifically, the anode electrode 121 is caused to suffer no vaporization of any portion having a size equivalent to one subpixel.

Figure 18:
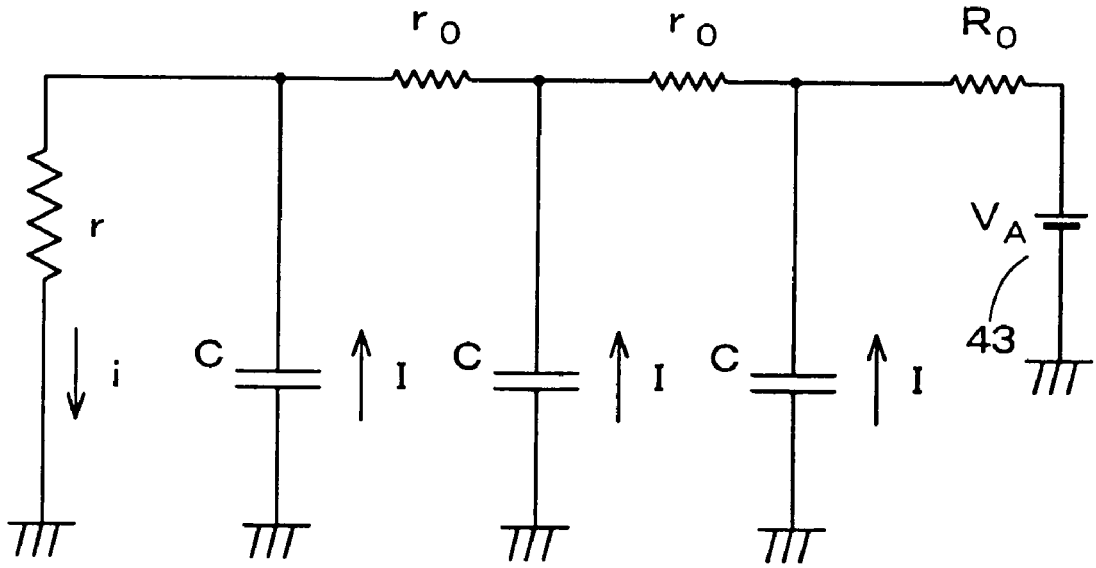
FIG. 18 shows an equivalent circuit when an abnormal discharge takes place between an anode electrode unit and a gate electrode in Example 5.

FIG. 18 shows an equivalent circuit found when a discharge takes place between the anode electrode unit 121 and the gate electrode 13. FIG. 18 shows three anode electrode units. A discharge current i flows due to a discharge between the anode electrode unit 121 and the gate electrode 13, and the theoretical resistance value (r) that is a resistance value between the anode electrode unit 121 and the gate electrode 13 in this case is 0.2 Ω. The value of a capacitor (C) to be formed by the anode electrode unit 121 and the gate electrode 13 when the value of S was 9000 mm$^2$ (number N of anode electrode units=1), 3000 mm$^2$ (number N of anode electrode units=3), 2250 mm$^2$ (number N of anode electrode units=4 or 450 mm$^2$ (number N of anode electrode units=20) was set to be 60 pF, 20 pF, 15 pF or 3 pF. Further, $V_A$ was determined to be 7 kilovolts. An integrated value of energy generated during a discharge when the value of S is 9000 mm$^2$, 3000 mm$^2$, 2250 mm$^2$ or 450 mm$^2$ was determined by simulation. Table 3 shows the results.

TABLE 3

| Area of anode electrode unit | integrated value during discharge |
|---|---|
| 9000 mm$^2$ | $5.6\times10^{-3}$ (J) |
| 3000 mm$^2$ | $1.9\times10^{-3}$ (J) |
| 2250 mm$^2$ | $1.4\times10^{-3}$ (J) |
| 450 mm$^2$ | $2.8\times10^{-4}$ (J) |

When the anode electrode unit 121 has an area of 9000 mm$^2$ or 3000 mm$^2$, the integrated value of energy generated during a discharge between the anode electrode unit 121 and the field emission device exceeds $Q_{Total}$. When the anode electrode unit 121 has an area of 2250 mm$^2$ or less, the integrated value of energy generated during a discharge between the anode electrode unit 121 and the field emission device does not exceed $Q_{Total}$. Therefore, the anode electrode unit 121 cannot be destroyed in a portion having a size equivalent to one subpixel due to energy generated by a discharge that takes place between the anode electrode unit 121 and the field emission device (specifically, the gate electrode 13 or the cathode electrode 11). Specifically, there is no case where the anode electrode unit 121 is locally vaporized (specifically, in a portion having a size equivalent to one subpixel) due to a discharge between the anode electrode unit 121 and the field emission device. When $r_1$ was about 30 kilo Ω and when $r_0$ was about 1 kilo Ω, the integrated values of energy generated for 1 nanosecond after a discharge took place between the anode electrode unit 121 and the field emission device resulted in the same values as shown in Tables 2 and 3.

Figure 19:
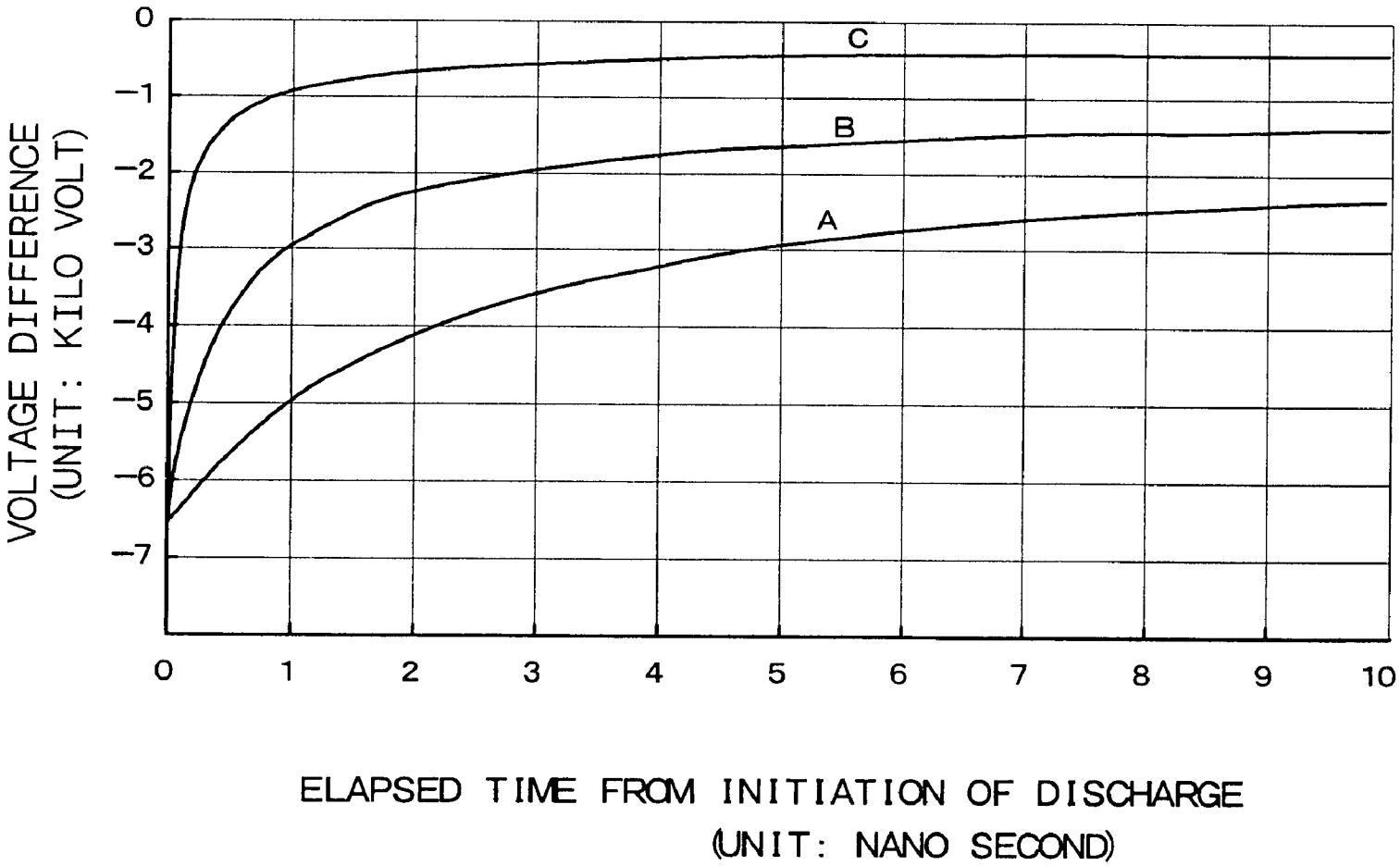
FIG. 19 is a graph showing simulation results of a voltage difference between one anode electrode unit and another adjacent anode electrode unit when the resistance value of a resistance layer formed between the anode electrode units is 1 kΩ, 200Ω or 20Ω in Example 5.

Further, when the anode electrode 120 had an area of 9000 mm$^2$, and when the number N of the anode electrode units 121 was 20 (area S of anode electrode unit 121=450 mm$^2$), the voltage difference between adjacent anode electrode units was simulated while the resistance value $r_0$ of the resistance layer 128 was varied. FIG. 19 shows the results. In FIG. 19, curves A, B and C show results where $r_0$=1 kΩ, 200 Ω and 20 Ω, respectively. It is seen from FIG. 19 that as the resistance value $r_0$ of the resistance layer 128 decreases, the voltage difference between the adjacent anode electrode units decreases. In view of the above simulation results, it can be said that the resistance value $r_0$ of the resistance layer 128 is preferably 200 Ω or less.

There was manufactured a display having an anode panel AP in which the gap length $L_g$ between the anode electrode units 121 (S=36.3 $mm^2$) was 50 μm. While aerial atmosphere was maintained inside the display without vacuuming the inside of the display, the display was tested by applying a voltage to the display while the voltage difference $V_A$ between the output voltage of the anode-electrode control circuit and the voltage applied to the cold cathode field emission device (specifically, a voltage applied to the cathode electrode 11) was adjusted to 2 kilovolts, 3 kilovolts, 4 kilovolts, 5 kilovolts and 6 kilovolts, to show that a discharge took place between the anode electrode units 121 with a probability of 100% when the voltage difference $V_A$ was 5 kilovolts or higher. When the voltage difference $V_A$ was less than 5 kilovolts, almost no discharge took place between the anode electrode units 121. When it is taken into account that the discharge breakdown between the anode electrode units 121 is in proportion to the gap length $L_g$ between the anode electrode units 121, it is seen from the above data that if $V_A/L_g<$ (5/50) (kV/μm), that is, $V_A/L_g<0.1$ kV/μm) is satisfied, no discharge takes place between the anode electrode units 121. Further, taking it into account that the above series of tests were carried out in aerial atmosphere, it is considered that the voltage difference $V_A$ at which the discharge takes place when the display is performed in an actual vacuum atmosphere is 5 to 10 times the voltage difference $V_A$ at which the discharge takes place in aerial atmosphere, so that the above expression can be modified to $V_A/L_g<1$ (kV/μm).

(In re Various Field Emission Devices)

Various field emission devices and method of manufacturing them will be explained below.

In Examples, Spindt-type (field emission device in which the conical electron-emitting portion is formed on the cathode electrode positioned in the bottom portion of the second opening portion) has been explained. Besides the above, for example, a plane-type (field emission device in which a nearly flat-surfaced electron-emitting portion is formed on a cathode electrode positioned in the bottom portion of a second opening portion) can be also employed. These field emission devices will be called a field emission device having a first structure.

Alternatively, there may be employed a field emission device comprising:

(a) a stripe-shaped cathode electrode being formed on a supporting member and extending in a first direction, (b) an insulating layer formed on the supporting member and the cathode electrode, (c) a stripe-shaped gate electrode being formed on the insulating layer and extending in a second direction different from the first direction, and (d) a first opening portion formed through the gate electrode and a second opening portion being formed through the insulating layer and communicating with the first opening portion, and having a structure in which that portion of the cathode electrode which is exposed in the bottom portion of the second opening portion corresponds to an electron-emitting portion and electrons are emitted from the exposed portion of the cathode electrode in the bottom portion of the second opening portion.

The thus-structured field emission device includes a flat-type field emission device that emits electrons from a flat surface of the cathode electrode. This field emission device will be called a field emission device having a second structure.

In the Spindt-type field emission device, the material for constituting an electron-emitting portion may include at least one material selected from the group consisting of tungsten, a tungsten alloy, molybdenum, a molybdenum alloy, titanium, a titanium alloy, niobium, a niobium alloy, tantalum, a tantalum alloy, chromium, a chromium alloy and impurity-containing silicon (polysilicon or amorphous silicon). The electron-emitting portion of the Spindt-type field emission device can be formed by, for example, a vapor deposition method, a sputtering method and a CVD method.

In the plane-type field emission device, preferably, the electron-emitting portion is made of a material having a smaller work function Φ than a material for constituting a cathode electrode. The material for constituting an electron-emitting portion can be selected on the basis of the work function of a material for constituting a cathode electrode, a potential difference between the gate electrode and the cathode electrode, a required current density of emitted electrons, and the like. Typical examples of the material for constituting a cathode electrode of the field emission device include tungsten (Φ=4.55 eV), niobium (Φ=4.02-4.87 eV), molybdenum (Φ=4.53-4.95 eV), aluminum (Φ=4.28 eV), copper (Φ=4.6 eV), tantalum (Φ=4.3 eV), chromium (Φ=4.5 eV) and silicon (Φ=4.9 eV). The material for constituting an electron-emitting portion preferably has a smaller work function Φ than these materials, and the value of the work function thereof is preferably approximately 3 eV or smaller. Examples of such a material include carbon (Φ<1 eV), cesium (Φ=2.14 eV), $LaB_6$ (Φ=2.66-2.76 eV), BaO (Φ=1.6-2.7 eV), SrO (Φ=1.25-1.6 eV), $Y_2O_3$ (Φ=2.0 eV), CaO (Φ=1.6-1.86 eV), BaS (Φ=2.05 eV), TiN (Φ=2.92 eV) and ZrN (Φ=2.92 eV). More preferably, the electron-emitting portion is made of a material having a work function Φ of 2 eV or smaller. The material for constituting an electron-emitting portion is not necessarily required to have electric conductivity.

Otherwise, in the plane-type field emission device, the material for constituting an electron-emitting portion can be selected from materials having a secondary electron gain δ greater than the secondary electron gain δ of the electrically conductive material for constituting a cathode electrode. That is, the above material can be properly selected from metals such as silver (Ag), aluminum (Al), gold (Au), cobalt (Co), copper (Cu), molybdenum (Mo), niobium (Nb), nickel (Ni), platinum (Pt), tantalum (Ta), tungsten (W) and zirconium (Zr); semiconductors such as silicon (Si) and germanium (Ge); inorganic simple substances such as carbon and diamond; and compounds such as aluminum oxide ($Al_2O_3$), barium oxide (BaO), beryllium oxide (BeO), calcium oxide (CaO), magnesium oxide (MgO), tin oxide ($SnO_2$), barium fluoride ($BaF_2$) and calcium fluoride ($CaF_2$). The material for constituting an electron-emitting portion is not necessarily required to have electric conductivity.

In the plane-type field emission device, as a material for constituting an electron-emitting portion, particularly, carbon is preferred. More specifically, diamond, graphite and a carbon-nanotube structure are preferred. When the electron-emitting portion is made of diamond, graphite or the carbon-nanotube structure, an emitted-electron current density necessary for the display can be obtained at an electric field intensity of $5\times10^7$ V/m or lower. Further, since diamond is an electric resister, emitted-electron currents obtained from the electron-emitting portions can be brought into uniform currents, and the fluctuation of brightness can be suppressed when such field emission devices are incorporated into the display. Further, since the above materials exhibit remarkably high durability against sputtering by ions of residual gas in the display, field emission devices having a longer lifetime can be attained.

Specifically, the carbon-nanotube structure includes a carbon-nanotube and/or a carbon-nanofiber. More specifically, the electron-emitting portion may be constituted of a carbon-nanotube, it may be constituted of a carbon-nanofiber, or it may be constituted of a mixture of a carbon-nanotube with a carbon-nanofiber. Macroscopically, the carbon-nanotube and carbon-nanofiber may have the form of a powder or a thin film. The carbon-nanotube structure may have the form of a cone in some cases. The carbon-nanotube and carbon-nanofiber can be produced or formed by a known PVD method as an arc discharge method and a laser abrasion method; and any one of various CVD methods such as a plasma CVD method, a laser CVD method, a thermal CVD method, a gaseous phase synthetic method and a gaseous phase growth method.

The plane-type field emission device can be produced by a method in which a dispersion of a carbon-nanotube structure in a binder material is, for example, applied onto a desired region of the cathode electrode and the binder material is fired or cured (more specifically, a method in which the carbon-nanotube structure is dispersed in an organic binder material such as an epoxy resin or an acrylic resin or an inorganic binder material such as water glass or silver paste and the like, the dispersion is, for example, applied onto a desired region of the cathode electrode, then, the solvent is removed and the binder material is fired and cured). The above method will be referred to as "first forming method of a carbon-nanotube structure". The application method includes, for example, a screen printing method.

Alternatively, the plane-type field emission device can be produced by a method in which a dispersion of the carbon-nanotube structure in a metal compound solution is applied onto the cathode electrode and then, the metal compound is fired, whereby the carbon-nanotube structure is fixed to the surface of the cathode electrode with a matrix containing metal atoms derived from the metal compound. The above method will be referred to as "second forming method of a carbon-nanotube structure". The matrix is preferably made of an electrically conductive metal oxide. More specifically, it is preferably made of tin oxide, indium oxide, indium-tin oxide, zinc oxide, antimony oxide or antimony-tin oxide. After the firing, there can be obtained a state where part of each carbon-nanotube structure is embedded in the matrix, or there can be obtained a state where the entire portion of each carbon-nanotube structure is embedded in the matrix. The matrix preferably has a volume resistivity of $1\times10^{-9}$ Ω·m to $5\times10^{-6}$ Ω·m.

The metal compound for constituting the metal compound solution includes, for example, an organometal compound, an organic acid metal compound and metal salts (for example, chloride, nitrate and acetate). The organic acid metal compound solution is, for example, a solution prepared by dissolving an organic tin compound, an organic indium compound, an organic zinc compound or an organic antimony compound in an acid (for example, hydrochloric acid, nitric acid or sulfuric acid) and diluting the resultant solution with an organic solvent (for example, toluene, butyl acetate or isopropyl alcohol). Further, the organic metal compound solution is, for example, a solution prepared by dissolving an organic tin compound, an organic indium compound, an organic zinc compound or an organic antimony compound in an organic solvent (for example, toluene, butyl acetate or isopropyl alcohol). When the amount of the solution is 100 parts by weight, the solution preferably has a composition containing 0.001 to 20 parts by weight of the carbon-nanotube structure and 0.1 to 10 parts by weight of the metal compound. The solution may contain a dispersing agent and a surfactant. From the viewpoint of increasing the thickness of the matrix, an additive such as carbon black or the like may be added to the metal compound solution. In some cases, the organic solvent may be replaced with water.

The method for applying, onto the cathode electrode the metal compound solution in which the carbon-nanotube structure is dispersed includes a spray method, a spin coating method, a dipping method, a die quarter method and a screen printing method. Of these, a spray method is preferred in view of easiness in application.

There may be employed a constitution in which the metal compound solution in which the carbon-nanotube structure is disperse is applied onto the cathode electrode, the metal compound solution is dried to form a metal compound layer, then, an unnecessary portion of the metal compound layer on the cathode electrode is removed, and then the metal compound is fired. Otherwise, an unnecessary portion of the metal compound layer on the cathode electrode may be removed after the metal compound is fired. Otherwise, the metal compound solution may be applied only onto a desired region of the cathode electrode.

The temperature for firing the metal compound is preferably, for example, a temperature at which the metal salt is oxidized to form a metal oxide having electric conductivity, or a temperature at which the organometal compound or an organic acid metal compound is decomposed to form a matrix (for example, a metal oxide having electric conductivity) containing metal atoms derived from the organometal compound or the organic acid metal compound. For example, the above temperature is preferably at least 300° C. The upper limit of the firing temperature can be a temperature at which elements constituting the field emission device or the cathode panel do not suffer any thermal damage and the like.

In the first forming method or the second forming method of a carbon-nanotube structure, it is preferred to carry out a kind of an activation treatment (washing treatment) of the surface of the electron-emitting portion after the formation of the electron-emitting portion, since the efficiency of emission of electrons from the electron-emitting portion is further improved. The above activation treatment includes a plasma treatment in an atmosphere containing a gas such as hydrogen gas, ammonia gas, helium gas, argon gas, neon gas, methane gas, ethylene gas, acetylene gas or nitrogen gas.

In the first forming method or the second forming method of a carbon-nanotube structure, the electron-emitting portion may be formed in that portion of the cathode electrode which portion is positioned in the bottom portion of the second opening portion, or the electron-emitting portion may be also formed so as to extend from that portion of the cathode electrode which portion is positioned in the bottom portion of the second opening portion to the surface of that portion of the cathode electrode which portion is different from the portion of the cathode electrode in the bottom portion of the second opening portion. Further, the electron-emitting portion may be formed on the entire surface or part of the surface of that portion of the cathode electrode which portion is positioned in the bottom portion of the second opening portion.

In the field emission device having the first or second structure, depending upon the structure of field emission device, one electron-emitting portion may exist in one first opening portion formed in the gate electrode and one second opening portion formed in the insulating layer, or a plurality of electron-emitting portions may exist in one first opening portion formed in the gate electrode and one second opening portion formed in the insulating layer, or one electron-emitting portion or a plurality of electron-emitting portions may exist in a plurality of first opening portions formed in the gate electrode and one second opening portion which is formed in the insulating layer and communicates with such first opening portions.

The plan form of the first or second opening portion (form obtained by cutting the first or second opening portion with an imaginary plane in parallel with the surface of the supporting member) may be any form such as a circle, an oval, a rectangle, a polygon, a rounded rectangle or a rounded polygon. The first opening portion can be formed, for example, by isotropic etching or by a combination of anisotropic etching and isotropic etching. Otherwise, the first opening portion can be formed directly according to the forming method of the gate electrode. The second opening portion can be also formed, for example, by isotropic etching or by a combination of anisotropic etching and isotropic etching.

In the field emission device having the first structure, a resistance layer may be formed between the cathode electrode and the electron-emitting portion. Otherwise, when the surface of the cathode electrode corresponds to the electron-emitting portion, that is, in the field emission device having the second structure, the cathode electrode may have a three-layered structure constituted of an electrically conductive material layer, a resistance layer and an electron-emitting layer corresponding to the electron-emitting portion. The resistance layer can stabilize performances of the field emission device and can attain uniform electron emitting properties. The material for constituting a resistance layer includes carbon-containing materials such as silicon carbide (SiC) and SiCN; SiN; semiconductor materials such as amorphous silicon and the like; and refractory metal oxides such as ruthenium oxide ($RuO_2$), tantalum oxide and tantalum nitride. The resistance layer can be formed by a sputtering method, a CVD method or a screen-printing method. The resistance value of the resistance layer is approximately $1\times10^5$ to $1\times10^7$ Ω, preferably several MΩ.

[Spindt-Type Field Emission Device]

The Spindt-type field emission device comprises:

(a) a stripe-shaped cathode electrode 11 being formed on a supporting member 10 and extending in a first direction, (b) an insulating layer 12 formed on the supporting member 10 and the cathode electrode 11, (c) a stripe-shaped gate electrode 13 being formed on the insulating layer 12 and extending in a second direction different from the first direction, (d) a first opening portion 14A formed through the gate electrode 13 and a second opening portion 14B being formed through the insulating layer 12 and communicating with the first opening portion 14A, and (e) an electron-emitting portion 15 formed on a cathode electrode 11 positioned in the bottom portion of the second opening portion 14B, and has a structure in which electrons are emitted from the conical electron-emitting portion 15 exposed in the bottom portion of the second opening portion 14B.

The method of manufacturing the Spindt-type field emission device will be explained below with reference to FIGS. 20A, 20B, 21A and 21B which are schematic partial end views of the supporting member 10, etc., constituting a cathode panel.

The above Spindt-type field emission device can be obtained basically by a method in which the conical electron-emitting portion 15 is formed by vertical vapor deposition of a metal material. That is, while deposition particles perpendicularly enter the first opening portion 14A formed through the gate electrode 13, the amount of deposition particles reaching the bottom portion of the second opening portion 14B is gradually decreased by utilizing a masking effect produced by an overhanging deposit formed around the edge of opening of the first opening portion 14A, and the electron-emitting portion 15, which is a conical deposit, is formed in a self-alignment manner. There will be explained below a method in which a peeling-off layer 16 is formed on the gate electrode 13 and the insulating layer 12 beforehand for making it easy to remove an unnecessary overhanging deposit. In the drawings for explaining the method of manufacturing a field emission device, one electron-emitting portion alone is shown.

[Step-A0]

A conductive material layer composed, for example, of polysilicon for a cathode electrode is formed on a supporting member 10 made, for example, of a glass substrate by a plasma-enhanced CVD method. Then, the conductive material layer for a cathode electrode is patterned by a lithograph method and a dry etching method, to form the cathode electrode 11 having a stripe form. Thereafter, the insulating layer 12 composed of $SiO_2$ is formed on the entire surface by a CVD method.

[Step-A1]

Then, the conductive material layer (for example, TiN layer) for a gate electrode is formed on the insulating layer 12 by a sputtering method. Then, the conductive material layer for a gate electrode is patterned by a lithograph method and a dry etching method, to form the stripe-shaped gate electrode 13. The cathode electrode 11 in the form of a stripe extends in a direction rightward and leftward to the paper surface of the drawing and the gate electrode 13 in the form of a stripe extends in a direction perpendicular to the paper surface of the drawing.

The gate electrode 13 can be formed by a known thin film forming method such as a PVD method including a vapor deposition method and the like, a CVD method, a plating method including an electroplating method and an electroless plating method, a screen printing method, a laser abrasion method, a sol-gel method, a lift-off method and the like, or a combination of one of them with an etching method as required. For example, a stripe-shaped gate electrode can be directly formed when a screen-printing method or a plating method is employed.

[Step-A2]

Then, a resist layer is formed again, and the first opening portion 14A is formed through the gate electrode 13 by etching, and further, the second opening portion 14B is formed through the insulating layer by etching. The cathode electrode 11 is exposed in the bottom portion of the second opening portion 14B, and then, the resist layer is removed. In the above manner, a structure shown in FIG. 20A can be obtained.

[Step-A3]

Figure 20A:
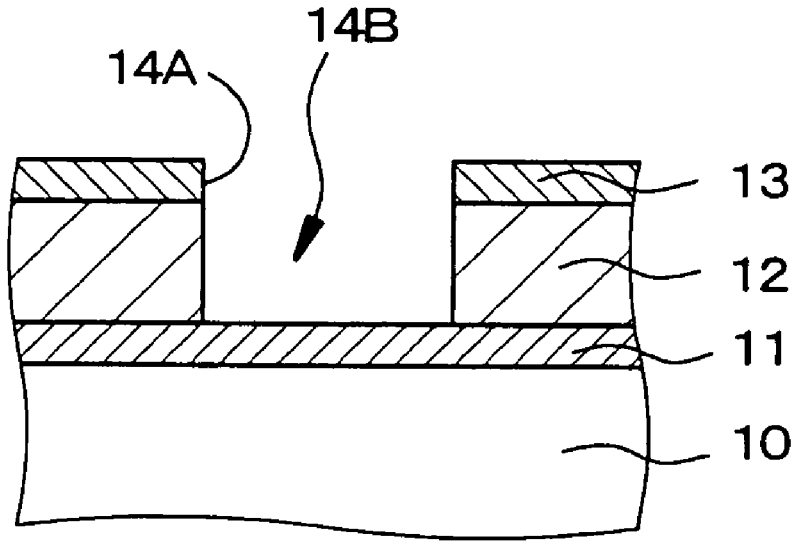
FIGS. 20A and 20B are schematic partial end views of a supporting member, etc., for explaining a method of manufacturing a Spindt-type cold cathode field emission device.
Figure 20B:
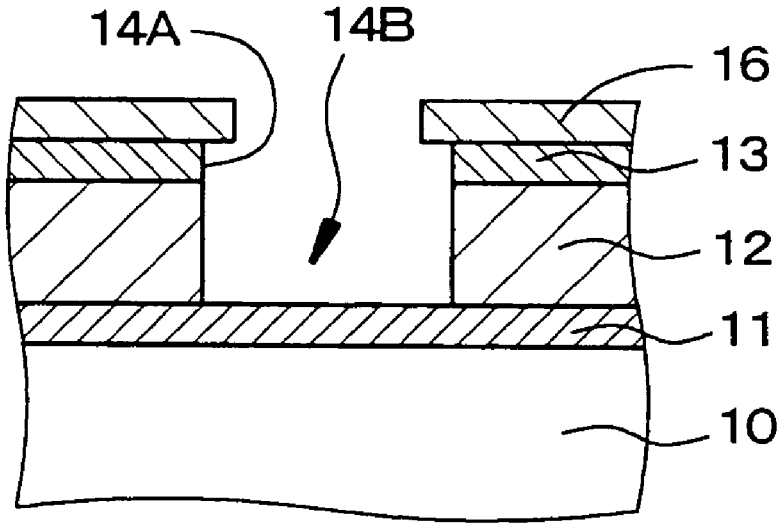

As shown in FIG. 20B, a peeling-off layer 16 is then formed on the insulating layer 12 and the gate electrode 13 by oblique vapor deposition of nickel (Ni) while the supporting member 10 is turned. In this case, the incidence angle of vaporized particles relative to the normal of the supporting member 10 is set at a sufficiently large angle (for example, an incidence angle of 65° to 85° ), whereby the peeling-off layer 16 can be formed on the gate electrode 13 and the insulating layer 12 almost without depositing any nickel in the bottom portion of the second opening portion 14B. The peeling-off layer 16 extends from the opening edge portion of the first opening portion 14A like eaves, whereby the diameter of the first opening portion 14A is substantially decreased.

[Step-A4]

Figure 21A:
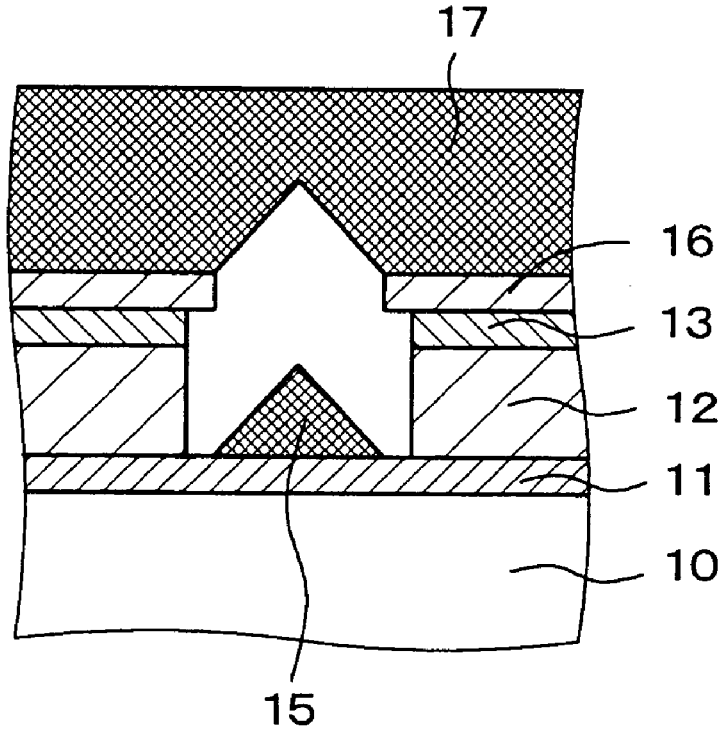
FIGS. 21A and 21B, following
Figure 21B:
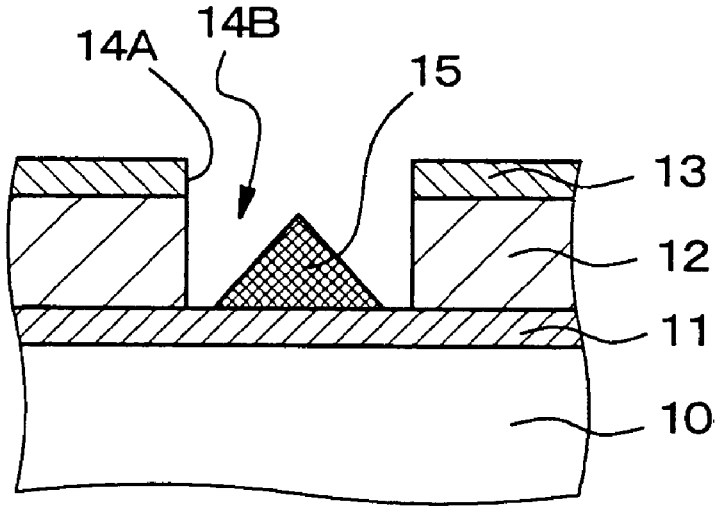

Then, an electrically conductive material such as molybdenum (Mo) is deposited on the entire surface by vertical vapor deposition (incidence angle 3° to 10°). During the above vapor deposition, as shown in FIG. 21A, as the conductive material layer 17 having an overhanging form grows on the peeling-off layer 16, the substantial diameter of the first opening portion 14A is gradually decreased, and the vaporized particles which contribute to the deposition in the bottom portion of the second opening portion 14B gradually come to be limited to particles which pass the central region of the first opening portion 14A. As a result, a circular-cone-shaped deposit is formed on the bottom portion of the second opening portion 14B, and the circular-cone-shaped deposit constitutes the electron-emitting portion 15.

[Step-A5]

Then, the peeling-off layer 16 is peeled off from the surfaces of the gate electrode 13 and the insulating layer 12 by a lift-off method, and the conductive material layer 17 above the gate electrode 13 and the insulating layer 12 are selectively removed. In this manner, the cathode panel having a plurality of the Spindt-type field emission devices can be obtained.

[Plane-Type Field Emission Device (No. 1)]

The plane-type field emission device comprises:

(a) cathode electrode 11 being formed on a supporting member 10 and extending in first direction, (b) an insulating layer 12 formed on the supporting member 10 and the cathode electrode 11, (c) a gate electrode 13 being formed on the insulating layer 12 and extending in a second direction different from the first direction, (d) a first opening portion 14A formed through the gate electrode 13 and a second opening portion 14B being formed through the insulating layer 12 and communicating with the first opening portion 14A, (e) a flat electron-emitting portion 15A formed on the cathode electrode 11 positioned in the bottom portion of the second opening portion 14B, and has a structure in which electrons are emitted from the electron-emitting portion 15A exposed in the bottom portion of the second opening portion 14B.

An electron-emitting portion 15A comprises a matrix 18 and a carbon-nanotube structure (specifically, a carbon-nanotube 19) embedded in the matrix 18 in a state where the top portion of the carbon-nanotube structure is projected, and the matrix 18 is formed from an electrically conductive metal oxide (specifically, indium-tin oxide, ITO).

The production method of the field emission device will be explained with reference to FIGS. 22A, 22B, 23A and 23B, hereinafter.

[Step-B0]

First, a stripe-shaped cathode electrode 11 made of an approximately 0.2 μm thick chromium (Cr) layer is formed on a supporting member 10 made, for example, of a glass substrate, for example, by a sputtering method and an etching technique.

[Step-B1]

Then, a metal compound solution consisting of an organic acid metal compound solution in which the carbon-nanotube structure is dispersed is applied onto the cathode electrode 11, for example, by a spray method. Specifically, a metal compound solution shown in Table 4 is used. In the metal compound solution, the organic tin compound and the organic indium compound are in a state where they are dissolved in an acid (for example, hydrochloric acid, nitric acid or sulfuric acid). The carbon-nanotube is produced by an arc discharge method and has an average diameter of 30 nm and an average length of 1 μm. In the application, the supporting member 10 is heated to 70-150° C. Atmospheric atmosphere is employed as an application atmosphere. After the application, the supporting member 10 is heated for 5 to 30 minutes to fully evaporate butyl acetate off. When the supporting member 10 is heated during the application as described above, the applied solution begins to dry before the carbon-nanotube is self-leveled toward the horizontal direction of the surface of the cathode electrode 11. As a result, the carbon-nanotube can be arranged on the surface of the cathode electrode 11 in a state where the carbon-nanotube is not in a level position. That is, the carbon-nanotube can be aligned in the direction in which the top portion of the carbon-nanotube faces the anode electrode, in other words, the carbon-nanotube comes close to the normal direction of the supporting member 10. The metal compound solution having a composition shown in Table 4 may be prepared beforehand, or a metal compound solution containing no carbon-nanotube may be prepared beforehand and the carbon-nanotube and the metal compound solution may be mixed before the application. For improving dispersibility of the carbon-nanotube, ultrasonic wave may be applied when the metal compound solution is prepared.

TABLE 4

| | |
|---|---|
| Organic tin compound and organic indium compound | 0.1-10 parts by weight |
| Dispersing agent (sodium dodecylsulfate) | 0.1-5 parts by weight |
| Carbon-nanotube | 0.1-20 parts by weight |
| Butyl acetate | Balance |

When a solution of an organic tin compound dissolved in an acid is used as an organic acid metal compound solution, tin oxide is obtained as a matrix. When a solution of an organic indium compound dissolved in an acid is used, indium oxide is obtained as a matrix. When a solution of an organic zinc compound dissolved in an acid is used, zinc oxide is obtained as a matrix. When a solution of an organic antimony compound dissolved in an acid is used, antimony oxide is obtained as a matrix. When a solution of an organic antimony compound and an organic tin compound dissolved in an acid is used, antimony-tin oxide is obtained as a matrix. Further, when an organic tin compound is used as an organic metal compound solution, tin oxide is obtained as a matrix. When an organic indium compound is used, indium oxide is obtained as a matrix. When an organic zinc compound is used, zinc oxide is obtained as a matrix. When an organic antimony compound is used, antimony oxide is obtained as a matrix. When an organic antimony compound and an organic tin compound are used, antimony-tin oxide is obtained as a matrix. Alternatively, a solution of metal chloride (for example, tin chloride or indium chloride) may be used.

After the metal compound solution is dried, salient convexo-concave shapes may be formed in the surface of the metal compound layer in some cases. In such cases, it is desirable to apply the metal compound solution again on the metal compound layer without heating the supporting member 10.

[Step-B2]

Then, the metal compound composed of the organic acid metal compound is fired, to give an electron-emitting portion 15A having the carbon-nanotubes 19 fixed onto the surface of the cathode electrode 11 with the matrix 18 (which is specifically a metal oxide, and more specifically, ITO) containing metal atoms (specifically, In and Sn) derived from the organic acid metal compound. The firing is carried out in an atmospheric atmosphere at 350° C. for 20 minutes. The thus-obtained matrix 18 had a volume resistivity of $5\times10^{-7}$ Ω·m. When the organic acid metal compound is used as a starting material, the matrix 18 made of ITO can be formed at a low firing temperature of as low as 350° C. The organic acid metal compound solution may be replaced with an organic metal compound solution. When a solution of metal chloride (for example, tin chloride and indium chloride) is used, the matrix 18 made of ITO is formed while the tin chloride and indium chloride are oxidized by the firing.

[Step-B3]

Then, a resist layer is formed on the entire surface, and the circular resist layer having a diameter, for example, of 10 μm is retained above a desired region of the cathode electrode 11. The matrix 18 is etched with hydrochloric acid having a temperature of 10 to 60° C. for 1 to 30 minutes, to remove an unnecessary portion of the electron-emitting portion. Further, when the carbon-nanotubes still remain in a region different from the desired region, the carbon-nanotubes are etched by an oxygen plasma etching treatment under a condition shown in Table 5. A bias power may be 0 W, i.e., direct current, while it is desirable to apply the bias power. The supporting member may be heated, for example, to approximately 80° C.

TABLE 5

| | |
|---|---|
| Apparatus to be used | RIE apparatus |
| Gas to be introduced | Gas containing oxygen |
| Plasma exciting power | 500 W |
| Bias power | 0-150 W |
| Treatment time period | at least 10 seconds |

Alternatively, the carbon-nanotubes can be etched by a wet etching treatment under a condition shown in Table 6.

TABLE 6

| | |
|---|---|
| Solution to be used | $KMnO_4$ |
| Temperature | 20-120° C. |
| Treatment time period | 10 seconds-20 minutes |

Figure 22A:
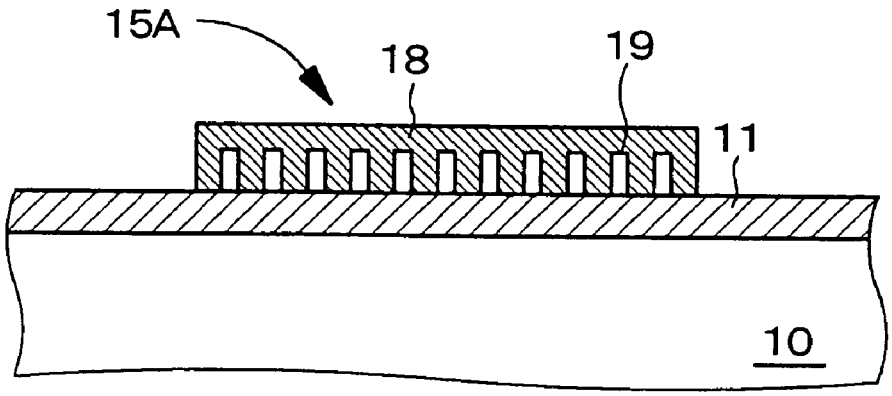
FIGS. 22A and 22B are schematic partial end views of a supporting member, etc., for explaining a method of manufacturing a plane-type cold cathode field emission device (No. 1).
Figure 22B:
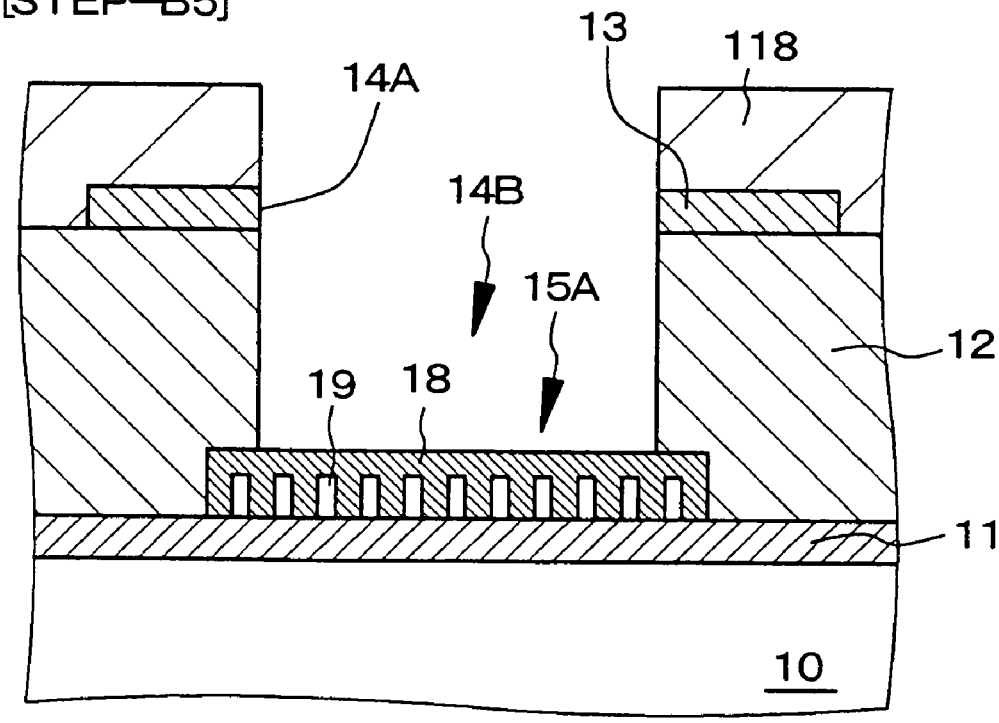

Then, the resist layer is removed, whereby a structure shown in FIG. 22A can be obtained. It is not necessarily required to retain a circular electron-emitting portion 15A having a diameter of 10 μm. For example, the electron-emitting portion 15A may be retained on the cathode electrode 11.

The process may be carried out in the order of [Step-B1], [Step-B3] and [Step-B2].

[Step-B4]

An insulating layer 12 is formed on the electron-emitting portion 15A, the supporting member 10 and the cathode electrode 11. Specifically, an approximately 1 μm thick insulating layer 12 is formed on the entire surface by a CVD method using, for example, tetraethoxysilane (TEOS) as a source gas.

[Step-B5]

Then, a stripe-shaped gate electrode 13 is formed on the insulating layer 12. Further, a mask layer 118 is formed on the insulating layer 12 and the gate electrode 13, then, a first opening portion 14A is formed through the gate electrode 13, a second opening portion 14B communicating with the first opening portion 14A formed through the gate electrode 13 is formed through the insulating layer 12 (see FIG. 22B). When the matrix 18 is made of a metal oxide, for example, ITO, the insulating layer 12 can be etched without etching the matrix 18. That is, the etching selective ratio between the insulating layer 12 and the matrix 18 is approximately infinite. The carbon-nanotubes 19 are therefore not damaged when the insulating layer 12 is etched.

[Step-B6]

Then, preferably, part of the matrix 18 is removed under a condition shown in Table 7, to obtain the carbon-nanotubes 19 in a state where top portions thereof are projected from the matrix 18. In this manner, the electron-emitting portion 15A having a structure shown in FIG. 23A can be obtained.

TABLE 7

| | |
|---|---|
| Etching solution | Hydrochloric acid |
| Etching time period | 10 seconds-30 seconds |
| Etching temperature | 10-60° C. |

Some or all of the carbon-nanotubes 19 may change in their surface state due to the etching of the matrix 18 (for example, oxygen atoms or oxygen molecules or fluorine atoms are adsorbed to their surfaces), and the carbon-nanotubes 19 are deactivated with respect of electric field emission in some cases. Therefore, it is preferred to subject the electron-emitting portion 15A to a plasma treatment in a hydrogen gas atmosphere. By the plasma treatment, the electron-emitting portion 15A is activated, and the efficiency of emission of electrons from the electron-emitting portion 15A is further improved. Table 8 shows an example of a plasma treatment condition.

TABLE 8

| | |
|---|---|
| Gas to be used | $H_2$ = 100 sccm |
| Source power | 1000 W |
| Power to be applied to supporting member | 50 V |
| Reaction pressure | 0.1 Pa |
| Supporting member temperature | 300° C. |

Then, for releasing gas from the carbon-nanotubes 19, a heating treatment or various plasma treatments may be carried out. For allowing a substance to be adsorbed to the surfaces of the carbon-nanotubes 19, the carbon-nanotubes 19 may be exposed to a gas containing the substance whose adsorption is desirable. For purifying the carbon-nanotubes 19, an oxygen plasma treatment or a fluorine plasma treatment may be carried out.

[Step-B7]

Figure 23A:
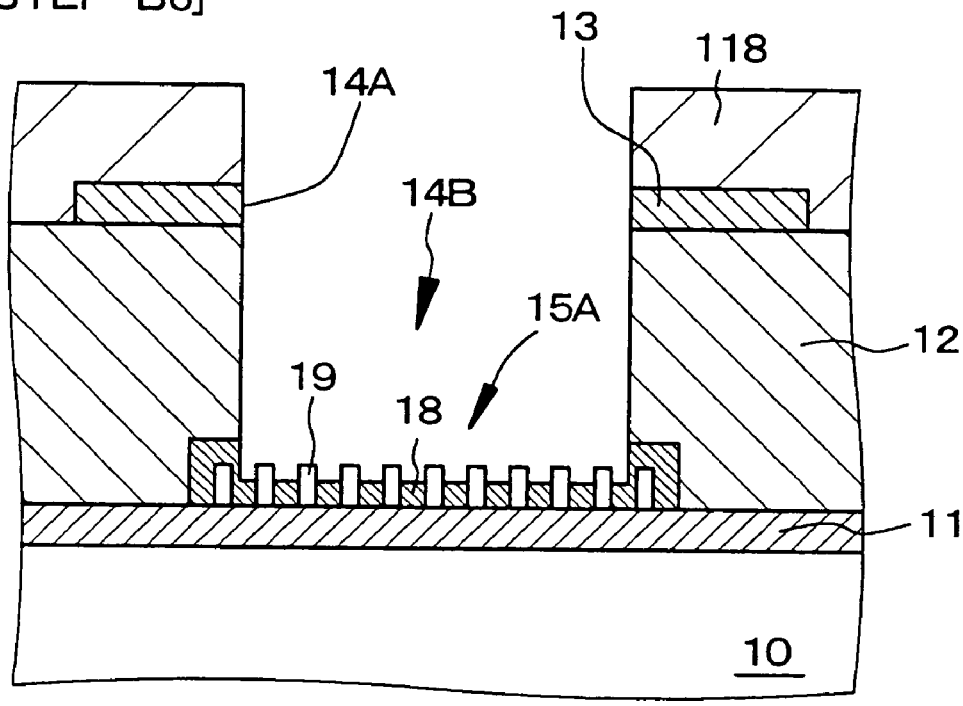
FIGS. 23A and 23B, following
Figure 23B:
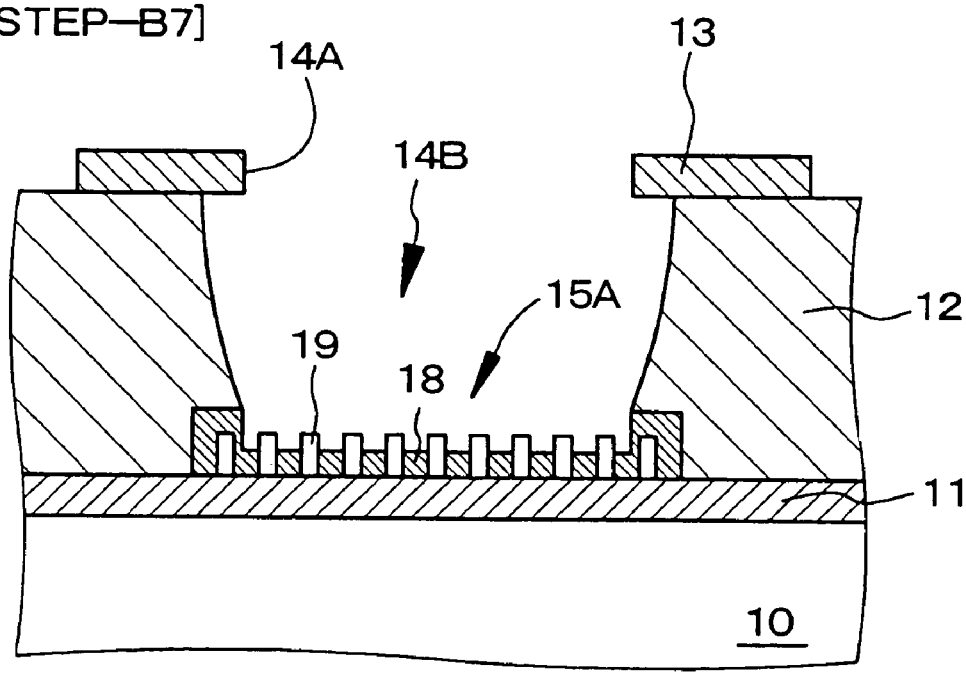

Then, the side wall surface of the second opening portion 14B formed through the insulating layer 12 are allowed to recede by isotropic etching, which is preferred from the viewpoint of exposing the opening end portion of the gate electrode 13. The isotropic etching can be carried out by dry etching using radicals as main etching species like chemical dry etching, or by wet etching using an etching solution. As an etching solution, for example, a mixture containing a 49% hydrofluoric acid aqueous solution and pure water in a hydrofluoric acid aqueous solution: pure water volume ratio of 1:100 can be used. Then, the mask layer 118 is removed, whereby a field emission device shown in FIG. 23B is completed.

The above process can be carried out in the order of [Step-B5], [Step-B7] and [Step-B6].

[Plane-Type Field Emission Device (No. 2)]

Figure 24A:
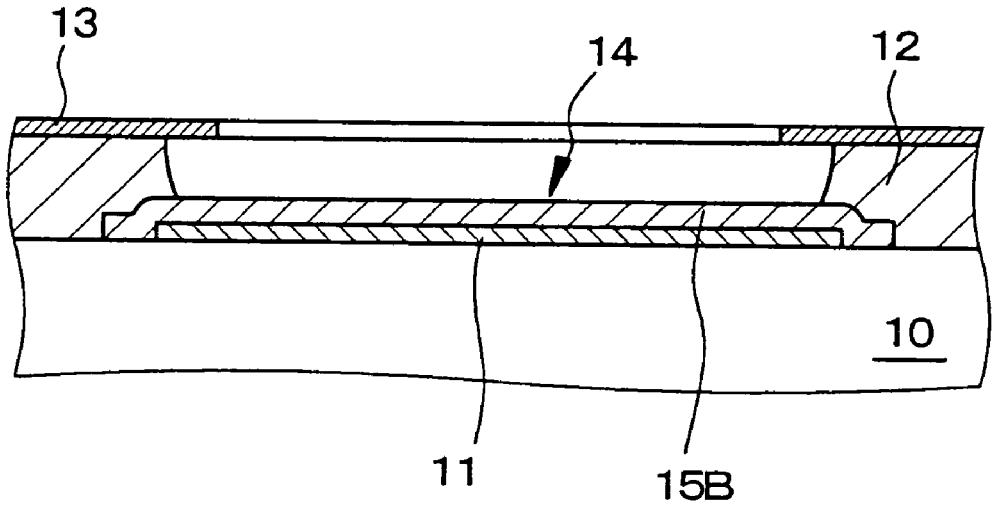
FIGS. 24A and 24B are a schematic partial cross-sectional view of a plane-type cold cathode field emission device (No. 2) and a schematic partial end view of a flat-type cold cathode field emission device, respectively.

FIG. 24A shows a schematic partial cross-sectional view of a plane-type field emission device. The plane-type field emission device comprises a cathode electrode 11 formed on a supporting member 10 made, for example, of glass, an insulating layer 12 formed on the supporting member 10 and the cathode electrode 11, a gate electrode 13 formed on the insulating layer 12, an opening portion 14 formed through the gate electrode 13 and the insulating layer 12 (a first opening portion formed through the gate electrode 13 and a second opening portion being formed through the insulating layer 12 and communicating with the first opening portion), and a flat electron-emitting portion (electron-emitting layer 15B) formed on that portion of the cathode electrode 11 which is positioned in the bottom portion of the opening portion 14. The electron-emitting layer 15B is formed on the stripe-shaped cathode electrode 11 extending in the direction perpendicular to the paper surface of the drawing. Further, the gate electrode 13 is extending leftward and rightward on the paper surface of the drawing. The cathode electrode 11 and the gate electrode 13 are made of chromium. Specifically, the electron-emitting layer 15B is constituted of a thin layer made of a graphite powder. In the plane-type field emission device shown in FIG. 24A, the electron-emitting layer 15B is formed on the entire region of the surface of the cathode electrode 11, while the plane-type field emission device shall not be limited to such a structure, and the point is that the electron-emitting layer 15B is formed at least in the bottom portion of the opening portion 14.

[Flat-Type Field Emission Device]

Figure 24B:
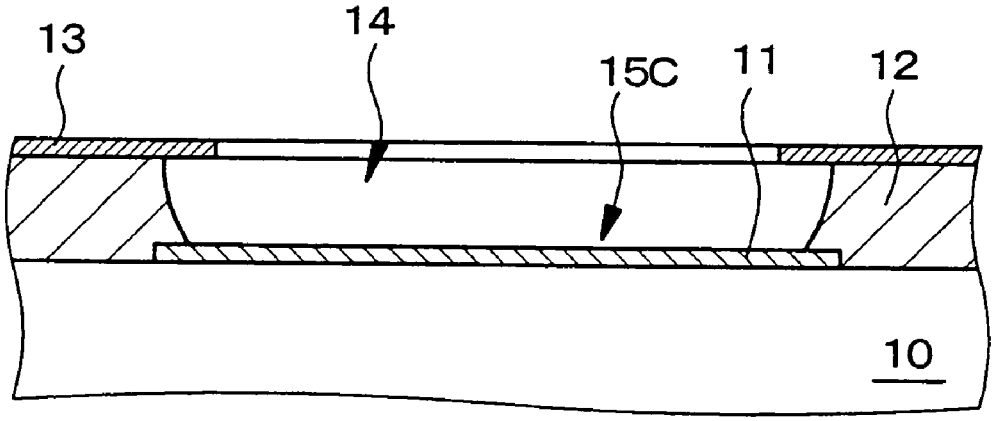

FIG. 24B shows a schematic partial cross-sectional view of a flat-type field emission device. The flat-type field emission device comprises a stripe-shaped cathode electrode 11 formed on a supporting member 10 made, for example, of glass, an insulating layer 12 formed on the supporting member 10 and the cathode electrode 11, a stripe-shaped gate electrode 13 formed on the insulating layer 12, and first and second opening portions (opening portion 14) formed through the gate electrode 13 and the insulating layer 12. The cathode electrode 11 is exposed in the bottom portion of the opening portion 14. The cathode electrode 11 is extending in the direction perpendicular to the paper surface of the drawing, and the gate electrode 13 is extending in leftward and rightward on the paper surface of the drawing. The cathode electrode 11 and the gate electrode 13 are made of chromium (Cr), and the insulating layer 12 is made of $SiO_2$. That portion of the above cathode electrode 11 which is exposed in the bottom portion of the opening portion 14 corresponds to an electron-emitting portion 15C.

[Method of Manufacturing an Anode Panel and a Display]

The method of manufacturing an anode panel AP will be explained below with reference to FIGS. 25A to 25F which are schematic partial cross-sectional views of a substrate, etc.

[Step-100]

Figure 25A:
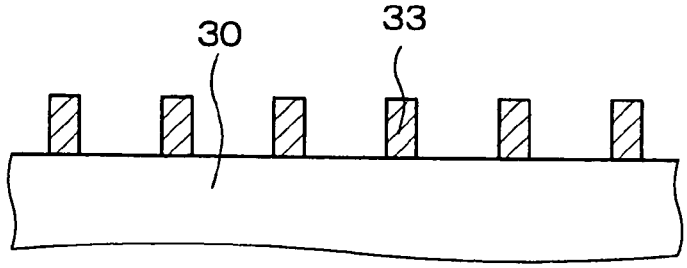
FIGS. 25A to 25F are schematic partial cross-sectional views of a substrate, etc., for explaining a method of manufacturing an anode panel.
Figure 25B:
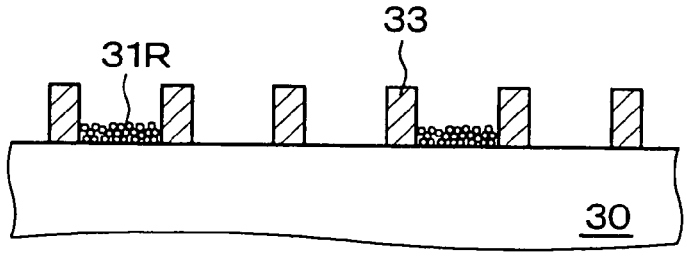
Figure 25C:
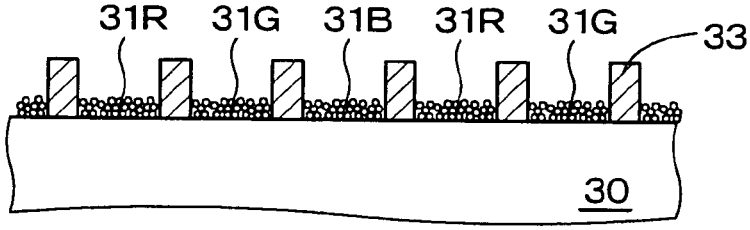

First, a separation wall 33 is formed on a substrate 30 made of a glass substrate (see FIG. 25A). The plan form of the separation wall 33 is the form of a lattice (grid). Specifically, a lead glass layer colored in black with a metal oxide such as cobalt oxide or the like is formed so as to have a thickness of approximately 50 μm, and then the lead glass layer is selectively processed by photolithography and an etching technique, whereby the separation wall 33 (see, for example, FIG. 5) having the form of a lattice (grid) can be obtained. There may be optionally employed a constitution in which a glass paste having a low melting point is printed on the substrate 30 by a screen printing method, and then the glass paste having a low melting point is fired to form the separation wall, or a constitution in which a photosensitive polyimide resin layer is formed on the entire surface of the substrate 30, and then the photosensitive polyimide resin layer is exposed to light and developed to form the separation wall. The separation wall 33 in one pixel had length×width×height dimensions of 200 μm×100 μm×50 μm. Part of the separation wall works as a spacer holder for holding a spacer 34. Before the formation of the separation wall 33, preferably, a black matrix (not shown in FIG. 25) is formed on the surface of that portion of the substrate 30 which is a portion where the separation wall 33 is to be formed, for improving displayed images in contrast. A stripe-shaped transparent electrode 27 may be formed before the formation of the black matrix and the separation wall 33.

[Step-110]

Then, for forming a phosphor layer 31R that emits light in red, for example, a red-light-emitting phosphor slurry prepared by dispersing a red-light-emitting phosphor particles in a polyvinyl alcohol (PVA) resin and water and further adding ammonium bichromate is applied to the entire surface, and the applied red-light-emitting phosphor slurry is dried. Then, that portion of the red-light-emitting phosphor slurry which is a portion where the red-light-emitting phosphor layer 31R is to be formed is irradiated to ultraviolet ray through the substrate 30 to expose the red-light-emitting phosphor slurry. The red-light-emitting phosphor slurry is gradually cured from the substrate 30 side. The thickness of the red-light-emitting phosphor layer 31R is determined depending upon the dosage of ultraviolet ray to the red-light-emitting phosphor slurry. In this case, the red-light-emitting phosphor layer 31R had a thickness of approximately 8 μm, which was attained by adjusting the time period of irradiation of the red-light-emitting phosphor slurry with the ultraviolet ray. Then, the red-light-emitting phosphor slurry is developed, whereby the red-light-emitting phosphor layer 31R can be formed between predetermined separation walls 33 (see FIG. 25B). Thereafter, a green-light-emitting phosphor slurry is treated in the same manner as above, to form a green-light-emitting phosphor layer 31G, and a blue-light-emitting phosphor slurry is treated in the same manner as above, to form a blue-light-emitting phosphor layer 31B (see FIG. 25C). The surface of the phosphor layer 31 microscopically has a convexoconcave shape formed by a plurality of the phosphor particles. The method of forming the phosphor layer is not limited to the above-explained method. A red-light-emitting phosphor slurry, a green-light-emitting phosphor slurry and a blue-light-emitting phosphor slurry may be consecutively applied, followed by consecutive exposures and developments of the phosphor slurries to form each phosphor layer, or each phosphor layer may be formed by a screen printing method or the like.

[Step-120]

Then, the substrate 30 having the separation walls 33 and the phosphor layers 31 is immersed in a liquid (specifically, water) filled in a treatment vessel while the phosphor layer 31 is allowed to face the liquid surface side. A drain portion of the treatment vessel is closed in advance. And, an intermediate film 50 having a substantially flat surface is formed on the liquid surface. Specifically, an organic solvent in which a resin (lacquer) for constituting the intermediate film 50 is dissolved is dropped on the liquid surface. That is, an intermediate film material for forming the intermediate film 50 is spread on the liquid surface. The resin (lacquer) for constituting the intermediate film is a kind of varnish in a broad sense, and it includes a solution of a cellulose derivative, generally, a formulation containing nitrocellulose as a main component in a volatilizable solvent such as a lower fatty acid ester, a urethane lacquer containing other synthetic polymer and an acrylic lacquer. Then, in a state where the intermediate film material is floated on the liquid surface, the intermediate film material is dried, for example, for 2 minutes, whereby a film is formed from the intermediate film material, and the intermediate film 50 having a flat surface is formed on the liquid surface. When the intermediate film 50 is formed, the amount of the intermediate film material to be spread is adjusted so that it has a thickness, for example, of about 30 nm.

Figure 25D:
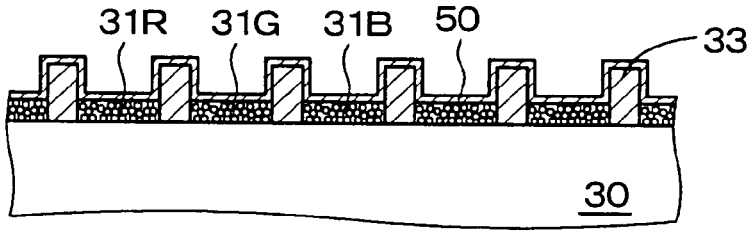
Figure 25E:
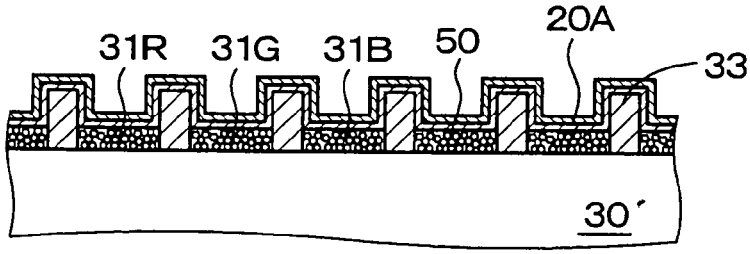
Figure 25F:
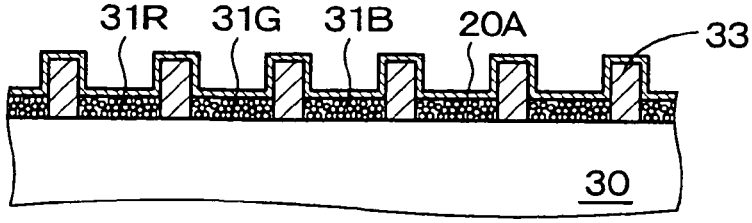

Then, the drain portion of the treatment vessel is opened, and the liquid is drained from the treatment vessel to lower the liquid surface, whereby the intermediate film 50 formed on the liquid surface moves toward the separation wall 33, comes in contact with the separation wall 33 and finally comes into a state where the intermediate film 50 is in contact with the phosphor layers 31, and the intermediate film 50 is left on the phosphor layers 31 (see FIG. 25D).

[Step-130]

Then, the intermediate film 50 is dried. That is, the substrate 30 is taken out of the treatment vessel, introduced into a drying furnace and dried in an environment having a predetermined temperature. The temperature for drying the intermediate film 50 is preferably in the range, for example, of 30° C. to 60° C., and the time period for drying the intermediate film 50 is preferably in the range, for example, of several minutes to several tens minutes. The drying time period is naturally decreased or increased depending upon the drying temperature.

[Step-140]

Then, a conductive material layer 20A is formed on the intermediate film 50. Specifically, the conductive material layer 20A made of a conductive material such as aluminum (Al), chromium (Cr) or the like is formed so as to cover the intermediate film 50 by a vapor deposition method or a sputtering method (see FIG. 25E).

[Step-150]

Then, the intermediate film 50 is fired at about 400° C. (see FIG. 25F). The intermediate film 50 is combusted off by the above firing, and the conductive material layer 20A remains on the phosphor layers 31 and the separation walls 33. Gas generated by the combustion of the intermediate film 50 is discharged to an outside through fine pores formed in that region of the conductive material layer 20A which is bent along the form of the separation wall 33. Since the pores are very fine, they do not cause any serious influence on the structural strength of the anode electrode or on the property of image display.

[Step-160]

Then, the conductive material layer 20A is patterned by lithography and an etching technique, whereby, for example, the anode electrode units, the electric supply line and the electric supply line units can be obtained. Further, a resistance layer, a first resistance element and a second resistance element may be formed as required by a screen printing method, or by a CVD method, lithography and an etching technique. In this manner, the anode panel AP can be completed.

[Step-170]

On the other hand, the cathode panel CP is prepared. Then, the display is assembled. Specifically, a spacer 34 is attached on a spacer holding portion formed in the effective region of the anode panel AP. Then, the anode panel AP and the cathode panel CP are arranged such that the phosphor layer 31 and the electron-emitting region face each other, and the anode panel AP and the cathode panel CP (more specifically, the substrate 30 and the supporting member 10) are bonded to each other in their circumferential portions through the frame 35 made of ceramic or glass having a height of approximately 1 mm. In the bonding, a frit glass is applied to bonding portions of the frame 35 and the anode panel AP and bonding portions of the frame 35 and the cathode panel CP. Then, the anode panel AP, the cathode panel CP and the frame 35 are attached. The frit glass is pre-calcined or pre-sintered to be dried, and then fully calcined or sintered at approximately 450° C. for 10 to 30 minutes. Then, a space surrounded by the anode panel AP, the cathode panel CP, the frame 35 and the frit glass is vacuumed through a through-hole (not shown) and a tip tube (not shown), and when the space comes to have a pressure of approximately $10^{-4}$ Pa, the tip tube is sealed by thermal fusion. In the above manner, the space surrounded by the anode panel AP, the cathode panel CP and the frame 35 can be vacuumed, whereby the display panel can be obtained. Otherwise, for example, the frame 35, the anode panel AP and the cathode panel CP may be bonded in a high-vacuum atmosphere. Otherwise, the anode panel AP and the cathode panel CP may be bonded with the adhesive layer alone without the frame depending upon the structure of the display. Then, wiring to external circuits is carried out to complete the display.

While the present invention has been explained on the basis of preferred Examples, the present invention shall not be limited thereto. The constitutions and structures explained with regard to the anode panel, the cathode panels, the displays and the field emission devices in Examples are given as examples and may be modified as required. The manufacturing method explained with regard to the anode panel, the cathode panels, the displays and the field emission devices are given as examples and may be modified as required. Further, the various materials used in the manufacture of the anode panel and the cathode panels are also given as examples and may be modified as required. With regard to the display, color displays are explained as examples, while the display may be a monochromatic display.

In the field emission device, there have been mostly explained embodiments in which one electron-emitting portion corresponds to one opening portion, while there may be employed an embodiment in which a plurality of electron-emitting portions correspond to one opening portion or one electron-emitting portion corresponds to a plurality of opening portions, depending upon the structure of the field emission device. Alternatively, there may be also employed an embodiment in which a plurality of first opening portions are formed through a gate electrode, a plurality of second opening portions communicating with a plurality of the first opening portion are formed through an insulating layer, and one or a plurality of electron-emitting portions are formed.

Figure 26:
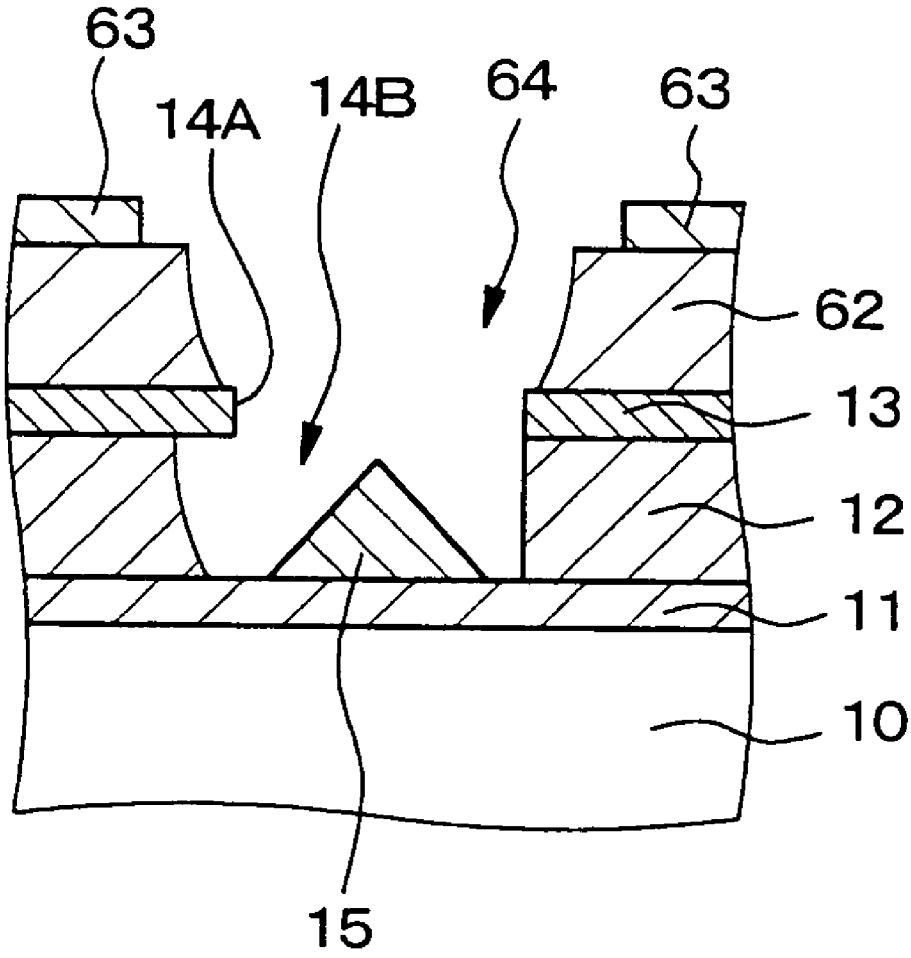
FIG. 26 is a schematic partial end view of a Spindt-type cold cathode field emission device having a focus electrode.

The field emission device in the present invention may have a constitution in which a second insulating layer 62 is further formed on the gate electrode 13 and the insulating layer 12, and a focus electrode 63 is formed on the second insulating layer 62. FIG. 26 shows a schematic partial end view of the thus-constituted field emission device. The second insulating layer 62 has a third opening portion 64 communicating with the first opening portion 14A. The focus electrode 63 may be formed as follows. For example, in [Step-A2], the gate electrode 13 in the form of a stripe is formed on the insulating layer 12; the second insulating layer 62 is formed; a patterned focus electrode 63 is formed on the second insulating layer 62; the third opening portion 64 is formed in the focus electrode 63 and the second insulating layer 62; and further, the first opening portion 14A is formed in the gate electrode 13. The focus electrode may be a focus electrode having a form in which focus electrode units, each of which corresponds to one or a plurality of electron-emitting portions or one or a plurality of pixels, are gathered, or may be a focus electrode having a form in which the effective field is covered with a sheet of an electrically conductive material, depending upon the patterning of the focus electrode. FIG. 26 shows a Spindt-type field emission device, however, the focus electrode can be also applied to another type of the field emission device.

In the display according to the first-B aspect of the present invention explained in Example 1 or Example 2, the focus electrode 15 may be replaced with a focus electrode which will be explained hereinafter. That is, one example of the focus electrode can be formed by forming an insulation film made, for example, of $SiO_2$ on each surface of a metal sheet made, for example, of 42% Ni—Fe alloy having a thickness of several tens micrometers, and then forming opening portions in regions corresponding to pixels by punching or etching. And, the cathode panel, the metal sheet and the anode panel are stacked, a frame is arranged in the circumferential portions of the two panels, and a heat treatment is carried out to bond the insulation film formed on one surface of the metal sheet and the insulating layer 12 and to bond the insulation layer formed on the other surface of the metal sheet and the anode panel, whereby these members are integrated, followed by evacuating and sealing. In this manner, the display can be also completed.

When the focus electrode is formed, a discharge takes place mainly between the focus electrode and the anode electrode unit. The shortest distance between the anode electrode unit and the focus electrode corresponds to the distance d between the anode electrode unit and the field emission device.

The gate electrode can be formed so as to have a form in which the effective field is covered with one sheet of an electrically conductive material (having a opening portion). In this case, a positive voltage is applied to the gate electrode. And, a switching element constituted, for example, of TFT is provided between the cathode electrode constituting a pixel and the cathode-electrode control circuit, and the voltage application state to the electron-emitting portion constituting the pixel is controlled by the operation of the above switching element, to control the light emission state of the pixel.

Alternatively, the cathode electrode can be formed so as to have a form in which the effective filed is covered with one sheet of an electrically conductive material. In this case, a voltage is applied to the cathode electrode. And, a switching element constituted, for example, of TFT is provided between the electron-emitting portion constituting a pixel and the gate-electrode control circuit, and the voltage application state to the gate electrode constituting the pixel is controlled by the operation of the switching element, to control the light emission state of the pixel.

Figure 27:
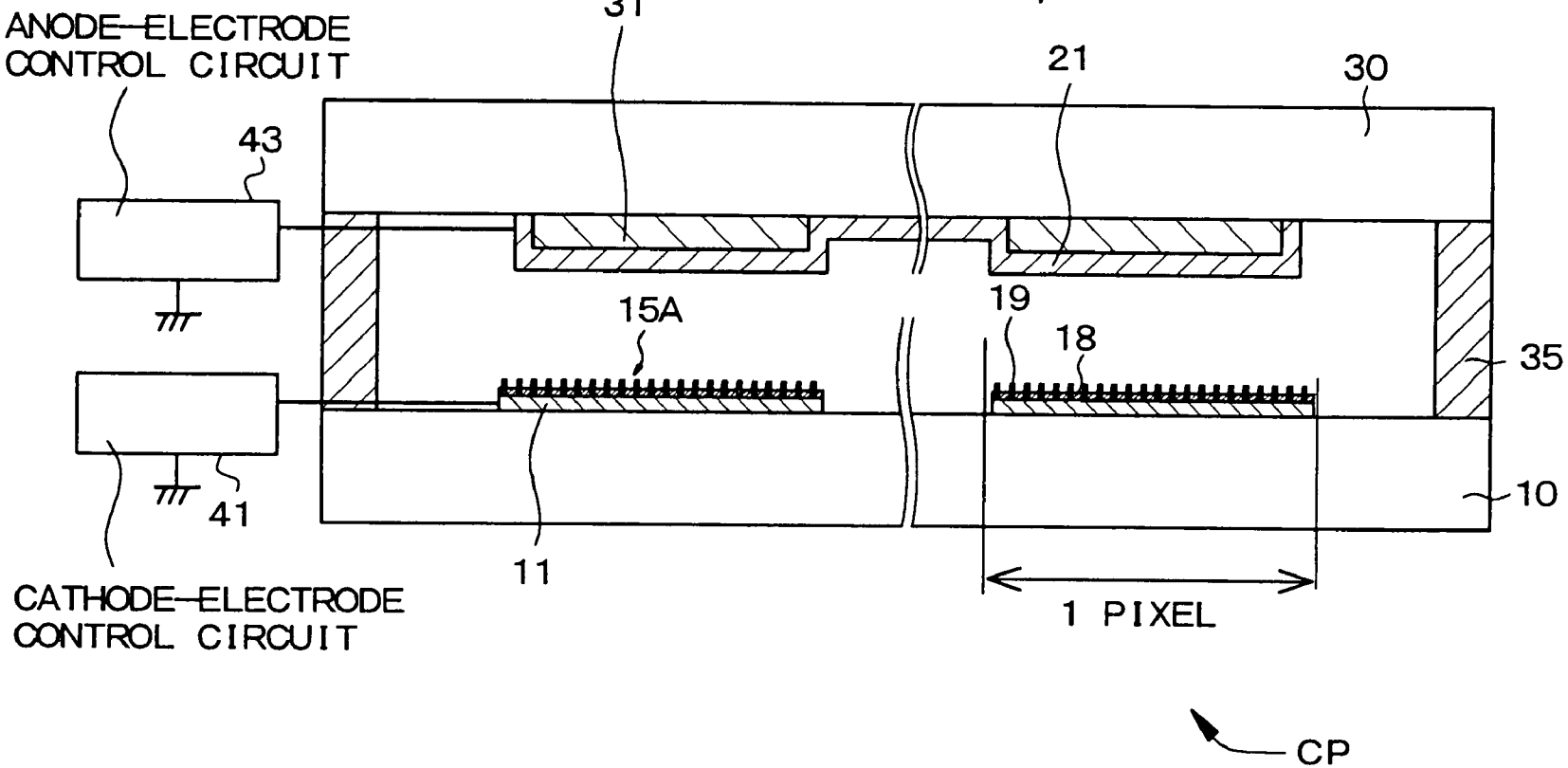
FIG. 27 is a schematic partial cross-sectional view of a so-called two-electrode-type cold cathode field emission display.

The cold cathode field emission display shall not be limited to a so-called three-electrode-type constituted of a cathode electrode, a gate electrode and an anode electrode, and it may be a so-called two-electrode-type constituted of a cathode electrode and an anode electrode. FIG. 27 shows a schematic partial cross-sectional view of an embodiment in which the constitution of the anode panel explained in Example 1 is applied to the thus-structured display. In FIG. 27, showing of a separation wall, a black matrix and a resister $R_0$ is omitted. The field emission device in the display comprises a cathode electrode 11 formed on a supporting member 10 and an electron-emitting portion 15A constituted of carbon nanotubes 19 formed on the cathode electrode 11. An anode electrode 20 constituting an anode panel AP is constituted of a plurality of stripe-shaped anode electrode units 21. There is no electric conduction between the stripe-shaped anode electrode units. The structure of the electron-emitting portion shall not be limited to the carbon nanotube structure. The projection image of the stripe-shaped cathode electrode 11 and the projection image of the stripe-shaped anode electrode unit 21 cross each other at right angles. Specifically, the cathode electrode 11 extends in the direction perpendicular to the paper surface of the drawing, and the stripe-shaped anode electrode unit 21 extends leftward and rightward on the paper surface of the drawing. In a cathode panel CP of the above display, a number of electron-emitting regions constituted of a plurality of the above field emission devices each are formed in the form of a two-dimensional matrix in the effective field.

In the above display, electrons are emitted from the electron-emitting portion 15A on the basis of a quantum tunnel effect by an electric field formed by the anode electrode unit 21, and the electrons are drawn to the anode electrode unit 21 to collide with the phosphor layer 31. That is, the display is driven by a so-called simple matrix method in which electrons are emitted from the electron-emitting portion 15A positioned in the overlap region of the projection image of the anode electrode unit 21 and the projection image of the cathode electrode 11 (anode electrode/cathode electrode overlap region). Specifically, a relatively negative voltage is applied to the cathode electrode 11 from a cathode-electrode control circuit 41, and a relatively positive voltage is applied to the anode electrode unit 21 from an anode-electrode control circuit 43. As a result, electrons are selectively emitted into a vacuum space from the carbon nanotubes 19 constituting the electron-emitting portion 15A positioned in the anode electrode/cathode electrode overlap region of a column-selected cathode electrode 11 and a row-selected anode electrode unit 21 (or a row-selected cathode electrode 11 and a column-selected anode electrode unit 21), the electrons are drawn toward the anode electrode unit 21 to collide with the phosphor layer 31 constituting the anode panel AP and excite the phosphor layer 31 to make the phosphor layer 31 to emit light.

Those various anode panels AP explained in Examples 1 to 5 can be applied to the above-constituted display.

Figure 28A:
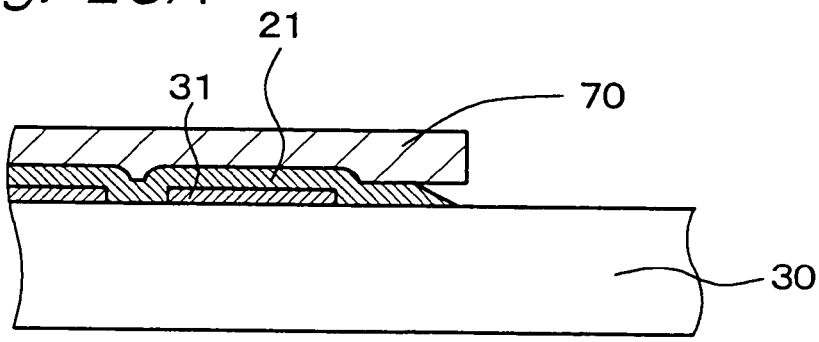
FIGS. 28A, 28C and 28D are schematic partial end views of a substrate, etc., for explaining a preferred method for forming a resistance layer on an anode electrode unit.
Figure 28B:
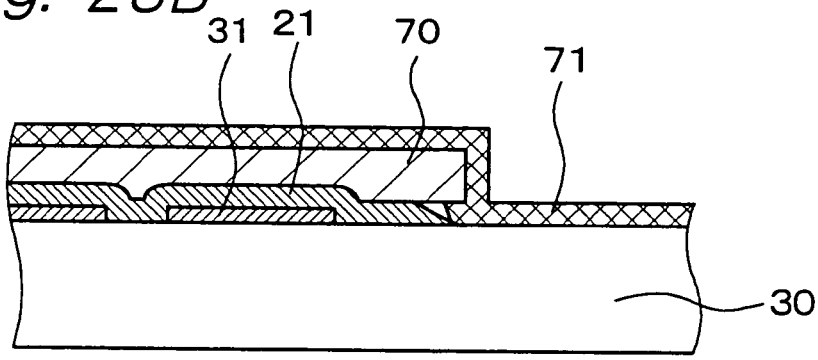
FIG. 28B is a schematic partial end view of a substrate, etc., for explaining a problem caused when a resistance layer is formed on an anode electrode unit.
Figure 28C:
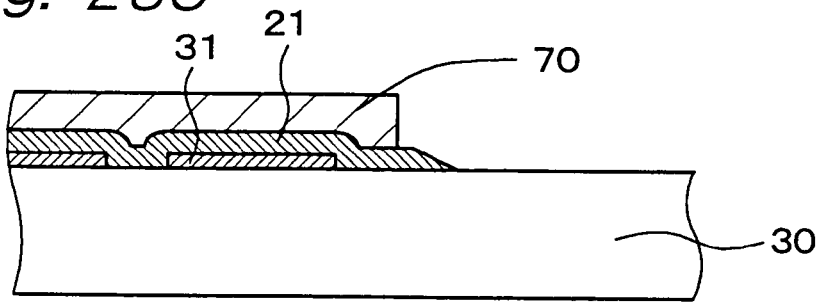
Figure 28D:
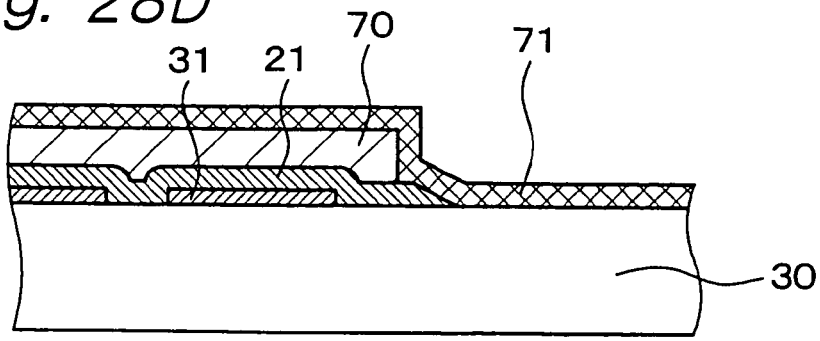
Figure 29:
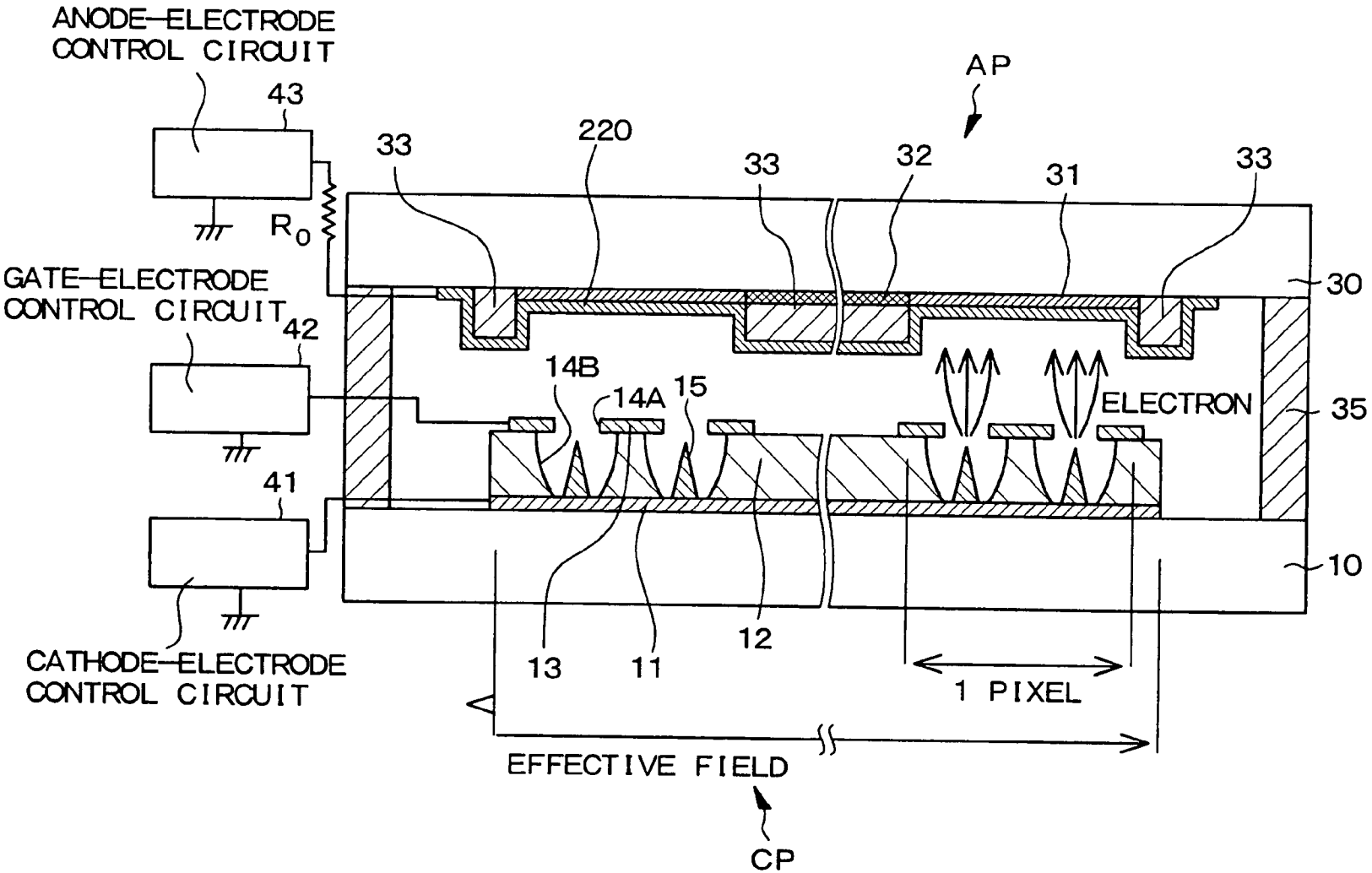
FIG. 29 is a schematic partial end view of a conventional cold cathode field emission display.

One embodiment of the method of forming the resistance layer 28 or 128 after the formation of the anode electrode unit 21 or 121 will be explained. That is, a resist mask layer is formed on the anode electrode 20 or 120 by a spin coating method, followed by defoaming in vacuum. Then, the resist mask layer is patterned by lithography, and the anode electrode 20 or 120 is etched using the above resist mask layer 70 as an etching mask, to form the anode electrode unit 21 or 121. This state is schematically shown in FIG. 28A. Generally, the anode electrode 20 or 120 just below the opening of the resist mask layer 70 is in an over-etched state. Then, for forming a resistance layer 28 or 128, a resistive element film 71 made of SiC is formed on a portion of the exposed anode electrode unit 21 or 121, on a portion of the substrate 30 and on the resist mask layer 70 by a sputtering method in a state where the resist mask layer 70 is retained, and then, the resist mask layer 70 is removed, whereby the resistance layer 28 or 128 can be obtained. Since, however, the anode electrode 20 or 120 just below the opening of the resist mask layer 70 is in an over-etched state, there are some cases where the resistance layer 28 or 128 is not reliably formed on the exposed anode electrode unit 21 or 121 (see FIG. 28B). For preventing the above phenomenon, after a state shown in FIG. 28A is obtained, the resist mask layer 70 can be over-exposed, or additionally developed, or subjected to back exposure through the reverse surface of the substrate 30, whereby that portion of the resist mask layer 70 which is positioned above the edge portion of the anode electrode unit 21 or 121 can be removed (see FIG. 28C). Then, in a state where the resist mask layer 70 is left, the resistive element film 71 made of SiC is formed on a portion of the exposed anode electrode unit 21 or 121, on a portion of the substrate 30 and on the resist mask layer 70 by a sputtering method, and then, the resist mask layer is removed, whereby the resistance layer 28 or 128 can be obtained. By employing the above method, the resistance layer 28 or 128 is reliably formed on the exposed anode electrode unit 21 or 121 (see FIG. 28D).

In the display of the present invention, the anode electrode is formed in a form in which the anode electrode is split into anode electrode units having a smaller area each, so that the electrostatic capacity between the anode electrode unit and the cold cathode field emission device can be decreased, and that the energy to be generated by a discharge between the anode electrode unit and the cold cathode field emission device can be decreased. As a result, the occurrence of an abnormal discharge (vacuum arc discharge) between the anode electrode unit and the cold cathode field emission device can be effectively prevented.

Further, in the cold cathode field emission display according to the first or third aspect of the present invention, the gap length between the anode electrode units is defined, so that the occurrence of a discharge between the anode electrode units can be reliably prevented. Moreover, in the cold cathode field emission display according to the second, fourth or fifth aspect of the present invention, the area of the anode electrode unit is defined, so that local damage caused on the anode electrode unit by a discharge between the anode electrode unit and the cold cathode field emission device can be reliably suppressed. Consequently, there can be obtained a cold cathode field emission display that is excellent in operational stability and reliability and has a long lifetime.

The invention claimed is:

1. A cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, one electric supply line, and an anode electrode formed on the phosphor layer, the anode electrode is constituted of anode electrode units in the number of N ($N \geqq 2$), each anode electrode unit is connected to an anode-electrode control circuit through said electric supply line, and $V_A/L_g<1$ (kV/μm) is satisfied in which $V_A$ (unit:kilovolt) is a voltage difference between an output voltage of the anode-electrode control circuit and a voltage applied to the cold cathode field emission device, and $L_g$ (unit:μm) is a gap length between the anode electrode units.

2. The cold cathode field emission display according to claim 1, wherein:

a gap is provided between each anode electrode unit and the electric supply line, and each anode electrode unit and the electric supply line are connected through a resistance element.

3. The cold cathode field emission display according to claim 2, wherein the electric supply line is constituted of electric supply line units in the number of M ($2 \leqq M \leqq N$) connected in series through second resistance elements and one electric supply line unit is connected to one or at least two anode electrode units.

4. The cold cathode field emission display according to claim 1, wherein a stripe-shaped transparent electrode connected to the anode-electrode control circuit is formed between the phosphor layer and the substrate.

5. The cold cathode field emission display according to claim 4, wherein:

a plurality of unit phosphor layers, each constituting one picture element, are arranged in the form of a straight line and a stripe-shaped transparent electrode connected to the anode-electrode control circuit is formed between a column constituted of a plurality of the unit phosphor layers arranged in the form of a straight line and the substrate.

6. The cold cathode field emission display according to claim 1, wherein when the distance between the anode electrode unit and the cold cathode field emission device is d (unit:mm) and when the anode electrode unit has an area S (unit:$mm^2$), $(V_A/7)^2 \times (S/d) \leqq 2250$ is satisfied.

7. The cold cathode field emission display according to claim 1, wherein a resistance layer is formed between the anode electrode units.

8. The cold cathode field emission display according to claim 7, wherein that edge portion of each anode electrode unit which does not face the adjacent anode electrode unit is covered with a resistance layer.

9. The cold cathode field emission display according to claim 7, wherein:

a gap is provided between each anode electrode unit and the electric supply line, and each anode electrode unit and the electric supply line are connected through a resistance element.

10. The cold cathode field emission display according to claim 9, wherein the electric supply line is constituted of electric supply line units in the number of M ($2 \leqq M \leqq N$) connected in series through second resistance elements and one electric supply line unit is connected to one or at least two anode electrode units.

11. The cold cathode field emission display according to claim 7, wherein a stripe-shaped transparent electrode connected to the anode-electrode control circuit is formed between the phosphor layer and the substrate.

12. The cold cathode field emission display according to claim 11, wherein:

a plurality of unit phosphor layers, each constituting one picture element, are arranged in the form of a straight line and a stripe-shaped transparent electrode connected to the anode-electrode control circuit is formed between a column constituted of a plurality of the unit phosphor layers arranged in the form of a straight line and the substrate.

13. The cold cathode field emission display according to claim 7, wherein when the distance between the anode electrode unit and the cold cathode field emission device is d (unit:mm) and when the anode electrode unit has an area S (unit:$mm^2$), $(V_A/7)^2 \times (S/d) \leqq 2250$ is satisfied.

14. A cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, one electric supply line, and an anode electrode formed on the phosphor layer, the anode electrode is constituted of anode electrode units in the number of N (N≧2), each anode electrode unit is connected to an anode-electrode control circuit through said electric supply line, and $(V_A/7)^2\times(S/d)\leqq 2250$ is satisfied in which d (unit:mm) is a distance between the anode electrode unit and the cold cathode field emission device, and S (unit:$mm^2$) is an area of the anode electrode unit.

15. The cold cathode field emission display according to claim 14, wherein:

a gap is provided between each anode electrode unit and the electric supply line, and each anode electrode unit and the electric supply line are connected through a resistance element.

16. The cold cathode field emission display according to claim 15, wherein the electric supply line is constituted of electric supply line units in the number of M (2≦M≦N) connected in series through second resistance elements and one electric supply line unit is connected to one or at least two anode electrode units.

17. The cold cathode field emission display according to claim 14, wherein a stripe-shaped transparent electrode connected to the anode-electrode control circuit is formed between the phosphor layer and the substrate.

18. The cold cathode field emission display according to claim 17, wherein:

a plurality of unit phosphor layers, each constituting one picture element, are arranged in the form of a straight line and a stripe-shaped transparent electrode connected to the anode-electrode control circuit is formed between a column constituted of a plurality of the unit phosphor layers arranged in the form of a straight line and the substrate.

19. The cold cathode field emission display according to claim 14, wherein a resistance layer is formed between the anode electrode units.

20. The cold cathode field emission display according to claim 19, wherein that edge portion of each anode electrode unit which does not face the adjacent anode electrode unit is covered with a resistance layer.

21. The cold cathode field emission display according to claim 19, wherein:

a gap is provided between each anode electrode unit and the electric supply line, and each anode electrode unit and the electric supply line are connected through a resistance element.

22. The cold cathode field emission display according to claim 21, wherein the electric supply line is constituted of electric supply line units in the number of M (2≦M≦N) connected in series through second resistance elements and one electric supply line unit is connected to one or at least two anode electrode units.

23. The cold cathode field emission display according to claim 19, wherein a stripe-shaped transparent electrode connected to the anode-electrode control circuit is formed between the phosphor layer and the substrate.

24. The cold cathode field emission display according to claim 23, wherein:

a plurality of unit phosphor layers, each constituting one picture element, are arranged in the form of a straight line and a stripe-shaped transparent electrode connected to the anode-electrode control circuit is formed between a column constituted of a plurality of the unit phosphor layers arranged in the form of a straight line and the substrate.

25. A cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, and an anode electrode formed on the phosphor layer, the anode electrode is constituted of anode electrode units in the number of N (N≧2), a resistance layer is formed between the anode electrode units, one anode electrode unit is connected to an anode-electrode control circuit, and $V_A/L_g<1$ (kV/μm) is satisfied in which $V_A$ (unit:kilovolt) is a voltage difference between an output voltage of the anode-electrode control circuit and a voltage applied to the cold cathode field emission device, and $L_g$ (unit:μm) is a gap length between the anode electrode units.

26. The cold cathode field emission display according to claim 25, wherein a stripe-shaped transparent electrode connected to the anode-electrode control circuit is formed between the phosphor layer and the substrate.

27. The cold cathode field emission display according to claim 26, wherein:

a plurality of unit phosphor layers, each constituting one picture element, are arranged in the form of a straight line and a stripe-shaped transparent electrode connected to the anode-electrode control circuit is formed between a column constituted of a plurality of the unit phosphor layers arranged in the form of a straight line and the substrate.

28. The cold cathode field emission display according to claim 25, wherein when the distance between the anode electrode unit and the cold cathode field emission device is d (unit:mm) and when the anode electrode unit has an area S (unit:$mm^2$), $(V_A/7)^2\times(S/d)\leqq 2250$ is satisfied.

29. The cold cathode field emission display according to claim 25, wherein that edge portion of each anode electrode unit which does not face the adjacent anode electrode unit is covered with a resistance layer.

30. A cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, and an anode electrode formed on the phosphor layer, the anode electrode is constituted of anode electrode units in the number of N (N≧2), a resistance layer is formed between the anode electrode units, one anode electrode unit is connected to an anode-electrode control circuit, $(V_A/7)^2\times(S/d)\leqq 2250$ is satisfied in which d (unit:mm) is a distance between the anode electrode unit and the cold cathode field emission device, and S (unit:$mm^2$) is an area of the anode electrode unit.

31. The cold cathode field emission display according to claim 30, wherein a stripe-shaped transparent electrode connected to the anode-electrode control circuit is formed between the phosphor layer and the substrate.

32. The cold cathode field emission display according to claim 31, wherein:

a plurality of unit phosphor layers, each constituting one picture element, are arranged in the form of a straight line and a stripe-shaped transparent electrode connected to the anode-electrode control circuit is formed between a column constituted of a plurality of the unit phosphor layers arranged in the form of a straight line and the substrate.

33. The cold cathode field emission display according to claim 30, wherein that edge portion of each anode electrode unit which does not face the adjacent anode electrode unit is covered with a resistance layer.

34. A cold cathode field emission display comprising a cathode panel having a plurality of cold cathode field emission devices and an anode panel which are bonded to each other in their circumferential portions, wherein:

the anode panel comprises a substrate, a phosphor layer formed on the substrate, and an anode electrode formed on the phosphor layer, the anode electrode is constituted of anode electrode units in the number of N (N≧2), and each anode electrode unit has a size that inhibits energy generated by a discharge taking place between the anode electrode unit and the cold cathode field emission device from vaporizing the anode electrode unit locally.

35. The cold cathode field emission display according to claim 34, wherein the anode electrode unit has a size that inhibits energy generated by a discharge taking place between the anode electrode unit and the cold cathode field emission device from vaporizing a portion of the anode electrode unit which portion has a size equivalent to one subpixel.

36. The cold cathode field emission display according to claim 34, wherein a resistance layer is formed between the anode electrode units.

* * * * *